US010691035B2

(12) United States Patent
Hara et al.

(10) Patent No.: US 10,691,035 B2
(45) Date of Patent: *Jun. 23, 2020

(54) BRILLIANT TONER, ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Satomi Hara, Minamiashigara (JP); Masaru Takahashi, Minamiashigara (JP); Yukiaki Nakamura, Minamiashigara (JP); Sakiko Takeuchi, Minamiashigara (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/434,341

(22) Filed: Jun. 7, 2019

(65) Prior Publication Data

US 2019/0285998 A1 Sep. 19, 2019

Related U.S. Application Data

(62) Division of application No. 16/106,603, filed on Aug. 21, 2018.

(30) Foreign Application Priority Data

Feb. 6, 2018 (JP) ..... 2018-019528
Feb. 6, 2018 (JP) ..... 2018-019529

(51) Int. Cl.
*G03G 9/08* (2006.01)
*G03G 9/09* (2006.01)
(Continued)

(52) U.S. Cl.
CPC ..... *G03G 9/0926* (2013.01); *G03G 9/0806* (2013.01); *G03G 9/0819* (2013.01);
(Continued)

(58) Field of Classification Search
CPC ..... G03G 9/0902; G03G 9/0926
(Continued)

(56) References Cited

U.S. PATENT DOCUMENTS

2014/0023964 A1* 1/2014 Hirai ..... G03G 9/09 430/105

FOREIGN PATENT DOCUMENTS

JP 2005316124 A 11/2005
JP 2010039276 A 2/2010
(Continued)

*Primary Examiner* — Mark A Chapman
(74) *Attorney, Agent, or Firm* — Sughrue Mion, PLLC

(57) ABSTRACT

A brilliant toner includes a first toner which contains a first toner particle containing a flake-shape brilliant pigment; and a second toner which contains a second toner particle containing a flake-shape brilliant pigment, and has a different color from that of the first toner, and an electrostatic charge image developing toner includes a first toner which contains a first toner particle; and a second toner which has a different color from that of the first toner, and contains the second toner particle, in which, based on a charge distribution of each of the first toner and the second toner obtained according to a charge spectrograph method, maximum peak positions of the first toner and the second toner are taken as $P_1$ and $P_2$, respectively, and full widths at half maximum of the first toner and the second toner are taken as $W_1$ and $W_2$, respectively, $|P_1-P_2|$ is 3 mm or less, and $|W_1-W_2|$ is 3 mm or less.

10 Claims, 6 Drawing Sheets

(51) Int. Cl.
*G03G 9/087* (2006.01)
*G03G 9/093* (2006.01)

(52) U.S. Cl.
CPC ..... *G03G 9/0821* (2013.01); *G03G 9/08782* (2013.01); *G03G 9/0902* (2013.01); *G03G 9/0904* (2013.01); *G03G 9/09307* (2013.01)

(58) Field of Classification Search
USPC ..... 430/107.1, 108.1
See application file for complete search history.

(56) References Cited

FOREIGN PATENT DOCUMENTS

| | | | |
|---|---|---|---|
| JP | 2014021300 | A | 2/2014 |
| JP | 6019865 | B2 | 11/2016 |

* cited by examiner

BRILLIANT TONER, ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is a Divisional of U.S. patent application Ser. No. 16/106,603, filed on Aug. 21, 2018, which claims priority under 35 USC 119 from Japanese Patent Application No. 2018-019528 filed Feb. 6, 2018, and Japanese Patent Application No. 2018-019529 filed Feb. 6, 2018.

BACKGROUND

(i) Technical Field

The present invention relates to a brilliant toner, an electrostatic charge image developing toner, an electrostatic charge image developer, and a toner cartridge.

(ii) Related Art

JP-A-2014-21300 discloses a toner set including at least a first brilliant toner containing at least a brilliant pigment; and a second brilliant toner which contains at least a brilliant pigment and has a different color from that of the first brilliant toner.

JP-A-2005-316124 discloses a producing method of an electrostatic charge image developing color toner, in which as the electrostatic charge image developing color toner containing a fixing resin, a coloring agent, and a surface treating agent, plural color toners, each containing a part of components of the coloring agent required to form a given color, are produced and the color toners are mixed, to obtain a color toner forming the given color; fine particles having a volume average particle diameter of 5 to 50 nm are used as the surface-treating agent of the toner and the anchoring rate of the surface-treating agent on the toner surface is 50%.

JP-A-2010-39276 discloses a method for producing a two-component developer is a method for producing a two-component developer including at least two colors of toners and a carrier, the method including a step A of obtaining the respective developers by mixing each toner with a carrier with each other, and a step B of mixing the developers obtained in the step A.

SUMMARY

Examples of a method of forming a brilliant image having a mixed color obtained by mixing plural colors include a method of obtaining plural brilliant toner images formed by using plural brilliant toners having different colors, and sequentially laminating the plural brilliant toner images formed of the brilliant toners. However, in a case of applying the brilliant toner using a flake-shape brilliant pigment to this method, a fixed image obtained by laminating plural brilliant toner images has an image with deteriorated brilliance as compared with a fixed image obtained by fixing a single layer of a brilliant toner image.

Aspects of non-limiting embodiments of the present disclosure relate to a brilliant toner which exhibits a target color and which may obtain a brilliant image with high brilliance as compared with a brilliant image obtained by using a brilliant toner set containing a first brilliant toner and a second brilliant toner which have different colors from each other, which corresponds to the following first aspect.

In addition, examples of a method of forming an image having a mixed color by mixing plural colors include a method of forming an image having the mixed color using a mixed color toner obtained by mixing plural color toners in advance, besides a method of forming an image having the mixed color obtaining by layering plural colors of toner images. However, for example, when a mixed color image is formed by using the mixed color toner on a recording medium having unevenness, areas having different color tones may be generated at places or the like corresponding to the concave portions of the recording medium among the formed images. In addition, for example, when a mixed color image is formed by using the mixed color toner on an easily chargeable recording medium such as a resin recording medium, areas having different color tones may be generated at end portions of the formed images.

Aspects of non-limiting embodiments of the present disclosure relate to an electrostatic charge image developing toner including a first toner which contains a first toner particle and a second toner which has a different color from that of the first toner and contains a second toner particle, in which an image having generation of areas having partially different color tone prevented is formed as compared with a case where at least one of $|P_1-P_2|$ and $|W_1-W_2|$ (as defined later) is larger than 3 mm, which corresponds to the following second aspect.

Aspects of certain non-limiting embodiments of the present disclosure overcome the above disadvantages and other disadvantages not described above. However, aspects of the non-limiting embodiments are not required to overcome the disadvantages described above, and aspects of the non-limiting embodiments of the present disclosure may not overcome any of the problems described above.

According to a first aspect of the present disclosure, there is provided a brilliant toner including a first toner which contains a first toner particle containing a flake-shape brilliant pigment; and a second toner which contains a second toner particle containing a flake-shape brilliant pigment, and has a different color from that of the first toner.

According to a second aspect of the present disclosure, there is provided an electrostatic charge image developing toner including a first toner which contains a first toner particle; and a second toner which has a different color from that of the first toner, and contains the second toner particle, in which, based on a charge distribution of each of the first toner and the second toner obtained according to a charge spectrograph method, maximum peak positions of the first toner and the second toner are taken as $P_1$ and $P_2$, respectively, and full widths at half maximum of the first toner and the second toner are taken as $W_1$ and $W_2$, respectively, $|P_1-P_2|$ is 3 mm or less, and $|W_1-W_2|$ is 3 mm or less.

BRIEF DESCRIPTION OF THE DRAWINGS

Exemplary embodiments of the present invention will be described in detail based on the following figures, wherein.

DETAILED DESCRIPTION

Figure 1A:
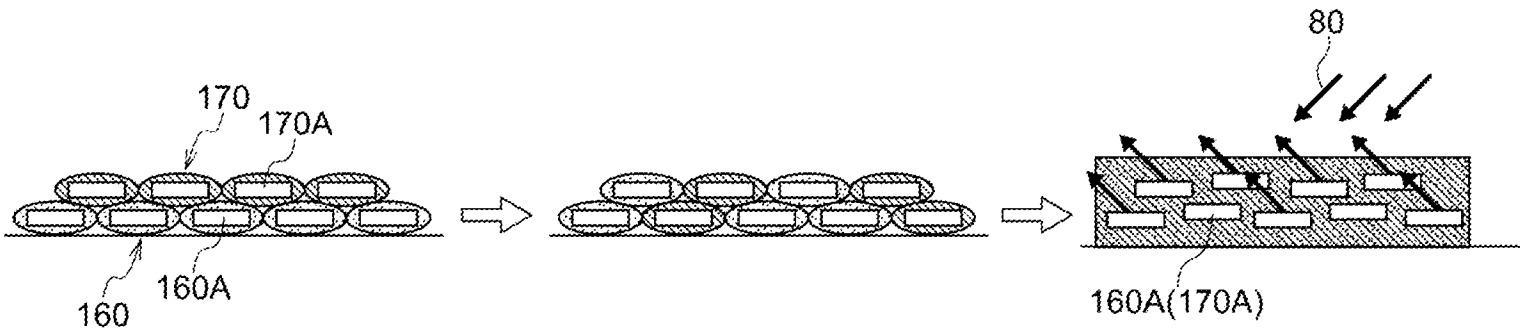
FIG. 1A is a diagram schematically illustrating an example of flow of forming, transferring, and fixing of a brilliant toner image in a case of using a brilliant toner set containing first brilliant toner and a second brilliant toner

Hereinafter, a brilliant toner according to Embodiment X for the first aspect will be described in detail.

<Brilliant Toner>

A brilliant toner according to Embodiment X includes a first toner which contains a first toner particle containing a flake-shape brilliant pigment and a second toner which contains a second toner particle containing a flake-shape brilliant pigment and has a color different from the first toner.

The first toner and the second toner are respectively brilliant toners including brilliant toner particles containing flake-shape brilliant pigments and are respectively referred to as a "first brilliant toner" and a "second brilliant toner", in some cases.

The first toner particle included in the first brilliant toner and the second toner particle included in the second brilliant toner are respectively brilliant toner particles containing flake-shape brilliant pigments, and, hereinafter referred to as a "first brilliant toner particle" and a "second brilliant toner particle", respectively.

Hereinafter, the brilliant toner including two or more kinds of brilliant toners having different colors is referred to as a "mixed brilliant toner". The brilliant toners of every color included in the mixed brilliant toner are collectively referred to as a "respective brilliant color toners", and the brilliant toner particles included in the brilliant toners of every color are collectively referred to as a "respective brilliant color toner particles".

The mixed brilliant toner according to Embodiment X has the above configuration such that a target color is exhibited, and a brilliant image with high brilliance may be obtained. Though the reason is not clear, it is assumed as follows.

Examples of a method of forming a brilliant image having a mixed color obtained by mixing plural colors include a method of obtaining a brilliant image having a mixed color by using plural brilliant toners with different colors, and sequentially laminating plural brilliant toner images formed of brilliant toners.

According to this method, in a case where the brilliant toner using the flake-shape brilliant pigment is used, a brilliant toner image including a flake-shape brilliant pigment is further laminated on the brilliant toner image of the flake-shape brilliant pigment. In the fixed image fixed to the recording medium after the plural brilliant toner images are laminated, the flake-shape brilliant pigments are easily present in an overlapped manner, and thus in a case where an image is fixed in a state in which the flake-shape brilliant pigments are overlapped, irregular reflection of light easily occurs in the fixed image.

Particularly, in a case where an image is formed in an intermediate transfer type, the alignment of the brilliant toner particles are disturbed in a step in which the plural laminated brilliant toner images are transferred such that the image may be fixed in a state in which the brilliant pigment is overlapped or in a state in which the alignment of the brilliant pigment is disturbed. In the same manner as in a case where the brilliant pigments are present in an overlapped manner, also in the fixed image in a state in which the alignment of the brilliant pigment is disturbed, the irregular reflection of the light easily occurs.

In contrast, in Embodiment X, the plural kinds of respective brilliant color toners having different colors are mixed in advance to thereby obtain a mixed brilliant toner exhibiting a target color, thereby easily obtaining a brilliant image exhibiting a target color without laminating the brilliant toner images. By fixing the brilliant toner image on the recording medium without lamination, as compared with a case where the brilliant toner images are laminated, the overlapping of the brilliant pigments or the disturbance of the alignment in the fixed image is prevented, so that the irregular reflection accompanied by the overlapping of the disturbance of the alignment is prevented.

From the above, in Embodiment X, it is assumed that the brilliant image exhibiting a target color and high brilliance may be obtained.

Figure 1B:
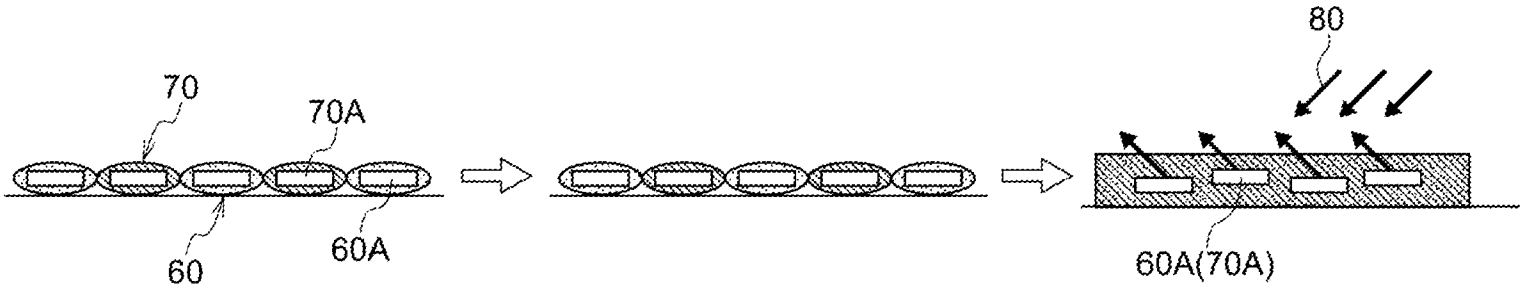
FIG. 1B is a diagram schematically illustrating an example of flow of forming, transferring, and fixing of a brilliant toner image in case of using a brilliant toner containing a first toner and a second toner.

Here, in FIGS. 1A and 1B, an example of the flow of forming, transferring, and fixing of the brilliant toner image in a case where the brilliant image is formed in the intermediate transfer type is schematically illustrated.

FIG. 1A illustrates a case where an image is formed by using a brilliant toner set having a first brilliant toner and a second brilliant toner, and FIG. 1B illustrates a case where an image is formed by using the mixed brilliant toner according to Embodiment X.

In an order from the left, FIG. 1A respectively illustrates a state in which the respective brilliant color toner images are laminated on an intermediate transfer member, a state after the laminated brilliant toner image is transferred from the intermediate transfer member to a recording medium, and a state after the transferred brilliant toner image is fixed on the recording medium. In an order from the left, FIG. 1B respectively illustrates a state in which the brilliant toner image is formed on an intermediate transfer member, a state in which the brilliant toner image is transferred from the intermediate transfer member to the recording medium, and a state in which the transferred brilliant toner image is fixed on the recording medium.

In FIGS. 1A and 1B, 60, 70, 160, and 170 denote brilliant toner particles, and 60A, 70A, 160A, and 170A denote flake-shape brilliant pigments, and 80 denotes light.

[Colors of Respective Brilliant Color Toners]

The color of the first brilliant toner and the color of the second brilliant toner are not particularly limited, as long as the colors are different from each other, and may be a chromatic color or an achromatic color, respectively. That is, the combination of the first brilliant toner and the second brilliant toner may be any one of a combination of a chromatic color and a chromatic color, a combination of a chromatic color and an achromatic color, and a combination of an achromatic color and an achromatic color.

Here, the "chromatic color" refers to a color having brightness, hue, and saturation, and a color other than the achromatic color. The "achromatic color" refers to a color that is described only by brightness among hue, brightness, and saturation and refers to white, gray, and black.

The brightness, the hue, and the saturation of the respective brilliant color toners are measured as follows. Specifically, with respect to the respective brilliant color toners of every color included in the mixed brilliant toner, coordinate values (L* value, a* value, and b* value) in the CIE1976L*a*b* color system by employing X-Rite 939 (aperture diameter: 4 mm, light source (illuminant): CIE standard light source D50, and standard observer (angle of view): 2 degree of visual field) are measured. At the time of the measurement, white high-quality paper (for example, mirror coated paper manufactured by Fuji Xerox Co., Ltd.) is used as a base. The brightness value, the hue angle, and the saturation value are obtained from the coordinate values as follows.

Specifically, the "brightness value" refers to an L* value in the coordinate values.

The "hue angle" refers to an angle formed by a line obtained by using a position (that is, a position of an achromatic color at which the a* axis and the b* axis intersect) at which a* and b* each are 0 in coordinates of the CIE1976L*a*b* color system as a starting point and connecting a position defined by a* and b* of the coordinate values and the starting point and the a* axis.

The "saturation value" refers to a value of c* obtained according to the following equation by using a* and b* of the coordinate values.

$$c^*=((a^*)^2+(b^*)^2)^{1/2} \quad \text{Equation:}$$

In the combination of the chromatic color and the chromatic color, the expression "colors are different from each other" refers to a case where the color difference ΔE represented by the following equation is 13.0 or more.

$$\Delta E=\{(L_1-L_2)^2+(a_1-a_2)^2+(b_1-b_2)^2\}^{1/2} \quad \text{Equation:}$$

Here, in the formula, $L_1$, $a_1$, and $b_1$ refer to an L* value, an a* value, and a b* value of the first toner in the CIE1976L*a*b* color system, respectively, and $L_2$, $a_2$, and $b_2$ refer to an L* value, an a* value, and a b* value of the second toner in the CIE1976L*a*b* color system, respectively.

In the combination of the achromatic color and the achromatic color, the expression "colors are different from each other" refers to a case where the brightness difference (that is, a value of $|L_1-L_2|$) is 13.0 or more.

Note that, the combination of the chromatic color and the achromatic color is a combination that "colors are different from each other".

In a case where the brightness of the first brilliant toner and the brightness of the second brilliant toner are different from each other, the difference between the "brightness values" is preferably 65 or less, more preferably 45 or less, and even more preferably 30 or less.

In a case where the hue of the first brilliant toner and the hue of the second brilliant toner are different from each other, the difference between the "hue angles" is preferably 150 degrees or less, more preferably 105 degrees or less, and even more preferably 60 degrees or less.

In a case where the saturation of the first brilliant toner and the saturation of the second brilliant toner are different from each other, the difference between "saturation values" is preferably 50 or less, more preferably 40 or less, and even more preferably 30 or less.

[Average Projected Circularity and Average Projected Circle Equivalent Diameter of Brilliant Toner Particle on Flake Surface]

In Embodiment X, the respective brilliant color toner particles are preferably flake. In a case where the respective brilliant color toner particles are flake, the flake-shape brilliant pigments are easily aligned in the fixed image.

The average projected circularity of the respective brilliant color toner particles on the flake surface is preferably 0.90 to 0.95, more preferably 0.92 to 0.94, and even more preferably 0.925 to 0.930.

Here, the "flake surface" refers to a surface in which the projected area becomes the maximum.

Hereinafter, the average projected circularity on the flake surface may be referred to as an "average projected circularity".

In a case where the average projected circularity of the respective brilliant color toner particles is in the above range, a brilliant image, which exhibits an intended color and in which areas having partially different color tones are hardly generated, is formed. Though the reason is not clear, it is assumed as follows.

Generally, the flake-shape brilliant pigment has a flake and irregular shape in many cases, such that the brilliant toner particle including the flake-shape brilliant pigment may be easily caused to have a flake and irregular shape and the shapes and the charging properties of the brilliant toner particles may be different from each other. If the shapes and the charging properties of the brilliant toner particles vary, the transfer efficiency in a case where the brilliant toner images are transferred may be uneven, or a portion of the brilliant toner particles may be easily scattered to a non-image area, selectively.

Specifically, for example, in a case where the brilliant image is formed by using the mixed brilliant toner in the uneven recording medium, in the concave portion of the recording medium, the distance between the brilliant toner image and the surface of the recording medium at the time of transfer is farther than the convex portion, and thus the transfer electric field tends to be low. In a case where the transfer electric field becomes low, a brilliant toner having a low charge amount is hardly transferred, and thus in a case where the charging properties vary for each brilliant toner particle, the transfer efficiency of the brilliant toner particle easily varies.

According to the variation, in a case where an area in which a difference is generated between the transfer efficiency of the first brilliant toner particle and the transfer efficiency of the second brilliant toner particle is generated, the area becomes an area having a partially different color from those of the other areas.

For example, in a case where the recording medium is easily charged like a resin recording medium, at the end portion of the image, a brilliant toner having a high charge amount or a brilliant toner having a low charge amount may be selectively scattered to the non-image area. At this point, in a case where a difference in the charge amount of the first brilliant toner particle and charge amount of the second brilliant toner particle is generated due to the variation of the shape or the charge properties for each brilliant toner particle, one brilliant toner particle is selectively scattered to a non-image area, and an area having a different color may partially glitters at an end portion of the image.

In contrast, in a case where the average projected circularity of the respective brilliant color toner particles is in the above range, the flake surface becomes circular as compared with a case where the average projected circularity is lower than the above range. Therefore, it is assumed that the variation of the shape or the charge properties for each brilliant toner particle is prevented, and a difference between the transfer efficiency of the first brilliant toner particle and the transfer efficiency of the second brilliant toner particle and a difference between the charge amount of the first brilliant toner particle and the charge amount of the second brilliant toner particle, which may be caused by the variation, are hardly caused, thereby forming a brilliant image in which the areas having partially different color tones are hardly generated and which exhibits the intended color.

In a case where the average projected circularity of the first brilliant toner particle on the flake surface is taken as $R_1$, and the average projected circularity of the second brilliant toner particle on the flake surface is taken as $R_2$, the difference between $R_1$ and $R_2$ is preferably 0.02 or less, more preferably 0.01 or less, and even more preferably 0.005 or less.

In a case where the average projected circle equivalent diameter of the first brilliant toner particle on the flake surface is taken as $D_1$, and the average projected circle equivalent diameter of the second brilliant toner particle on the flake surface is taken as $D_2$, the difference between $D_1$ and $D_2$ is preferably 1.0 μm or less, more preferably 0.5 μm or less, and even more preferably 0.2 μm or less.

Hereinafter, the average projected circle equivalent diameter on the flake surface is simply referred to as an "average projected circle equivalent diameter" in some cases.

In a case where the difference between $R_1$ and $R_2$ and the difference between $D_1$ and $D_2$ is in the above ranges, a brilliant image which exhibits an intended color and in which areas having partially different color tones are hardly generated is formed. The reason thereof is not clear, but it is assumed that, as compared with a case where the difference between the average projected circularity and the average projected circle equivalent diameter is caused to be small, in a case where the differences between the shapes and the charge properties of the first brilliant toner particle and the second brilliant toner particle are caused to be small, the differences between the transfer efficiency and the charge amounts become small such that a brilliant image in which the areas having partially different color tones are hardly generated and which exhibits an intended color is formed.

The method of measuring the average projected circularity and the average projected circle equivalent diameter is described as below.

A dispersion is obtained by dispersing the mixed brilliant toner to the aqueous solution including the surfactant. The obtained dispersion is dropwise added into a glass bottle and is allowed to keep for one hour. Thereafter, observation is performed while discriminating colors by an optical microscope, and the projected circularity and the projected circle equivalent diameter of each of the brilliant toner particles are measured by image analysis software. The projected circularity and the projected circle equivalent diameter for 500 pieces for each of the brilliant color toner particles are measured and averaged so as to calculate the average projected circularity and the average projected circle equivalent diameter.

The surfactant used in the above-described measurements is not particularly limited, and examples thereof include TAYCAPOWER (manufactured by TAYCA). Examples of the image analysis software include VISION SOFTWARE (manufactured by Cognex Corporation).

The projected circularity is a value represented by the following equation.

$$\text{Projected circularity} = (\text{Circle equivalent perimeter}) / (\text{perimeter of projected image}) \quad \text{Equation:}$$

The "circle equivalent perimeter" means a perimeter of a circle having the same projected area as the projected image of the brilliant toner particle.

The projected circle equivalent diameter means a diameter of a circle having the same projected area as the projected image of the brilliant toner particle.

The method of causing the average projected circularity of the respective brilliant color toner particles to be in the above range is not particularly limited, and examples thereof include a method of further applying a resin after producing a brilliant toner particle in the related art.

Examples of the method of applying a resin include a method of mechanically colliding a resin (for example, a resin particle) with a dry particle composite apparatus (for example, NOBILTA manufactured by Hosokawa Micron Ltd.).

The method of causing the difference between $R_1$ and $R_2$ and the difference between $D_1$ and $D_2$ to be in the above range is not particularly limited, and examples thereof include a method of causing the average projected circularity of the respective brilliant color toner particles to be in the above range.

Figure 2A:
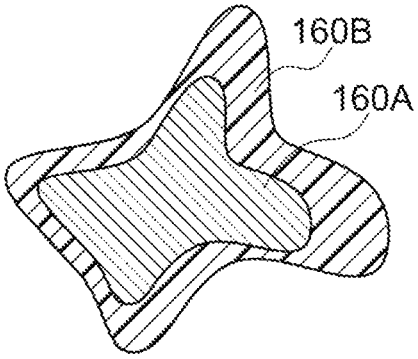
FIG. 2A is a diagram schematically illustrating a cross section of a flake surface of a brilliant toner particle before performing coating of a resin by a dry particle composite apparatus.
Figure 2B:
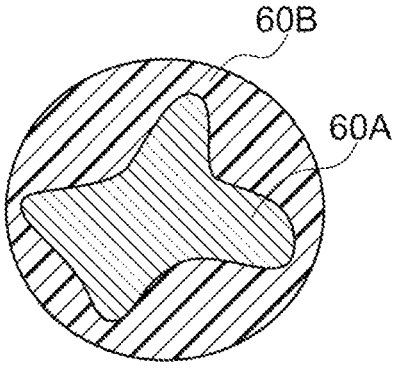
FIG. 2B is a diagram schematically illustrating a cross section of a flake surface of a brilliant toner particle after performing coating of a resin by a dry particle composite apparatus.

FIGS. 2A and 2B schematically illustrate a change in a cross section of a flake surface of the brilliant toner particle before and after adhesion of the resin by the dry particle composite apparatus. FIG. 2A illustrates a brilliant toner particle before the adhesion of a resin by the dry particle composite apparatus, which corresponds to the brilliant toner particle in the related art. FIG. 2B illustrates a brilliant toner particle after the adhesion of a resin to a brilliant toner particle in the related art by the dry particle composite apparatus, which corresponds to the brilliant toner particle according to Embodiment X. In FIGS. 2A and 2B, 60A and 160A denote flake-shape brilliant pigments, and 60B and 160B denote resins.

[Charge Spectrograph Method]

With respect to Embodiment X, when, based on a charge distribution of each of the first brilliant toner and the second brilliant toner obtained according to a charge spectrograph method, maximum peak positions of the first brilliant toner and the second brilliant toner are taken as $P_1$ and $P_2$, respectively, and full widths at half maximum of the first brilliant toner and the second brilliant toner are taken as $W_1$ and $W_2$, respectively, it is preferable that $|P_1-P_2|$ is 3 mm or less and $|W_1-W_2|$ is 3 mm or less.

In a case where $|P_1-P_2|$ and $|W_1-W_2|$ are in the above range, a brilliant image which exhibits an intended color and in which areas having partially different color tones are hardly generated is formed. Though the reason is not clear, it is assumed as follows.

In a case where $|P_1-P_2|$ and $|W_1-W_2|$ are in the above range, the first brilliant toner and the second brilliant toner included in the mixed brilliant toner have similar charge properties to each other, and thus the generation of the charges due to the contact between the first brilliant toner and the second brilliant toner is also prevented. Therefore, the difference between the transfer efficiency of the first brilliant toner particle and the transfer efficiency of the second brilliant toner particle and the difference between the charge amount of the first brilliant toner particle and the charge amount of the second brilliant toner particle are hardly generated. Accordingly, it is assumed that a brilliant image in which the areas having partially different color tones are hardly generated and which exhibits the intended color is formed.

Hereinafter, a charge spectrograph method is described.

Figure 3:
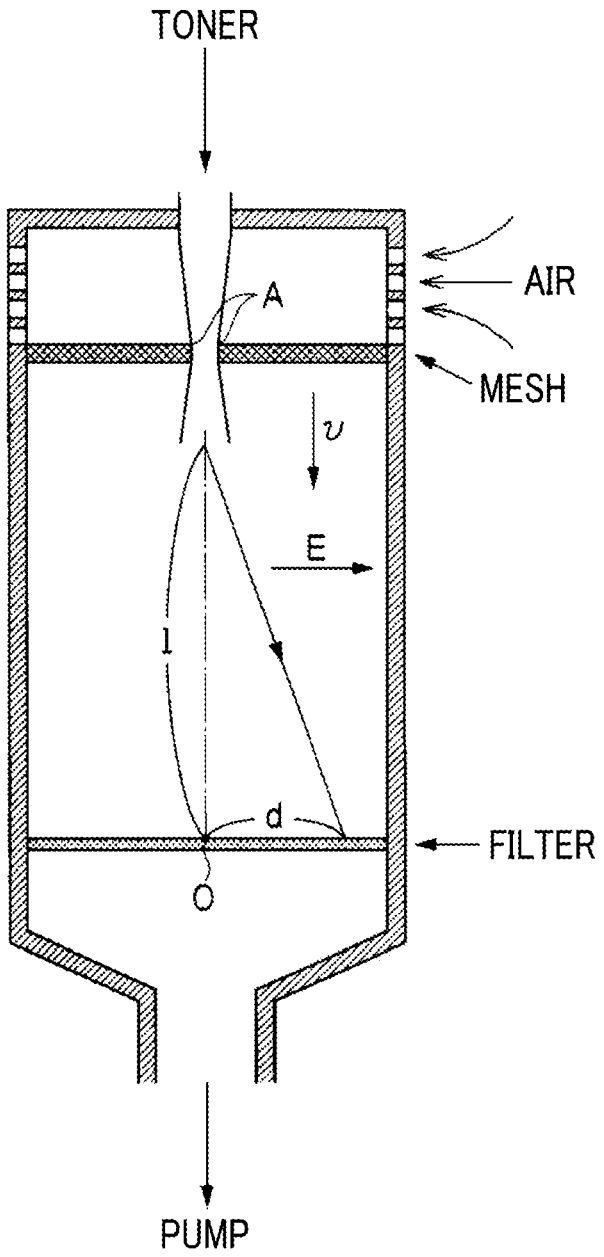
FIG. 3 is a diagram schematically illustrating an apparatus of a charge spectrograph method.

As illustrated in FIG. 3, an air laminar flow of a velocity v in the vertical direction and an electric field E perpendicular to this flow are formed in a cylindrical container having a length l by the charge spectrograph method. The mixed brilliant toner charged from the center of the upper end portion is inserted and the respective brilliant color toner particles of every color contained in the mixed brilliant toner moves in the vertical direction by the electric field while moving to a lower end portion by the air laminar flow. A filter is laid on the bottom surface of the cylindrical container and the distribution of the brilliant color toner particles of every color captured on the filter in the vertical direction from a center point 0 is measured with a microscope. Specifically, the image obtained by the microscope is color-separated and binarized, and the distribution is obtained by extracting the number for each color.

Examples of the filter include a white filter, and in a case where observation becomes difficult if a white filter (for example, in a case where the mixed toner contains at least one of a white toner or a colorless toner) is used, a colored filter (for example, a gray filter) may be used.

In each of the brilliant toner particles, the relation between the distance d in the vertical direction from the center point 0 and a charge amount q of the brilliant toner particle is represented by the following equation.

$$q/r=(6\times\pi\times\eta\times d\times v)/(1\times E) \quad \text{Equation:}$$

In the equation, r represents a radius of the brilliant toner particle, and η represents a viscosity of the air. That is, the distance d is a factor depending on the radius r and the charge amount q of the brilliant toner particle.

In a case where the brilliant toner particle is flake, the radius r of the brilliant toner particle corresponds to a half of the projected circle equivalent diameter.

The measurement conditions of a specific charge spectrograph method are as follows.

The length l of the cylindrical container is 18 cm, and the electric field E is 100 V/cm. The velocity v of the air flow is caused to be constant by setting the internal pressure to 350 mmHg. The upper aperture diameter A of the cylindrical container is 0.7 mm, and the diameter of the cylindrical container is 6 cm.

The "charged mixed brilliant toner" is obtained as follows. Specifically, 8 parts of the mixed toner and 100 parts of the carrier are set in a TURBULA shaker mixer (101 rpm) and stirred for five minutes.

As the carrier, those produced by the following method are used.

Ferrite particle (average particle diameter: 50 μm): 100 parts

Toluene: 14 parts

Styrene/methyl methacrylate copolymer (copolymerization ratio: 15/85): 3 parts

Carbon black: 0.2 parts

The above components other than ferrite particles are dispersed in a sand mill to prepare a dispersion, the dispersion is introduced into a vacuum degassing type kneader together with the ferrite particles, and the carrier is obtained by reducing the pressure while stirring and drying.

Measurement with respect to the brilliant color toner particles of every color on the filter is performed as follows. Specifically, the number of the brilliant color toner particles of every color per 500 $mm^2$ (that is, in the region of 50 mm×10 mm) at the position of the distance d from the center point 0 in the vertical direction is measured by a laser microscope (VK8500, manufactured by Keyence Corporation), thereby obtaining the charge distribution for the brilliant color toners of every color.

In the charge distribution of the first brilliant toner obtained by the method, the maximum peak position is taken as $P_1$, and the full width at half maximum is taken as $W_1$, and in the charge distribution of the second brilliant toner, the maximum peak position is taken as $P_2$, and the full width at half maximum is taken as $W_2$. The "maximum peak position" refers to the distance d (that is, a distance from the center point 0) of the maximum peak (that is, a point having the largest number of the brilliant toner particles per unit area) in the charge distribution.

The difference (that is, $|P_1-P_2|$) between $P_1$ and $P_2$ is preferably 3 mm or less, more preferably 2 mm or less, and even more preferably 1 mm or less. The difference (that is, $|W_1-W_2|$) between $W_1$ and $W_2$ is preferably 3 mm or less, more preferably 2 mm or less, and even more preferably 1 mm or less.

It is preferable that the ratio (that is, $P_2/P_1$) of $P_2$ to $P_1$ is preferably 0.62 to 1.6 or less, more preferably 0.75 to 1.25, and even more preferably 0.85 to 1.15.

The method of causing $|P_1-P_2|$ and $|W_1-W_2|$ to be in the above ranges is not particularly limited, and examples thereof include a method of using coloring agents having similar charge properties as a coloring agent other than the brilliant pigments included in each of the brilliant color toner particles, a method of preventing the variation of compositions on the surface of each of the brilliant color toner particles, and a combination of these methods.

Examples of the method of preventing the variation of the compositions on each of the brilliant color toner particles include a method of applying a resin by mechanically colliding a resin with a dry particle composite apparatus as described above.

[Fluidity of Mixed Brilliant Toner]

The fluidity with respect the entire mixed brilliant toner according to Embodiment X is preferably 15 sec/50 g to 40 sec/50 g, more preferably 20 sec/50 g to 35 sec/50 g, and even more preferably 20 sec/50 g to 30 sec/50 g.

In a case where the fluidity with respect to the entire mixed brilliant toner is in the above range, the mixed brilliant toner easily flows, and thus the variation of the charge distribution is prevented, such that the difference between the transfer efficiency of the first brilliant toner particle and the transfer efficiency of the second brilliant toner particle and the difference between the charge amount of the first brilliant toner particle and the charge amount of the second brilliant toner particle are hardly generated. Accordingly, it is assumed that a brilliant image in which the areas having partially different color tones are hardly generated and which exhibits the intended color is formed.

Here, the fluidity with respect to the entire mixed brilliant toner is a value measured based on JIS-Z2502 (year: 2000) under the conditions of 25° C. and 50% RH with respect to the mixed brilliant toner.

The method of causing the fluidity with respect to the entire mixed brilliant toner is not particularly limited, and examples thereof include a method of further applying a resin with a dry particle composite apparatus as described above and a method of causing the average projected circularity of the respective brilliant color toner particles in the above range.

[Mixed Brilliant Toner]

Hereinafter, the mixed brilliant toner according to Embodiment X will be described.

The mixed brilliant toner contains a first brilliant toner and a second brilliant toner.

The first brilliant toner and the second brilliant toner may be identical to or different from each other except for having different colors, but the composition and the properties of the brilliant toner (for example, a diameter or a shape of the brilliant toner particle) except for the properties relating to the coloring agent other than the brilliant pigment are preferably the same.

If necessary, the mixed brilliant toner may contain the other brilliant toner in addition to the first brilliant toner and the second brilliant toner. The other brilliant toner may contain two or more brilliant toners having different colors. That is, the mixed brilliant toner only have to contain brilliant toners of two or more colors, may include brilliant toners of three or more colors, and may include brilliant toners of four or more colors.

In a case where the mixed brilliant toner contains the other brilliant toner, it is preferable that all of the first brilliant toner, the second brilliant toner, and the other brilliant toner are flake, and their average projected circularity is in the above range.

In a case where the mixed brilliant toner contains the other brilliant toner, it is preferable that a difference between a maximum value and a minimum value of the average projected circularity among the respective brilliant color toners and a difference between a maximum value and a minimum value of the average projected circle equivalent diameter among the respective brilliant color toners are in the above ranges, respectively, which are described with respect to the difference between $R_1$ and $R_2$, and the difference between $D_1$ and $D_2$, respectively.

In a case where the mixed brilliant toner contains the other brilliant toner, it is preferable that the difference between a maximum value and a minimum value of the maximum peak position in the charge distribution among all the respective brilliant color toners is in the above range, which is described with respect to $|P_1-P_2|$ and it is more preferable that a ratio between the maximum value and the minimum value of the maximum peak position is in the above range, which is described with respect to $P_2/P_1$.

In a case where the mixed brilliant toner contains the other brilliant toner, it is preferable that the fluidity with respect to the entire mixed brilliant toner is in the above range.

If necessary, the mixed brilliant toner may contain the other toner than the brilliant toner or may contain the other component than the toner. Here, a content of the other toner with respect to the entire mixed brilliant toner is preferably 10% by weight or less and more preferably 5% by weight or less. The content of the other component with respect to the entire mixed brilliant toner is preferably 10% by weight or less and more preferably 5% by weight or less.

A content ratio of the second brilliant toner to the first brilliant toner included in the mixed brilliant toner varies depending on an intended color of the mixed brilliant toner and colors of the respective brilliant color toners and is not particularly limited. For example, the content ratio (that is, content of second brilliant toner/content of first brilliant toner) of the second brilliant toner to the first brilliant toner is 0.1 to 10, preferably 0.2 to 5, and more preferably 0.5 to 2.

For example, the mixed brilliant toner is produced by mixing the first brilliant toner and the second brilliant toner. In a case where the first brilliant toner and the second brilliant toner contain external additives (for example, a charge control agent), the external additives may be attached to each of the brilliant color toner particles by mixing the first brilliant toner particle, the second brilliant toner particle, and the external additive, the external additive may be added after the first brilliant toner particle and the second brilliant toner particle are mixed, and the external additives may be attached to each of the brilliant color toner particles to produce the first brilliant toner and the second brilliant toner, which are then mixed.

The mixing method is not particularly limited, and examples thereof include mixing with a V blender, a Henschel mixer, a Loedige mixer or the like.

With respect to the mixed brilliant toner, in a case where a solid image is formed, a ratio (A/B) of a reflectance A at an acceptance angle of +30° and a reflectance B at an acceptance angle of −30°, as measured in a case where the image is irradiated with incident light at an incident angle of −45° by a goniophotometer, is preferably 1.5 to 60.

The fact that the ratio (A/B) is 1.5 or more means that the reflection to the side (angle+side) opposite to the side on which the incident light is incident is appropriately more than the reflection to the side on which the incident light is incident (angle−side), that is, irregular reflection of the incident light is prevented. In a case where irregular reflection in which the incident light is reflected in various directions occurs, if the reflected light is visually checked, the color looks dull. Therefore, in a case where the ratio (A/B) is less than 1.5, gloss is not checked even in a case where the reflected light is visually recognized, and the brilliant may be inferior in some cases.

In a case where the ratio (A/B) is greater than 60, the color of the base is hardly seen in some cases.

The ratio (A/B) is preferably 5 to 50 and more preferably 10 to 40.

Measuring of Ratio (A/B) by Goniophotometer

Here, the incident angle and the acceptance angle are described. At the time of measurement by a goniophotometer according to Embodiment X, the incident angle is taken as −45°, but this is because the measurement sensitivity is high with respect to the image in the range of wide glossiness.

The reason that the acceptance angle is set to −30° and +30° is that the measurement sensitivity is highest for evaluating images with brilliance feeling and images without brilliance feeling.

Subsequently, a method of measuring the ratio (A/B) is described.

According to Embodiment X, at the time of measuring the ratio (A/B), the "solid image" is formed by the following method. A developer serving as a sample is charged in a developer of DocuCentre-III C7600 manufactured by Fuji Xerox Co., Ltd., and a solid image having a toner applied amount of 4.5 g/m$^2$ is formed on a recording sheet (OK top coat+paper, glossiness: 75, whiteness degree: 85.0 manufactured by Oji Paper Co., Ltd.) at a fixing temperature of 190° C. and a fixing pressure of 4.0 kgf/cm$^2$.

Incident light having an incident angle of −45° to a solid image is incident to the image portion of the formed solid image, by using a spectral type goniometric color difference meter GC5000L manufactured by Nippon Denshoku Industries Co., Ltd. as a goniophotometer, so as to measure the reflectance A at an acceptance angle of +30° and the reflectance B at an acceptance angle −30°. Note that, the reflectance A and the reflectance B are measured at intervals of 20 nm for light having wavelengths in the range of 400 nm to 700 nm, and are taken as an average value of the reflectance at each wavelength. A ratio (A/B) is calculated from these measurement results.

In view of satisfying the above ratio (A/B), it is preferable that the mixed brilliant toner satisfies the following requirements (1) and (2).

(1) The average circle equivalent diameter D is longer than the average maximum thickness C of the brilliant toner particles.

(2) In a case where a cross section is observed in the thickness direction of the brilliant toner particle, the number of brilliant pigments in which an angle between a major axis direction in the cross section of the brilliant toner particle and a major axis direction of the brilliant pigment is from −30° to +30° is 60% or more of the total brilliant pigment observed.

Figure 4:
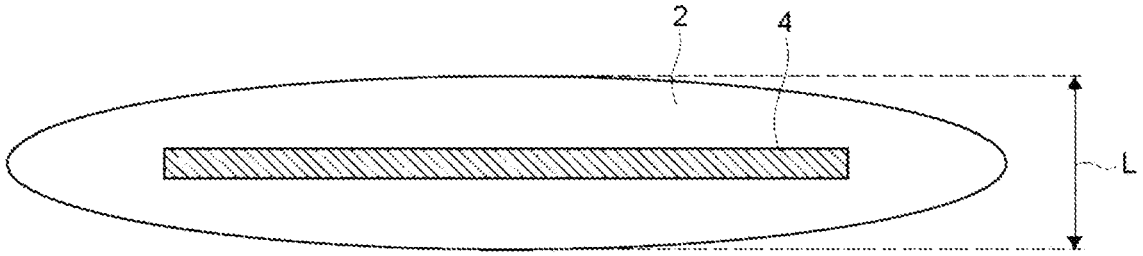
FIG. 4 is a sectional view schematically illustrating a brilliant toner particle of Embodiment X.

Here, FIG. 4 is a sectional view schematically illustrating a brilliant toner particle satisfying the above requirements (1) and (2). The schematic view illustrated in FIG. 4 is a sectional view of the brilliant toner particle in the thickness direction.

A brilliant toner particle 2 illustrated in FIG. 4 is a flake-shape brilliant toner particle having a circle equivalent longer than a thickness L and contains a flaky-shape metal pigment 4 which is a type of brilliant pigment.

Average Maximum Thickness C and Average Circle Equivalent Diameter D

As indicated in (1) above, it is preferable that the average circle equivalent diameter D of the brilliant toner particle contained in the mixed brilliant toner is longer than the average maximum thickness C thereof. Note that, a ratio (C/D) between an average maximum thickness C and an average circle equivalent diameter D is preferably 0.001 to 0.500, is more preferably 0.010 to 0.200, and is particularly preferably 0.050 to 0.100.

In a case where the ratio (C/D) is 0.001 or more, the strength of the brilliant toner is secured, so that breakage due to stress at the time of image formation is prevented, and the exposure of the brilliant pigment causes the reduction of charging, so that fogging is prevented. On the other hand, in a case where the ratio (C/D) is 0.500 or less, excellent brilliance may be obtained.

The average maximum thickness C and the average circle equivalent diameter D are measured by the following method.

The mixed brilliant toner is placed on a smooth surface and is vibrated so as to be dispersed not to have unevenness. 1,000 brilliant toner particles are magnified 1,000 times by a color laser microscope "VK-9700" (manufactured by Keyence Corporation), the maximum thickness C and the circle equivalent diameter D of the surface viewed from above are measured, and the arithmetic mean value thereof is obtained so as to calculate the average maximum thickness C and the average circle equivalent diameter D.

Major Axis Direction in Cross Section of Brilliant Toner Particle and Major Axis Direction of Brilliant Pigment As described in the above (2), in a case where a cross section is observed in the thickness direction of the brilliant toner particle, the number of brilliant pigments in which an angle between a major axis direction in the cross section of the brilliant toner particle and a major axis direction of the brilliant pigment is from −30° to +30° is preferably 60% or more of the total brilliant pigments observed. Further, the above number is preferably from 70% to 95%, and is particularly 80% to 90%.

In a case where the above number is 60% or more, excellent brilliance may be obtained.

Here, a method of observing the cross section of the brilliant toner particle will be described.

The mixed brilliant toner is embedded with a bisphenol A type liquid epoxy resin and a curing agent, and then a cutting sample is prepared. Next, the cutting sample is cut at −100° C. using a cutting machine using a diamond knife (in Embodiment X, LEICA Ultramicrotome (manufactured by Hitachi Technologies)) so as to prepare observation samples. The cross section of the brilliant toner particle is observed with a transmission electron microscope (TEM) at a magnification of about 5,000 times. Regarding observed 1,000 brilliant toner particles, the number of brilliant pigments in which an angle between a major axis direction in the cross section of the brilliant toner particle and a major axis direction of the brilliant pigment is from −30° to +30° is calculated by the image analysis software and the ratio thereof is calculated.

Note that, "a major axis direction in the cross section of the brilliant toner particle" means a direction orthogonal to the thickness direction of the brilliant toner particles having an average circle equivalent diameter D longer than the above-mentioned average maximum thickness C, and "a major axis direction of the brilliant pigment" means a length direction in the brilliant pigment.

[Respective Brilliant Color Toners]

Hereinafter, the respective brilliant color toners will be described.

The respective brilliant color toners are configured to include a brilliant toner particle and if necessary, an external additive.

(Brilliant Toner Particle)

The brilliant toner particle is configured to include, for example, a binder resin, a flake-shape brilliant pigment, and if necessary, a coloring agent, a release agent, and other additives, in addition to the brilliant pigment.

—Binder Resin—

Examples of the binder resin include vinyl resins formed of homopolymer of monomers such as styrenes (for example, styrene, para-chloro styrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenic unsaturated nitriles (for example, acrylonitrile, and methacrylonitrile), vinyl ethers (for example, vinyl methyl ether, and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

As the binder resin, there are also exemplified non-vinyl resins such as an epoxy resin, a polyester resin, a polyurethane resin, a polyamide resin, a cellulose resin, a polyether resin, and a modified rosin, a mixture of the above-described vinyl resins, or a graft polymer obtained by polymerizing a vinyl monomer with the coexistence of such non-vinyl resins.

These binder resins may be used singly or in combination of two or more thereof.

As the binder resin, a polyester resin is preferably used.

Examples of the polyester resin include a known polyester resin.

Examples of the polyester resin include condensation polymers of polyvalent carboxylic acids and polyol. A commercially available product or a synthesized product may be used as the polyester resin.

Examples of the polyvalent carboxylic acid include an aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), an alicyclic dicarboxylic acid (for example, cyclohexane dicarboxylic acid), an aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, an aromatic dicarboxylic acid is preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol. As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more thereof.

The glass transition temperature (Tg) of the polyester resin is preferably from 50° C. to 80° C., and further preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the polyester resin is preferably from 5,000 to 1,000,000, and is further preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC & HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

The content of the binder resin is, for example, preferably from 40% by weight to 95% by weight, is more preferably from 50% by weight to 90% by weight, and is still more preferably from 60% by weight to 85% by weight, with respect to the entire brilliant toner particle.

—Flake-Shape Brilliant Pigment—

Examples of the flake-shape brilliant pigment include metal pigments such as aluminum, brass, bronze, nickel, stainless steel, and zinc; mica coated with titanium oxide or yellow iron oxide; flaky crystals or plate crystals such as aluminosilicate, basic carbonate, barium sulfate, titanium oxide, and bismuth oxychloride; flaky glass powder; and metal-deposited flaky glass powder. Among them, a metal pigment is preferable from the viewpoint of specular reflection intensity, and from the viewpoint of higher specular reflection intensity, a flake-shape metal pigment is more preferable. Among the metallic pigments, an aluminum pigment is preferable from the viewpoint of easily obtaining a flake-shape powder. The surface of the metallic pigment may be coated with silica, an acrylic resin, a polyester resin, or the like.

The volume average particle diameter of the brilliant pigment is preferably from 3 μm to 20 μm, is more preferably from 4.5 μm to 18 μm, and is particularly preferably from 6 μm to 16 μm.

In Embodiment X, various average particle diameters and various particle diameter distribution indices of the particles are measured using a Coulter Multisizer II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% aqueous solution of surfactant (preferably sodium alkyl benzene sulfonate) being a dispersing agent. The obtained material is added to 100 ml to 150 ml of the electrolyte.

The electrolyte in which the sample is suspended is subjected to a dispersion treatment using an ultrasonic disperser for one minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume particle diameter distribution index (GSDv) is calculated as $(D84v/D16v)^{1/2}$, while a number particle diameter distribution index (GSDp) is calculated as $(D84p/D16p)^{1/2}$.

The larger diameter side volume particle diameter distribution index (upper GSDv) is calculated as $(D84v/D50v)^{1/2}$, and the smaller diameter side volume particle diameter distribution index (lower GSDv) is calculated as $(D50v/D16v)^{1/2}$. The presence or absence of a peak and the peak position in the particle diameter distribution are obtained from the particle diameter distribution of the measured particles.

The content of the brilliant pigment in the brilliant toner particles is preferably from 1 part by weight to 70 parts by weight, is more preferably from 5 parts by weight to 50 parts by weight, based on 100 parts by weight of the binder resin.

—Coloring Agent Other than Brilliant Pigment—

Examples of the coloring agent other than the brilliant pigment includes various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents other than the brilliant pigment may be used alone or two or more kinds thereof may be used in combination.

Examples of the coloring agent other than the brilliant pigment include coloring pigments such as Pigment Orange, Pigment Green, Pigment Violet, and dyes such as white dyes such as titanium oxide, zinc white, and Pigment White, acid dyes (ACID RED, ACID BLUE, ACID GREEN, ACID BROWN, ACID BLACK, ACID VIOLET, ACID YELLOW, and ACID ORANGE), and basic dyes or cationic dyes (BASIC RED, BASIC VIOLET, BASIC ORANGE, BASIC YELLOW, BASIC BLUE, BASIC GREEN, BASIC BROWN).

As the coloring agent other than the brilliant pigment, a surface-treated coloring agent may be used if necessary, and it may be used together with a dispersing agent. Further, plural kinds of the coloring agents other than the brilliant pigment may be used in combination.

The content of the coloring agent other than brilliant pigment is, for example, preferably from 1% by weight to 30% by weight, and is more preferably from 3% by weight to 15% by weight, with respect to the entire brilliant toner particle. The content of the coloring agent other than brilliant pigment is, for example, preferably from 5 parts by weight by weight to 60 parts by weight, and is more preferably from 10 parts by weight to 50 parts by weight, with respect to 100 parts by weight of the brilliant pigment.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is further preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably from 1 weight % to 20 weight %, and is more preferably from 5 weight % to 15 weight % with respect to the entire brilliant toner particles.

—Other Additives—

Examples of other additives include known additives such as a magnetic material, a charge-controlling agent, and an inorganic powder. These additives are contained in the brilliant toner particle as internal additives.

—Properties or the Like of Brilliant Toner Particle—

An average projected circle equivalent diameter of the brilliant toner particles is preferably from 8 μm to 12 μm, and is more preferably from 9 μm to 11 μm.

(External Additive)

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably from 0.01 weight % to 5 weight %, and is further preferably from 0.01 weight % to 2.0 weight % with respect to the brilliant toner particles.

(Preparation of Respective Brilliant Color Toners)

Next, the respective brilliant color toners may be prepared by adding the additive to the brilliant toner particle after preparing the brilliant toner particle.

A method of preparing the brilliant toner particle is not particularly limited, and examples thereof include a dry method such as a kneading.pulverization method which is well known, and a wet method such as aggregation and coalescence method and a dissolution suspension method.

<Kneading.Pulverization Method>

In the kneading.pulverization method, materials such as the brilliant pigment are mixed with each other, then the aforementioned materials are molten-kneaded by a kneader, an extruder, and the like, and the obtained molten-kneading material is finely pulverized, is pulverized by a jet mill, and is classified by a wind classifier, thereby obtaining a brilliant toner particle having a desired particle size.

More specifically, the kneading pulverization method includes a step of kneading a toner-forming material containing the brilliant pigment and the binder resin, and a step of pulverizing the kneaded material. If necessary, the kneading pulverization method further includes other steps such as a step of cooling the kneaded material formed in the kneading step.

The respective steps according to the kneading.pulverization method will be described in detail.

—Kneading Step—

In a kneading step, a toner-forming material containing a brilliant pigment and a binder resin is kneaded.

In the kneading step, for example, it is preferable to add an aqueous medium (for example, water such as distilled water and ion exchange water, and alcohols) in a range of 0.5 parts by weight to 5 parts by weight, with respect to 100 parts by weight of the toner-forming material.

Examples of a kneading machine used in the kneading step include a single-screw extruder and a twin-screw extruder.

—Cooling Step—

A cooling step is a step of cooling the kneaded material formed in the above-described kneading step, and in the cooling step, the temperature of the kneaded material at the time of completing the kneading step is desired to be cooled down to be equal to or lower than 40° C. at an average temperature lowering speed of equal to or higher than 4° C./sec.

Specific examples of the method of cooling in the cooling step include a method of using a rolling roller which circulates cold water or brine, and a pinched type cooling belt. Note that, in a case where the cooling is performed according to the above-described method, the cooling speed is determined by a speed of the rolling roller, a flow rate of the brine, a supply amount of the kneaded material, a slab thickness during the rolling of the kneaded material. The slab thickness is preferably from 1 mm to 3 mm.

—Pulverizing Step—

The kneaded material which is cooled in the cooling step is pulverized in the pulverizing step so as to form a particle. In the pulverizing step, for example, a mechanical pulverizer and a jet type pulverizer are used.

—Classification Step—

The particle obtained in the pulverizing step may be classified in the classification step so as to obtain a brilliant toner particle having a particle diameter in a target range, if necessary. In the classification step, fine powder (a particle smaller than the target diameter range) and coarse powder (a particle larger than the target range) are removed by a centrifugal classifier, an air classifier, and the like are used from the related art.

—Resin Coating Step—

The brilliant toner particle may be prepared through a resin coating step of coating particles obtained by the pulverization step or particles classified by the classification step with a resin.

The resin coating step is not particularly limited, and example thereof include a method of coating the surface of the coalesced particle with a resin by mechanically colliding a resin (for example, a resin particle) with a dry particle composite apparatus (for example, NOBILTA manufactured by Hosokawa Micron Ltd.).

—External Addition Step—

For the obtained brilliant toner particles, inorganic particles typified by silica, titania, and aluminum oxide may be added and adhered for the purpose of charging adjustment, imparting fluidity, imparting charge exchange property, and the like. These may be performed, for example, by a V-type blender, a Henschel mixer, a Loedige mixer or the like, and these mixers may be separately attached for each step. The content of external additive is preferably from 0.1 parts by weight to 5 parts by weight, and is more preferably from 0.3 parts by weight to 2 parts by weight, with respect to 100 parts by weight of brilliant toner particle.

—Sieving Step—

After the above external addition step, a sieving step may be performed if necessary. Specific examples of the sieving method include methods performed by a gyro shifter, a vibration sieving machine, and a wind classifier. By sieving, coarse particles and the like of the external additive are removed, generation of streaks on the photoreceptor, blot contamination in the apparatus, and the like are prevented.

<Aggregation and Coalescence Method>

In Embodiment X, an aggregation and coalescence method may be used in which the shape of the brilliant toner particle and the particle diameter of the brilliant toner particle may be controlled easily and the control range of the brilliant toner particle structure such as the core-shell structure is also wide. Hereinafter, a method of preparing the brilliant toner particle by the aggregation and coalescence method will be described in detail.

The aggregation and coalescence method according to Embodiment X includes a resin particle dispersion preparing step of emulsifying raw materials constituting the brilliant toner particles so as to form resin particles, an aggregation step of forming aggregates of the resin particles, and a coalescence step of coalescing the aggregates.

—Resin Particle Dispersion Preparing Step—

The preparation of the resin particle dispersion may be carried out by preparing a resin particle dispersion by a general polymerization method, for example, an emulsion polymerization method, a suspension polymerization method, a dispersion polymerization method, and the like, and also may be carried out through emulsification performed by applying a shearing force to a solution in which an aqueous medium and a binder resin are mixed by a dispersing machine. At that time, particles may be formed by heating to lower the viscosity of the resin component. In order to stabilize the dispersed resin particles, a dispersing agent may be used. Further, if the resin is oily and soluble in a solvent having a relatively low solubility in water, the resin is dissolved in the solvent and particle-dispersed together with the dispersing agent and the polymer electrolyte in water, followed by heating or depressurization so as to evaporate the solvent, and thereby a resin particle dispersion is prepared.

Examples of the aqueous medium include water such as distilled water, ion exchange water, or the like, alcohols, and the like, and water is preferably used.

Examples of the dispersing agent used in the resin particle dispersion preparing step include soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecylsulfate, sodium oleate, sodium laurate and potassium stearate; cationic surfactants such as lauryl amine acetate, stearyl amine acetate, and lauryl trimethyl ammonium chloride; a zwitterionic surfactant such as lauryldimethylamine oxide; surfactants such as a nonionic surfactant such as polyoxyethylene alkyl ether, polyoxyethylene alkyl phenyl ether, and polyoxyethylene alkyl amine; and inorganic salts such as tricalcium phosphate, aluminum hydroxide, calcium sulfate, calcium carbonate, and barium carbonate.

Examples of the dispersing machine used for preparing an emulsion include a homogenizer, a homomixer, a pressure kneader, an extruder, a media dispersing machine, and the like. The size of the average particle diameter (volume average particle diameter) of the resin particle is preferably 1.0 μm or less, more preferably from 60 nm to 300 nm, and is still more preferably from 150 nm to 250 nm. When the size is 60 nm or more, the resin particle tends to be unstable in the dispersion, aggregation of the resin particles may be easy in some cases. On the other hands, when the size is 1.0 μm or less, the particle diameter distribution of the brilliant toner particle may be narrow.

When preparing the release agent dispersion, the release agent is dispersed in water with an ionic surfactant, a polymer electrolyte such as a polymer acid or a polymer base, and then heated to a temperature not lower than the melting temperature of the release agent and subjected to a dispersing treatment by a homogenizer or a pressure discharge type dispersing machine capable of applying a strong shear force. Through such a treatment, a release agent dispersion may be obtained. In the dispersion treatment, an inorganic compound such as polyaluminum chloride may be added to the dispersion. Preferable examples of the inorganic compound include polyaluminum chloride, aluminum sulfate, highly basic polyaluminum chloride (BAC), polyaluminum hydroxide, and aluminum chloride. Among them, polyaluminum chloride and aluminum sulfate are preferable.

Through the dispersing treatment, the release agent dispersion containing the release agent particles having a volume average particle diameter of 1 μm or less may be obtained. Note that, the volume average particle diameter of the release agent particles is from 100 nm to 500 nm.

When the volume average particle diameter is 100 nm or more, generally, the release agent components are likely to be incorporated in the brilliant toner particle while depending on the properties of the binder resin to be used. Further, in a case where the volume average particle diameter is 500 nm or less, a dispersion state of the release agent in the brilliant toner particle becomes excellent.

For the preparation of the brilliant pigment dispersion, known dispersion methods may be used, and for example, general dispersion means such as a rotary shearing-type homogenizer, or a ball mill, a sand mill, a Dyno mill, or an ultimizer may be employed, and is not particularly limited thereto. The brilliant pigment is dispersed in water together with a polymer electrolyte such as a polymer acid or a polymer base. The volume average particle diameter of the dispersed brilliant pigment may be 20 μm or less, and a range from 3 μm to 16 μm is preferable from the viewpoint that the aggregation property is not impaired and the dispersion of the brilliant pigments in the brilliant toner particles is excellent.

In addition, the brilliant pigment and the binder resin are dispersed and mixed in a solvent, and dispersed in water by inversion emulsification or shear emulsification so as to prepare a dispersion of the brilliant pigment coated with the binder resin.

Note that, the dispersion of the coloring agent other than the brilliant pigment is prepared in the same manner as in the preparation of the brilliant pigment dispersion.

—Aggregation Step—

In the aggregation step, a resin particle dispersion, a brilliant pigment dispersion, a release agent dispersion, and the like are mixed to prepare a mixed solution, and the mixed solution is heated and aggregated at a glass transition temperature or lower of the resin particle, and thereby a an aggregated particle is formed. The aggregated particle is formed by making a pH of the mixed solution acidic under the stirring in many cases. The ratio (C/D) is controlled to a preferable range by the stirring conditions. More specifically, the ratio (C/D) may be decreased by performing the stirring at a high speed and heating at the stage of forming the aggregated particles, and the ratio (C/D) may be increased by performing the stirring at a low speed and heating at a lower temperature. The pH is preferably from 2 to 7, and in this case, it is also effective to use an aggregating agent.

In addition, in the aggregation step, the release agent dispersion may be added and mixed at once with various dispersions such as a resin particle dispersion, or may be added dividedly in plural times.

Examples of the aggregating agent include a surfactant having an opposite polarity to the polarity of the surfactant used as the dispersing agent, an inorganic metal salt, a divalent or more metal complex. Particularly, when a metal complex is used, the amount of the surfactant used is reduced and charging properties are improved.

As the inorganic metal salt, an aluminum salt and a polymer thereof are particularly preferable. In order to obtain a narrower particle diameter distribution, it is preferable that the valence of the inorganic metal salt is divalent rather than monovalent, trivalent rather than divalent, tetravalent rather than trivalent, and even if it is the same valence number, an inorganic metal salt polymer is more suitable.

In addition, the brilliant toner particle may be prepared in such a manner that surfaces of core aggregated particles are coated with the resin by adding the resin particle dispersion at the time when the aggregated particles have a desired particle diameter (coating step). In this case, the release agent and the brilliant pigment are less likely to be exposed to the brilliant toner particle surface, and thus the above-described configuration is preferable in terms of the charging properties and the developing properties. In a case of adding the resin particle dispersion, the aggregating agent may be added or the pH may be adjusted before adding the resin particle dispersion.

—Coalescence Step—

In the coalescence step, the pH of the suspension of the aggregated particles is increased to 3 to 9 under the stirring based on the aggregating step to stop the proceeding of the aggregation, and heating is performed at a temperature which is equal to or higher than the glass-transition temperature of the resin is performed to cause the aggregated particles to coalesce.

In addition, in a case where the aggregated particles are coated with the resins, the core aggregated particles are coated with the resins which coalesce with each other. The heating may be performed such that the resins coalesce with each other, and the heating time is preferably from 0.5 hours to 10 hours.

After performing the coalescing, the aggregated particles are cooled to thereby obtain coalesced particles. In addition, in the cooling step, the cooling speed may be decreased in the vicinity of the glass-transition temperature (glass-transition temperature in a range of ±10° C.) of the resin, that is, the cooling may be slowly performed so as to promote the crystallization.

The coalesced particles through the coalescing step go through a solid-liquid separation step such as filtration, if necessary, a washing step, and a drying step, thereby forming the brilliant toner particles.

—Resin Coating Step—

The brilliant toner particle may be prepared through a resin coating step of coating the coalesced particle with a resin. The resin coating step is not particularly limited, and example thereof include a method of coating the surface of the coalesced particle with a resin by mechanically colliding a resin (for example, a resin particle) by a dry particle composite apparatus (for example, NOBILTA manufactured by Hosokawa Micron Ltd.).

In a case where the resin particles contained in the resin particle dispersion are used in the resin coating step, the resin particles obtained by filtration of the resin particle dispersion are washed by dialysis, ultrafiltration, or the like so as to remove impurities such as a surfactant, and then dried by spray drying or the like.

—External Addition Step—

For the obtained brilliant toner particles, inorganic oxide or the like typified by silica, titania, and aluminum oxide may be added and adhered as an external additive for the purpose of charging adjustment, imparting fluidity, imparting charge exchange property, or the like. The preferable external addition method and the preferable added amount of the external additive are as described above.

In addition to the inorganic oxides and the like described above, other components (particles) such as a charge-controlling agent, an organic particle, a lubricant, and an abrasive may be added as an external additive.

The charge-controlling agent is not particularly limited, and a colorless or light color one is preferably used. Examples thereof include a quaternary ammonium salt compound, a nigrosine compound, a complex such as aluminum and chromium, a triphenylmethane pigment, and the like.

Examples of the organic particle include a particle used as an external additive on the surface of the general brilliant toner particle such as particles of a vinyl resin, a polyester resin, and a silicone resin. These inorganic particle and the organic particle are used as a fluidity aid, a cleaning aid or the like.

Examples of the lubricant include fatty acid amides such as ethylenebisstearic acid amide and oleic acid amide, and fatty acid metal salts such as zinc stearate and calcium stearate.

Examples of the adhesive include the aforementioned silica, alumina, cerium oxide and the like.

<Dissolution Suspension Method>

Hereinafter, a method of preparing the brilliant toner particle by the dissolution suspension method will be described in detail.

The dissolution suspension method is a method of obtaining a brilliant toner particle by granulating a liquid, in which a material containing a binder resin, a brilliant pigment, and other components such as a release agent used if necessary is dissolved and dispersed in a solvent in which the binder resin may be solved, in an aqueous medium containing an inorganic dispersing agent, and then removing the solvent.

Examples of other components used in the dissolution suspension method include various components such as a charge-controlling agent and an organic particle other than the release agent.

In Embodiment X, the binder resin, the brilliant pigment, and other components used if necessary are dissolved and dispersed in a solvent in which the binder resin is dissolved. Whether or not the binder resin may be dissolved depends on the constituent components of the binder resin, the molecular chain length, the degree of three-dimensionalization and the like; however, generally, hydrocarbons such as toluene, xylene, and hexane, halogenated hydrocarbons such as methylene chloride, chloroform, dichloroethane, and dichloroethylene; alcohols or ethers such as ethanol, butanol, benzyl alcohol ethyl ether, benzyl alcohol isopropyl ether, tetrahydrofuran, and tetrahydropyran; esters such as methyl acetate, ethyl acetate, butyl acetate, and isopropyl acetate; and ketone or acetal such as acetone, methyl ethyl ketone, diisobutyl ketone, dimethyl oxide, diacetone alcohol, cyclohexanone, and methyl cyclohexanone may be used.

These solvents dissolve the binder resin, and it is not necessary to dissolve the brilliant pigment and other components. The brilliant pigment and other components may be dispersed in the binder resin solution. The amount of solvent used is not limited, and any viscosity may be used as long as granulation is performed in an aqueous medium. As a ratio of a material (the former) containing the binder resin, the brilliant pigment, and other components to a solvent (the latter), 10/90 to 50/50 (weight ratio of former/latter) is preferable from the viewpoint of ease of granulation and yield of finally prepared brilliant toner particles.

The liquid (toner mother liquor) of the binder resin, the brilliant pigment, and other components dissolved or dispersed in the solvent is granulated so as to have a predetermined particle diameter in an aqueous medium containing an inorganic dispersing agent. Water is mainly used as the aqueous medium. The inorganic dispersing agent is preferably selected from tricalcium phosphate, hydroxyapatite, calcium carbonate, titanium oxide, and silica powder. The amount of the inorganic dispersing agent to be used is determined according to the particle diameter of the granulated particles, but generally, it is preferably from 0.1% by weight to 15% by weight with respect to the toner mother liquor. When the amount is 0.1% by weight or more, good granulation is easily performed, and when it is 15% by weight or less, unnecessary fine particles are hardly formed and the target particles are easily obtained with high yield.

In order to granulate the toner mother liquor well in an aqueous medium containing an inorganic dispersing agent, an auxiliary agent may be added in the aqueous medium. Such auxiliary agents include a known cationic type surfactant, an anionic type surfactant, and a nonionic type surfactant, and particularly the anionic type surfactant is preferable. For example, sodium alkyl benzene sulfonate, sodium α-olefin sulfonate, sodium alkyl sulfonate and the like are used, and these are preferably used in an amount of from $1\times10^{-4}$% by weight to 0.1% by weight with respect to the toner mother liquor.

The granulation of the toner mother liquor in the aqueous medium containing the inorganic dispersing agent is preferably performed under shearing. The toner mother liquor dispersed in the aqueous medium preferably has an average particle diameter of 20 μm or less. Particularly, it is preferably from 3 μm to 15 μm.

Various dispersing machines are available as an apparatus equipped with a shearing mechanism, and among them, a homogenizer is preferable. By a homogenizer, a substance which is incompatible with each other (in Embodiment X, an aqueous medium containing an inorganic dispersing agent and a toner mother liquor) is allowed to pass through a gap between the casing and a rotating rotor, so that a substance that is incompatible with the liquid may be dispersed in a particle form in a certain liquid. Examples of such homogenizers include a TK homomixer, a line flow homomixer, an auto homomixer (manufactured by Tokushu Kika Kogyo Co., Ltd.), a silverson homogenizer (manufactured by Silverson), and a polytron homogenizer (manufactured by KINEMATICA AG).

The stirring condition using the homogenizer is preferably 2 m/sec or higher at a peripheral speed of the blades of the rotor. When the peripheral speed is 2 m/sec or higher, the particle formation becomes excellent. In Embodiment X, after the toner mother liquor is granulated in the aqueous medium containing the inorganic dispersing agent, the solvent is removed. The removing of the solvent may be carried out at room temperature (25° C.) at atmospheric pressure, but it takes a long time to remove, and thus it is preferably performed under the condition that a temperature is lower than the boiling point of the solvent and a difference from the boiling point is 80° C. or lower. The pressure may be atmospheric pressure or reduced pressure, but at the time of the pressure reduction, it is preferably performed at from 20 mmHg to 150 mmHg.

The brilliant toner particles are preferably washed with hydrochloric acid or the like after removing the solvent. As a result, the inorganic dispersing agent remaining on the surface of the brilliant toner particle is removed so as to improve the properties by making the original composition of the brilliant toner particle. Then, dehydration and drying are performed so as to obtain the brilliant toner particles of powder.

The brilliant toner particle may be prepared through the resin coating step of coating particles obtained after removing the solvent or particles washed after removing the solvent with a resin. The resin coating step is not particularly limited, and example thereof include a method of coating the surface of the coalesced particle with a resin by mechanically colliding a resin (for example, a resin particle) with a dry particle composite apparatus (for example, NOBILTA manufactured by Hosokawa Micron Ltd.).

For the brilliant toner particles obtained by a dissolution suspension method, similar to a case of the aggregation and coalescence method, inorganic oxide or the like typified by silica, titania, and aluminum oxide may be added and adhered as an external additive for the purpose of charging adjustment, imparting fluidity, imparting charge exchange property, and the like. In addition to the inorganic oxides and the like described above, other components (particles) such as a charge-controlling agent, an organic particle, a lubricant, and an abrasive may be added as an external additive.

Among the preparation methods of the above-described brilliant toner particles, the aggregation and coalescence method is preferable from the viewpoint that it is easy to obtain toner particles having a high average projected circularity, and the toner particle in which the difference between $R_1$ and $R_2$, the difference between $D_1$ and $D_2$, $|P_1-P_2|$, and $|W_1-W_2|$ are small.

Next, the electrostatic charge image developing toner according to Embodiment A for the second aspect, which includes the electrostatic charge image developing toners according to the following aspects A1 and A2, will be described in detail.

<Electrostatic Charge Image Developing Toner>

[Aspect A1]

An electrostatic charge image developing toner (hereinafter, also referred to as "toner") according to an aspect A1 of Embodiment A includes a first toner which contains a first toner particle; and a second toner which has a different color from that of the first toner, and contains the second toner particle. When, based on a charge distribution of each of the first toner and the second toner obtained according to a charge spectrograph method, maximum peak positions of the first toner and the second toner are taken as $P_1$ and $P_2$, respectively, and full widths at half maximum of the first toner and the second toner are taken as $W_1$ and $W_2$, respectively, $|P_1-P_2|$ is 3 mm or less, and $|W_1-W_2|$ is 3 mm or less.

Hereinafter, a toner including two or more kinds of toners having different colors is referred to as a "mixed toner" in some cases. In addition, as a general term of the toner of each color included in the mixed toner, it is referred to as "each color toner" in some cases.

When the toner according to the aspect A1 has the above-described configuration, an image is formed while the formation of areas having partially different color tone is prevented. Though the reason is not clear, it is assumed as follows.

In addition, examples of a method of forming an image having a mixed color by mixing plural colors include a method of using a mixed color toner (that is, a mixed toner) obtained by mixing plural color toners in advance in addition to a method of forming an image having the mixed color obtaining by layering plural colors of toner images. Compared with the method of layering the toner images of the respective colors, the method using the mixed toner is easier to reproduce the target mixed color and the reproducibility of the mixed color is also higher.

However, in a case of using the mixed toner, depending on the type of the recording medium, there is a case where an image including areas having partially different color tones is formed.

Specifically, for example, in a case where the recording medium having unevenness, in the concave portion of the recording medium, the distance between the toner image and the surface of the recording medium at the time of transfer is farther than the convex portion, and thus the transfer electric field tends to be low and the toner having a low charge amount is less likely to be transferred. When the charging properties of the respective color toners included in the mixed toner are greatly different from each other, the transfer efficiency in the concave portion of the recording medium, is deviated between one color toner and the other color toner, and thereby an image including areas having partially different color tones is formed in some cases.

For example, in a case where the recording medium is easily charged like a resin recording medium, at the end portion of the image, a toner having a high charge amount or a toner having a low charge amount may be selectively scattered to the non-image area. When the charging properties of the respective color toners included in the mixed toner are greatly different from each other, only one of the respective color toners selectively scatters to the non-image portion at the end portion of the image, thereby forming an image including area having partially different color tones in some cases.

In contrast, in the mixed toner according to the aspect A1, based on the charge distribution with respect to each of the respective color toners obtained by the charge spectrograph method, the difference between the maximum peak positions and the difference between the full widths at half maximum each is 3 mm or less in terms of an absolute value. That is, each color toner contained in the toner according to the aspect A1 has similar charging properties to each other. Therefore, it is presumed that even when the transfer electric field is low in the concave portion of the recording medium having unevenness and the transfer efficiency of the toner having a low charge amount is deteriorated, the transfer efficiency between the first toner and the second toner is hardly deviated, thereby preventing the generation of areas having partially different color tones. Even if a toner having a high charge amount or a toner having a low charge amount tends to be selectively scattered to a non-image portion at an end portion of the image formed on the easily chargeable recording medium, it is presumed that the difference in the occurrence ratio of scattering between the first toner and the second toner is small, thereby preventing the generation of areas having partially different color tones.

In the mixed toner according to the aspect A1, the method of causing the difference between the maximum peak positions and the difference in the full widths at half maximum to be in the above ranges is not particularly limited, and examples thereof include a method of using coloring agents having similar charging properties as a coloring agent included in the respective color toner particles, a method of preventing the variation of compositions on the surface of the respective color toner particles, a method of controlling the charge amount by adjusting the amount of the external additive adhering to the surface of the toner particle of each color, and a combination of these methods.

In addition, examples of the a method of preventing the variation of compositions on the surface of the respective color toner particles include a method in which the toner particle of each color has a coating layer having an average thickness of 0.1 μm or more as in the mixed toner according to the aspect A2 described below, a method of removing impurities adhered to the surface in the process of preparing the toner particle, and a combination of these methods.

[Aspect A2]

An electrostatic charge image developing toner (hereinafter, also referred to as "toner") according to an aspect A2 of Embodiment A includes a first toner which contains a first toner particle; and a second toner which has a different color from that of the first toner, and contains the second toner particle. The first toner particle and the second toner particle include a core particle and a coating layer which covers the core particle and has an average thickness of 0.1 μm or more.

When the toner according to the aspect A2 has the above-described configuration, an image having generation of areas having partially different color tone prevented is formed. Though the reason is not clear, it is assumed as follows.

As described above, when the mixed toner containing the first toner and the second toner, which have greatly different charging properties from each other, is used, for example, areas having partially different color tones may be generated at the end portion of an image on a concave portion of the recording medium having unevenness or an image formed on an easily chargeable recording medium.

In contrast, in the toner according to the aspect A2, both the first toner particle and the second toner particle have a coating layer having an average thickness of 0.1 μm or more. Therefore, components (for example, coloring agents, and impurities) contained in the core particles are hardly exposed to the surface, and variation in the composition of the toner particle surface is prevented. In addition, when having the coating layer having the average thickness of 0.1 μm or more, electrostatic influence due to the components contained in the core particles hardly appears on the surface of the toner particle. Further, variations in the adhesion strength of the external additive are also prevented. As a result, even when the respective color toners included in the mixed toner contain coloring agents having largely different electrostatic properties from each other, it is presumed that the charging properties of the toner are similar to each other, thereby preventing the generation of areas having partially different color tones.

Hereinafter, the aspect A1 and the aspect A2 are collectively referred to as a toner according to Embodiment A in some cases.

[Color of Toner]

The color of the first toner and the color of the second toner are not particularly limited, as long as the colors are different from each other, and may be a chromatic color, may be an achromatic color, or may be colorless, respectively. That is, the combination of the first toner and the second toner may be any one of a combination of a chromatic color and a chromatic color, a combination of a chromatic color and an achromatic color, a combination of an achromatic color and an achromatic color, a combination of a chromatic color and colorless, and a combination of an achromatic color and colorless.

Here, the "chromatic color" refers to a color having brightness, hue, and saturation, and a color other than the achromatic color. The "achromatic color" refers to a color that is described only by brightness among hue, brightness, and saturation and refers to white, gray, and black. "Colorless" means not having any of hue, brightness, and saturation (that is, having no color).

The brightness, the hue, and the saturation of the respective color toners are measured as follows. Specifically, with respect to each of the color toners included in the mixed toner, coordinate values (L* value, a* value, and b* value) in the CIE1976L*a*b* color system by employing X-Rite 939 (aperture diameter: 4 mm, light source (illuminant): CIE standard light source D50, and standard observer (angle of view): 2 degree of visual field) are measured. At the time of the measurement, white high-quality paper (for example, mirror coated paper manufactured by Fuji Xerox Co., Ltd.) is used as a base. The brightness value, the hue angle, and the saturation value are obtained from the coordinate values as follows.

Specifically, the "brightness value" refers to an L* value in the coordinate values.

The "hue angle" refers to an angle formed by a line obtained by using a position (that is, a position of an achromatic color at which the a* axis and the b* axis intersect) at which a* and b* each are 0 in coordinates of the CIE1976L*a*b* color system as a starting point and connecting a position defined by a* and b* of the coordinate values and the starting point and the a* axis.

The "saturation value" refers to a value of c* obtained by using a* and b* of the coordinate values and the following equation.

$$c^*=((a^*)^2+(b^*)^2)^{1/2} \quad \text{Equation:}$$

In the combination of the chromatic color and the chromatic color, the expression "colors are different from each other" refers to a case where the color difference ΔE represented by the following equation is 13.0 or more.

$$\Delta E=\{(L_1-L_2)^2+(a_1-a_2)^2+(b_1-b_2)^2\}^{1/2} \quad \text{Equation:}$$

Here, in the formula, $L_1$, $a_1$, and $b_1$ refer to an L* value, an a* value, and a b* value of the first toner in the CIE1976L*a*b* color system, respectively, and $L_2$, $a_2$, and $b_2$ refer to an L* value, an a* value, and a b* value of the second toner in the CIE1976L*a*b* color system, respectively.

In the combination of the achromatic color and the achromatic color, the expression "colors are different from each other" refers to a case where the brightness difference (that is, a value of $|L_1-L_2|$) is 13.0 or more.

A combination of a chromatic color and an achromatic color, a combination of a chromatic color and colorless, and a combination of an achromatic color and a colorless are combinations of "different colors".

In Embodiment A, the color of the first toner is preferably a chromatic color, and a hue angle of the first toner is more preferably from 15 degrees to 75 degrees, from 115 degrees to 225 degrees, or from 255 degrees to 345 degrees.

It is further preferable that both the first toner and the second toner are chromatic colors. In a case where both of the first toner and the second toner are chromatic colors, the difference in hue angles between the first toner and the second toner is preferably 150 degrees or less, is more preferably 105 degrees or less, and is still more preferably 60 degrees or less. When the difference in hue angle is within the above range, even if one toner is selectively transferred and biased, it becomes difficult to visually recognize as a difference in color.

In a case where both of the first toner and the second toner are chromatic colors or colorless, the difference in brightness value between the first toner and the second toner is preferably 65 degrees or less, is more preferably 45 degrees or less, and is still more preferably 30 degrees or less. In a case where both of the first toner and the second toner are chromatic colors, the difference in saturation values between the first toner and the second toner is preferably 50 or less, is more preferably 40 or less, and is still more preferably 30 or less.

Note that, even when the difference of the hue angle is larger than 150 degrees, as compared with a case of a mixed toner of where at least one of $|P_1-P_2|$ and $|W_1-W_2|$ is the absolute value of larger than 3 mm, with the mixed toner according to the aspect A1, an image having generation of areas having partially different color tone prevented is formed. In addition, even when the difference of the hue angle is larger than 150 degrees, an image having generation of areas having partially different color tone prevented is formed with the mixed toner according to the aspect A2, as compared with a case where the first toner particle and the second toner particle have a coating layer having an average thickness of less than 0.1 μm or have no coating layer.

Similarly, even in a case where the difference of brightness values is larger than 65, an image having generation of areas having partially different color tone prevented is formed with the mixed toners according to the aspects A1 and A2. Similarly, even in a case where the difference in saturation values is larger than 50, an image having generation of areas having partially different color tone prevented is formed with the mixed toners according to the aspects A1 and A2.

[Charge Spectrograph Method]

Hereinafter, a charge spectrograph method is described.

As illustrated in FIG. 3, an air laminar flow of a velocity v in the vertical direction and an electric field E perpendicular to this flow are formed in a cylindrical container having a length l by the charge spectrograph method. The mixed toner charged from the center of the upper end portion is inserted and the respective toner particles contained in the mixed toner move in the vertical direction by the electric field while moving to a lower end portion by the air laminar flow. A filter is laid on the bottom surface of the cylindrical container and the distribution of the respective color toner particles captured on the filter in the vertical direction from a center point 0 is measured with a microscope. Specifically, the image obtained by the microscope is color-separated and binarized, and the distribution is obtained by extracting the number for each color.

Examples of the filter include a white filter, and in a case where observation becomes difficult if a white filter (for example, in a case where the mixed toner contains at least one of a white toner or a colorless toner) is used, a colored filter (for example, a gray filter) may be used.

In each of the toner particles, the relation between the distance d in the vertical direction from the center point 0 and a charge amount q of the toner particle is represented by the following equation.

$$q/r=(6\times\pi\times\eta\times d\times v)/(1\times E) \quad \text{Equation:}$$

In the equation, r represents a radius of the toner particle, and η represents a viscosity of the air. That is, the distance d is a factor depending on the radius r and the charge amount q of the toner particle.

The measurement conditions of a specific charge spectrograph method are the same as those of the mixed brilliant toner.

As for the "charged mixed toner", a developer is prepared in the same manner as in the case of mixed brilliant toner.

Measurement with respect to the respective color toner particles on the filter is performed as follows. Specifically, the number of the respective color toner particles per 500 $mm^2$ (that is, in the region of 50 mm×10 mm) at the position of the distance d from the center point 0 in the vertical direction is measured by a laser microscope (VK8500, manufactured by Keyence Corporation), so as to obtain the charge distribution for each of the respective color toners.

In the charge distribution of the first toner obtained by the above method, the maximum peak position is taken as $P_1$, and the full width at half maximum is taken as $W_1$, and in the charge distribution of the second toner, the maximum peak position is taken as $P_2$, and the full width at half maximum is taken as $W_2$. The "maximum peak position" refers to the distance d (that is, a distance from the center point 0) of the maximum peak (that is, a point having the largest number of the toner particles per unit area) in the charge distribution.

In the toner of the aspect A1, the difference (that is, $|P_1-P_2|$) between $P_1$ and $P_2$ is 3 mm or less, is preferably 2 mm or less, and is more preferably 1 mm or less. In the toner of the aspect A1, the difference (that is, $|W_1-W_2|$) between $W_1$ and $W_2$ is 3 mm or less, is preferably 2 mm or less, and is more preferably 1 mm or less.

Also in the toner according to the aspect A2, it is preferable that $|P_1-P_2|$ and $|W_1-W_2|$ are in the above ranges.

In addition, in Embodiment A, it is preferable that the ratio (that is, $P_2/P_1$) of $P_2$ to $P_1$ is preferably 0.62 to 1.6 or less, more preferably 0.75 to 1.25, and even more preferably 0.85 to 1.15.

[Mixed Toner]

Hereinafter, the mixed toner according to Embodiment A will be described.

The mixed toner contains a first toner and a second toner.

The first toner and the second toner may be identical to or different from each other except for having different colors, but the composition other than the coloring agent and the properties of the toner (for example, a diameter or a shape of the toner particle) are preferably the same.

In addition, in a case where both of the first toner and the second toner contain the coating layer, the coating layer of the first toner particle and the coating layer of the second toner particle preferably contains resins having similar charging properties, and more preferably contain the same kinds of resins.

If necessary, the mixed toner may contain the other toner in addition to the first toner and the second toner. The other toner may contain two or more toners having different colors. That is, the mixed toner may contain toners of two or more colors, and may include toners of three or more colors, and toners of four or more colors.

In a case where the mixed toner contains the other toner, the difference between a maximum value and a minimum value with respect to the maximum peak position based on the charge distribution with respect to each of the respective color toners is preferably 3 mm or less in the absolute value, is more preferably 2 mm or less, and is still more preferably 1 mm or less. In addition, the difference between a maximum value and a minimum value with respect to the full width at half maximum based on the charge distribution of each of the respective color toners is preferably 3 mm or less in the absolute value, is more preferably 2 mm or less, and is still more preferably 1 mm or less.

In a case where the mixed toner contains the other toner, the ratio of a maximum value to a minimum value with respect to the maximum peak position based on the charge distribution of each of the respective color toners is preferably from 0.62 to 1.6, is more preferably from 0.75 to 1.25, and is still more preferably from 0.85 to 1.15.

The mixed toner may contain other components than the toner, if necessary. The content of the other component with respect to the entire mixed toner is preferably 10% by weight or less and more preferably 5% by weight or less.

A content ratio of the second toner to the first toner included in the mixed toner varies depending on an intended color of the mixed toner and colors of the respective color toners and is not particularly limited. For example, the content ratio (that is, content of second toner/content of first toner) of the second toner with respect to the first toner is from 0.1 to 10, preferably from 0.2 to 5, and more preferably from 0.5 to 2.

For example, the mixed toner is produced by mixing the first toner and the second toner. In a case where the first toner and the second toner contain external additives (for example, a charge control agent), the external additives may be attached to the respective color toner particles by mixing the first toner particle, the second toner particle, and the external additive, the external additive may be added after the first toner particle and the second toner particle are mixed, or the external additives may be attached to the respective color toner particles to produce the first toner and the second toner, which are then mixed.

The mixing method is not particularly limited, and examples thereof include mixing with a V blender, a Henschel mixer, a Loedige mixer or the like.

[Each Color Toner]

Hereinafter, each color toner will be described.

The respective color toners are configured to include a toner particle and if necessary, an external additive.

(Toner Particle)

The toner particle is configured to include a binder resin and if necessary, a coloring agent, a release agent, and other additives.

—Binder Resin—

As the binder resin, the description of the binder resin contained in the brilliant toner of Embodiment X may be applied.

The content of the binder resin is, for example, preferably from 40% by weight to 95% by weight, is more preferably from 50% by weight to 90% by weight, and is still more preferably from 60% by weight to 85% by weight, with respect to the entire toner particle.

—Coloring Agent—

As the coloring agent, the description of the coloring agent other than the brilliant toner of Embodiment X may be applied.

The content of the coloring agent is, for example, preferably from 1% by weight to 30% by weight, and is more preferably from 3% by weight to 15% by weight, with respect to the entire toner particle.

—Release Agent—

As the release agent, the description of the release agent of Embodiment X may be applied.

The content of the release agent is, for example, preferably from 1% by weight to 20% by weight, and is more preferably from 5% by weight to 15% by weight, with respect to the entire toner particle.

—Other Additives—

Examples of other additives include known additives such as a magnetic material, a charge-controlling agent, and an inorganic powder. These additives are included in the toner particles as internal additives.

—Properties of Toner Particle—

The toner particles may be toner particles having a single-layer structure, or toner particles having a so-called core and shell structure composed of a core (core particle) and a coating layer (shell layer) coated on the core.

Here, the toner particles having a core and shell structure is preferably composed of, for example, a core containing a binder resin, and if necessary, other additives such as a coloring agent and a release agent and a coating layer containing a binder resin.

Both of the first toner particle and the second toner particle contained in the mixed toner according to the aspect A1 preferably contain a core particle and a coating layer. In addition, the average thickness of the coating layer preferably 0.1 μm or more, is more preferably from 0.15 μm to 0.5 μm, and is still more preferably from 0.2 μm to 0.4 μm.

Both of the first toner particle and the second toner particle contained in the mixed toner according to the aspect A2 contain a core particle and a coating layer, and the average thickness of the coating layer is 0.1 μm or more. In addition, the average thickness of the coating layer preferably from 0.15 μm to 0.5 μm, and is more preferably from 0.2 μm to 0.4 μm.

In both of the aspect A1 and the aspect A2, in a case where the mixed toner contains other toner particles, other toner particles also preferably contain a core particle and a coating layer, and the average thickness of the coating layer is more preferably in the above range.

Here, the average thickness of the coating layer is measured as follows.

The toner particles contained in the mixed toner is mixed and embedded in an epoxy resin, and the epoxy resin is solidified. The obtained solidified matter is cut by an ultramicrotome device (Ultracut UCT manufactured by Leica Inc.) so as to prepare a flake-shape sample having a thickness of 80 nm to 130 nm. An SEM image of the obtained flake-shape sample by an ultrahigh resolution field emission scanning electron microscope (FE-SEM, manufactured by Hitachi High-Technologies Corporation, model No.: S-4800).

In SEM images of 100 toner particles, the shortest distance from the outer edge of the coloring agent existing at the position closest to the outer edge of each toner particle to the outer edge of the toner particle is measured, and the average value is defined as "the average thickness of the coating layer".

The volume average particle diameter (D50v) of the toner particle is preferably 2 μm to 10 μm, and is more preferably 4 μm to 8 μm.

Various average particle diameters of the toner particles and various particle diameter distribution indices are measured using Coulter Multisizer II (manufactured by Beckman Coulter, Inc.), and the electrolytic solution is measured using ISOTON-II (manufactured by Beckman Coulter, Inc.).

In the measurement, a measurement sample in a range of 0.5 mg to 50 mg is added to 2 ml of a 5% aqueous solution of surfactant (preferably sodium alkyl benzene sulfonate) as a dispersing agent. The obtained material is added to the electrolyte in a range of 100 ml to 150 ml.

The electrolyte in which the sample is suspended is subjected to a dispersion treatment using an ultrasonic disperser for one minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume particle diameter distribution index (GSDv) is calculated as $(D84v/D16v)^{1/2}$, while a number particle diameter distribution index (GSDp) is calculated as $(D84p/D16p)^{1/2}$.

The average circularity of the toner particles is preferably from 0.94 to 1.00, and is more preferably from 0.95 to 0.98.

The average circularity of the toner particles is calculated by (circumference length of circle equivalent diameter)/(circumference length) [(circumference length of circle having the same projected area as that of particle image)/(circumference length of particle projected image)]. Specifically, the aforementioned value is measured according to the following method.

The average circularity of the toner particles is calculated by a flow particle image analyzer (measured by FPIA-3000 manufactured by Sysmex Corporation) which first, suctions and collects the toner particles to be measured so as to form flake flow, then captures a particle image as a static image by instantaneously emitting strobe light, and then performs image analysis of the obtained particle image. 3,500 particles are sampled at the time of calculating the average circularity.

In a case where the toner contains an external additive, the toner (the developer) to be measured is dispersed in the water containing a surfactant, and then the water is subjected to an ultrasonic treatment, thereby obtaining the toner particles in which the external additive is removed.

(External Additive)

As the external additive, the descriptions of the external additive of Embodiment X may be applied.

The amount of the external additive is, for example, preferably from 0.01 weight % to 5 weight %, and is more preferably from 0.01 weight % to 2.0 weight % with respect to the toner particles.

(Preparing Method of Each Color Toner)

Next, a method of preparing each of the color toners will be described.

Each of the color toners is obtained by additionally adding the external additive to the toner particles after preparing the toner particles.

The toner particles may be produced according to any one of a drying method (for example, a kneading and pulverizing method) and a wetting method (for example, an aggregation and coalescence method, a suspension polymerization method, and a dissolution suspension method). The preparing method of the toner particles is not particularly limited, and known method may be employed.

Among them, the toner particles may be obtained according to the aggregation and coalescence method.

Specifically, for example, in a case where the toner particles are produced according to the aggregation and coalescence method, the toner particles are produced through the following steps.

The steps include a step (a resin particle dispersion preparing step) of preparing a resin particle dispersion in which resin particles constituting the binder resin are dispersed, a step (an aggregated particle forming step) of forming aggregated particles by aggregating the resin particles (other particles if necessary), in the resin particle dispersion (in the dispersion in which other particle dispersions are mixed, if necessary); and a step (a coalescence step) of forming a toner particle by coalescing aggregated particles by heating an aggregated particle dispersion in which aggregated particles are dispersed so as to prepare a toner particle.

Hereinafter, the respective steps will be described in detail.

In the following description, a method of obtaining toner particles including the coloring agent and the release agent will be described; however, the coloring agent and the release agent are used if necessary. Other additives other than the coloring agent and the release agent may also be used.

—Resin Particle Dispersion Preparing Step—

First, a resin particle dispersion in which the resin particles corresponds to the binder resins containing the crystalline polyester resin are dispersed, a coloring agent particle dispersion in which coloring agent particles are dispersed, and a release agent particle dispersion in which the release agent particles are dispersed are prepared, for example.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used alone or two or more kinds thereof may be used in combination.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol. Among them, anionic surfactants and cationic surfactants are particularly preferable. Nonionic surfactants may be used in combination with anionic surfactants or cationic surfactants.

The surfactants may be used alone or two or more kinds thereof may be used in combination.

In the resin particle dispersion, as a method of dispersing the resin particles in the dispersion medium, a common dispersing method by, for example, a rotary shearing-type homogenizer, a ball mill having media, a sand mill, or a Dyno mill is exemplified. Further, depending on the kinds of the resin particles, the resin particles may be dispersed in the resin particle dispersion by, for example, a phase inversion emulsification method.

The phase inversion emulsification method is a method of dispersing a resin in an aqueous medium in a particle form by dissolving a resin to be dispersed in a hydrophobic organic solvent in which the resin is soluble, conducting neutralization by adding a base to an organic continuous phase (O phase), and performing inversion (so called phase inversion) of the resin from W/O to O/W to make discontinuous phase by adding an aqueous medium (W phase).

The volume average particle diameter of the resin particles dispersed in the resin particle dispersion is, for example, preferably from 0.01 μm to 1 μm, is more preferably from 0.08 μm to 0.8 μm, and is still more preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is taken as a volume average particle diameter D50v. Note that, the volume average particle diameter of the particles in other dispersions is also measured in the same manner.

The content of the resin particles contained in the resin particle dispersion is preferably from 5% by weight to 50% by weight, and is more preferably from 10% by weight to 40% by weight.

Note that, the coloring agent particle dispersion and the release agent particle dispersion are also prepared in the same manner as in the case of the resin particle dispersion. That is, the volume average particle diameter of the particles in the resin particle dispersion, dispersion medium, the dispersing method, and the content of the particles are the same as those in the coloring agent particles dispersed in the coloring agent particle dispersion and the release agent particles dispersed in the release agent particle dispersion.

—Aggregated Particle Forming Step—

Next, the resin particle dispersion, the coloring agent particle dispersion, and the release agent particle dispersion are mixed with each other.

In addition, in the mixed dispersion, the resin particle, the coloring agent particle, and the release agent particle are heteroaggregated, and thereby an aggregated particle which has a diameter close to a targeted diameter of the toner particle and contains the resin particle, the coloring agent particle, and the release agent particle is formed.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of glass transition temperature of −30° C. to glass transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, a divalent or more metal complex. Particularly, when a metal complex is used as the aggregating agent, the amount of the surfactant used is reduced and charging properties are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably in a range of 0.01 parts by weight to 5.0 parts by weight, and is more preferably equal to or greater than 0.1 parts by weight and less than 3.0 parts by weight, with respect to 100 parts by weight of resin particle.

—Coalescence Step—

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be obtained through a step of forming a second aggregated particles in such a manner that an aggregated particle dispersion in which the aggregated particles are dispersed is obtained, the aggregated particle dispersion and a resin particle dispersion in which resin particles are dispersed are mixed, and the mixtures are aggregated so as to attach the resin particle on the surface of the aggregated particle, and a step of forming the toner particles having a core/shell structure by heating a second aggregated particle dispersion in which the second aggregated particles are dispersed, and coalescing the second aggregated particles.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner particle may be prepared through a step of forming the coating layer after completion of the coalescence step of the aggregated particle or the second aggregated particle, or if necessary, after a step performed after the coalescence step (for example, a washing step, a liquid separation step, a drying step, and the like).

The step of forming the coating layer is not particularly limited, and example thereof include a method of coating the surface of the coalesced particle obtained through the coalescence step with a resin by mechanically colliding a resin (for example, a resin particle) with a dry particle composite apparatus (for example, NOBILTA manufactured by Hosokawa Micron Ltd.).

In a case where the resin particles contained in the resin particle dispersion are used in the step of forming the coating layer, the resin particles obtained by filtration of the resin particle dispersion are washed by dialysis, ultrafiltration, or the like so as to remove impurities such as a surfactant, and then dried by spray drying or the like.

Further, after the step of forming the coating layer, a treatment of removing impurities on the surface of the toner particle may be performed.

The respective color toners are prepared by adding and mixing, for example, an external additive to the obtained dry toner particles. The mixing may be performed with, for example, a V-blender, a Henschel mixer, a Lodige mixer, or the like. Furthermore, if necessary, coarse particles of the toner may be removed by a vibration sieving machine, a wind classifier, or the like.

As described above, when mixing the first toner particle and the second toner particle, the external additive may be added to prepare the mixed toner, and the first toner particle and the second toner particle may be mixed in advance and then the external additive is added to prepare the mixed toner.

With respect to a developer, an image forming apparatus, an image forming method, process cartridge, and toner cartridge as described below, an exemplary embodiment where the mixed brilliant toner according to Embodiment X or the mixed toner according to Embodiment A is used is hereinafter referred to as "the exemplary embodiment".

<Electrostatic Charge Image Developer>

The electrostatic charge image developer according to the exemplary embodiment at least include the mixed brilliant toner according to Embodiment X or the mixed toner according to Embodiment A.

The electrostatic charge image developer according to the exemplary embodiment may be a one-component developer only containing the mixed brilliant toner according to Embodiment X or the mixed toner according to Embodiment A, and may be a two-component developer in which the mixed brilliant toner or the mixed toner is mixed with a carrier.

The carrier is not particularly limited, and a known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the aforementioned carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include a straight silicone resin formed by containing polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, and an organosiloxane bond, or the modified products thereof, a fluorine resin, polyester, polycarbonate, a phenol resin, and an epoxy resin.

Note that, other additives such as the conductive particles may be contained in the coating resin and the matrix resin.

Examples of the conductive particle include metal such as gold, silver, and copper, and particles such as carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the mixed brilliant toner or the mixed toner to the carrier in the two-component developer is preferably from toner:carrier=1:100 to 30:100, and is more preferably from 3:100 to 20:100.

<Image Forming Apparatus and Image Forming Method>

An image forming apparatus and an image forming method according to Embodiments X and A will be described.

The image forming apparatus is provided with an image holding member, a charging unit that charges the surface of the image holding member, an electrostatic charge image forming unit that forms an electrostatic charge image on the charged surface of the image holding member, a developing unit that contains an electrostatic charge image developer, and develops the electrostatic charge image formed on the surface of the image holding member as a toner image by using the electrostatic charge image developer, a transfer unit that transfers the toner image formed on the surface of the image holding member to a surface of a recording medium, and a fixing unit that fixes the toner image transferred onto the surface of the recording medium. In addition, the electrostatic charge image developer according to the exemplary embodiment is used as the electrostatic charge image developer.

In the image forming apparatus according to the exemplary embodiment, an image forming method (the image forming method according to the exemplary embodiment)

including a step of charging a surface of an image holding member, a step of forming an electrostatic charge image on the charged surface of the image holding member, a step of developing an electrostatic charge image formed on the surface of the image holding member as a toner image with the electrostatic charge image developer according to the exemplary embodiment, a step of transferring the toner image formed on the surface of the image holding member onto a surface of a recording medium, and a step of fixing the toner image transferred on the surface of the recording medium is performed.

As the image forming apparatus according to the exemplary embodiment, known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the surface of the intermediate transfer member to the surface of the recording medium; an apparatus a cleaning unit that cleans the surface of the image holding member before being charged and after transferring the toner image; and an apparatus includes an erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit that secondarily transfers the toner image formed on the surface of the intermediate transfer member to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer according to the exemplary embodiment is preferably used.

Hereinafter, an example of the image forming apparatus according to the exemplary embodiment will be described. However, the process cartridge is not limited thereto. Major parts shown in the drawing will be described, but descriptions of other parts will be omitted.

Figure 5:
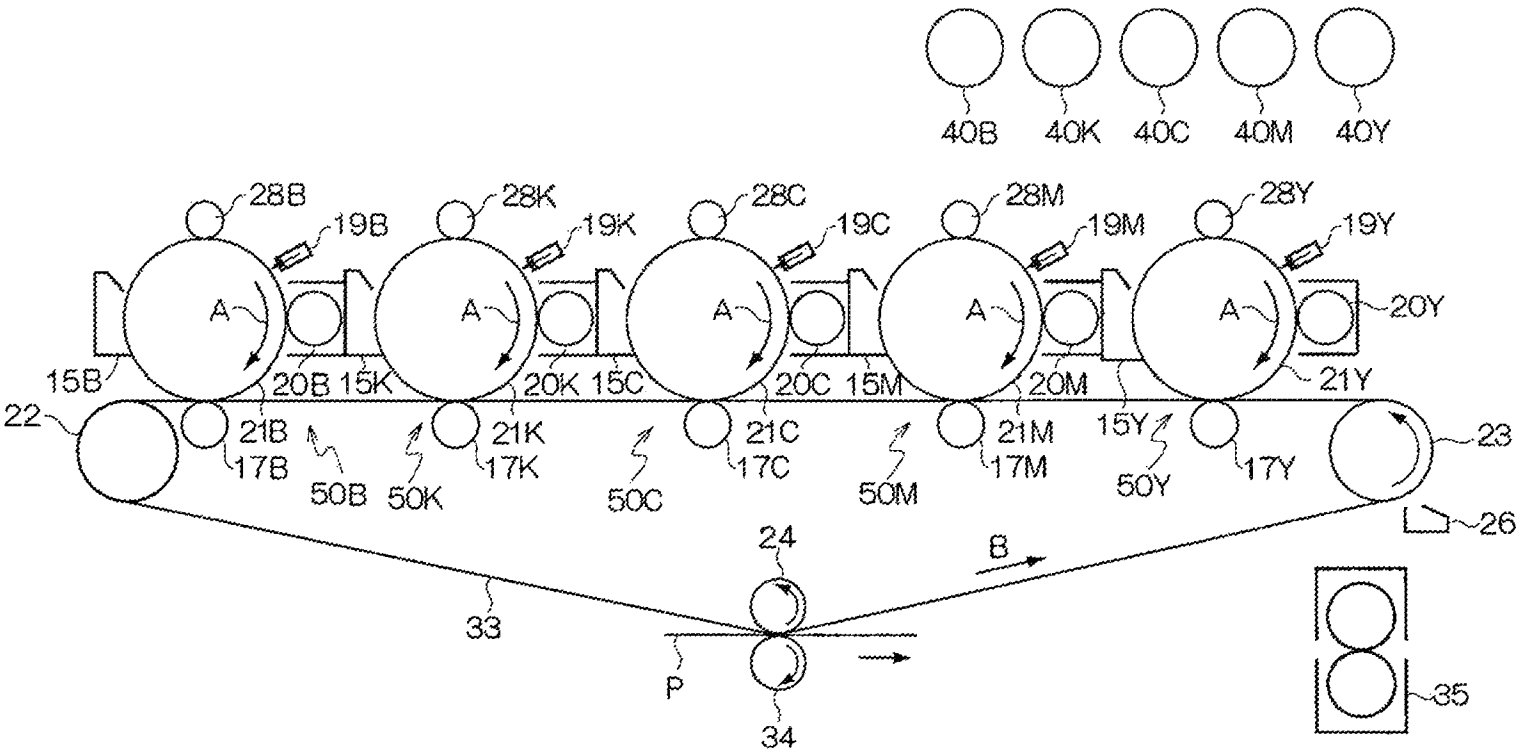
FIG. 5 is a configuration diagram illustrating an image forming apparatus according to the exemplary embodiment.

FIG. 5 is a configuration diagram illustrating an image forming apparatus according to the exemplary embodiment.

The image forming apparatus illustrated in FIG. 5 has a tandem tandem-type configuration in which plural image forming units are provided, and is an intermediate transfer type image forming apparatus provided with an intermediate transfer belt. In addition, an electrostatic charge image developer containing the mixed brilliant toner or the mixed toner is contained in one of the plural image forming units.

Although the image forming apparatus as illustrated in FIG. 5 includes five image forming units, the image forming apparatus according to the exemplary embodiment is not limited as long as it includes an image forming unit that contains the electrostatic charge image developer containing at least the mixed brilliant toner or the mixed toner. That is, the image forming apparatus according to the exemplary embodiment may include image forming units other than the image forming unit that contains the electrostatic charge image developer containing the mixed brilliant toner or the mixed toner.

In the image forming apparatus illustrated in FIG. 5, for example, four image forming units 50Y, 50M, 50C, and 50K that form toner images of respective colors of yellow, magenta, cyan, and black, and an image forming unit 50B that forms the mixed color toner image with a developer containing the above-described mixed brilliant toner or the mixed toner are arranged in parallel (tandem tandem) at intervals.

The image forming units are arranged in the order of the image forming units 50Y, 50M, 50C, 50K, and 50B from the upstream side in the rotational direction of the intermediate transfer belt 33.

Here, the image forming units 50Y, 50M, 50C, 50K, and 50B have a similar configuration except for the color of the toner contained in the stored developer, and thus in this case, the image forming unit 50Y for forming a yellow image will be described as a representative. By denoting reference numerals with magenta (M), cyan (C), black (K), and mixed color (B) instead of yellow (Y) to the same portions as those in the image forming unit 50Y, description of each of the image forming units 50M, 50C, 50K, and 50B will not be made.

The yellow image forming unit 50Y includes a photoreceptor 21Y as an image holding member, and the photoreceptor 21Y is rotationally driven at a predetermined process speed by a driving unit (not shown) along a direction of an arrow A. As the photoreceptor 21Y, for example, an organic photoreceptor having sensitivity in an infrared region is used.

A charging roller (charging unit) 28Y is provided on the upper portion of the photoreceptor 21Y, and a predetermined voltage is applied to the charging roller 28Y by a power source (not shown) so as to charge the surface of the photoreceptor 21Y to a predetermined potential.

An exposure device (electrostatic charge image forming unit) 19Y that exposes the surface of the photoreceptor 21Y so as to form an electrostatic charge image is disposed around the photoreceptor 21Y on the downstream side of the charging roller 28Y in the rotation direction of the photoreceptor 21Y. In this case, as the exposure device 19Y, an LED array which realizes miniaturization is used due to the space, but the invention is not limited thereto, and an electrostatic charge image forming unit using the other laser beam or the like may be used.

In addition, a developing device (developing unit) 20Y including a developer holding member for holding a yellow color developer is disposed around the photoreceptor 21Y on the downstream side of the exposure device 19Y in the rotational direction of the photoreceptor 21Y, the electrostatic charge image formed on the surface of the photoreceptor 21Y is visualized with yellow toner, and thereby a toner image is formed on the surface of the photoreceptor 21Y.

Below the photoreceptor 21Y, an intermediate transfer belt (transfer medium, primary transfer unit) 33 for primarily transferring a toner image formed on the surface of photoreceptor 21Y is disposed to extend downward of five photoreceptors 21Y, 21M, 21C, 21K, and 21B. The intermediate transfer belt 33 is attached to the surface of the photoreceptor 21Y by the primary transfer roller 17Y. The intermediate transfer belt 33 is supported by three rollers of a driving roller 22, a support roller 23, and a bias roller 24, and is moved in the direction of an arrow B at a moving speed equal to the process speed of the photoreceptor 21Y. A yellow toner image is primarily transferred to the surface of the intermediate transfer belt 33, and the toner images of respective colors of magenta, cyan, black, and mixed color are sequentially primarily transferred and laminated.

In addition, a cleaning device 15Y for cleaning the toner remaining on the surface of the photoreceptor 21Y and the toner that has been retransferred (re-transferred) is disposed around the photoreceptor 21Y on the downstream side of the primary transfer roller 17Y in the rotational direction (direction of the arrow A) of the photoreceptor 21Y. For the cleaning device 15Y, a blade cleaning type device is used. The cleaning blade in the cleaning device 15Y is mounted on the surface of the photoreceptor 21Y so as to be in pressure contact with the photoreceptor 21Y in the counter direction.

The material of the cleaning blade is not particularly limited, and various elastic members are used. Specific elastic members include an elastic member such as a polyurethane elastic member, a silicone rubber, and a chloroprene rubber.

A secondary transfer roller (secondary transfer unit) 34 is pressed against the bias roller 24 supporting the intermediate transfer belt 33 via the intermediate transfer belt 33. A toner image primarily transferred and laminated on the surface of the intermediate transfer belt 33 is electrostatically transferred to the surface of a recording sheet (recording medium) P supplied from a paper cassette (not shown) at a nip portion between the bias roller 24 and the secondary transfer roller 34. At this time, the mixed color toner image is the uppermost (uppermost layer) of the toner images transferred and laminated on the intermediate transfer belt 33, and thus in the toner image transferred to the surface of the recording sheet P, the mixed color toner image is the bottom (bottom layer).

As the recording sheet P, for example, plain paper used for an electrophotographic copying machine or the like, coated paper obtained by coating the surface of plain paper with a resin or the like, art paper for printing, paper having unevenness (such as embossed paper) on the surface, and the like are exemplified. As a recording medium, a resin film (for example, an OHP sheet or the like) which is a resin recording medium may be used.

In the exemplary embodiment, even when using a recording medium having unevenness on the surface (for example, a recording medium having a difference between a convex portion and a concave portion of 0.05 mm or more), a recording medium made of an easily chargeable resin (for example, a polyester resin recording medium), or the like, the generation of areas having partially different color tone is prevented.

Note that, examples of the recording medium having unevenness on the surface include embossed paper such as LE SAC 66 (continuity: 260 kg, and maximum unevenness difference: 150 μm, manufactured by Tokushu Tokai Paper Co., Ltd.). Examples of easily chargeable recording medium include a PET sheet, LIMEX (Lime Mex, major material: limestone), aluminum vapor deposited paper, Yupo paper, and the like.

Further, a fixing device (fixing unit) 35 that fixes a toner image transferred onto the recording sheet P on the surface of the recording sheet P by heat and pressure for making the image permanent is disposed on the downstream (a path is not shown) of the secondary transfer roller 34.

Examples of the fixing device 35 include a fixing belt having a belt shape by using a low surface energy material typified by a fluorine resin component and a silicone resin as the surface thereof, and a fixing roller having a cylindrical shape by using a low surface energy material typified by a fluorine resin component and a silicone resin as the surface thereof.

The image forming apparatus as illustrated in FIG. 5 includes toner cartridges 40B, 40Y, 40M, 40C, and 40K. The toner cartridges 40B, 40Y, 40M, 40C, and 40K are cartridges that contains the toner of each color, and are detachable from the image forming apparatus, and are connected to the corresponding developing devices 20Y, 20M, 20C, 20K, and 20B via a toner supply tubes (not shown). In addition, in a case where the toner contained in the toner cartridge runs low, the toner cartridge is replaced.

Next, the operation of each of the units 50Y, 50M, 50C, 50K, and 50B for forming images of yellow, magenta, cyan, black, and mixed color will be described. Since the operations of the units 50Y, 50M, 50C, 50K, and 50B are similar to each other, the operation of the yellow unit 50Y will be described as a representative thereof.

In the yellow unit 50Y, the photoreceptor 21Y rotates in a direction of the arrow A at the predetermined process speed. The surface of the photoreceptor 21Y is negatively charged to a predetermined potential by the charging roller 28Y. Thereafter, the surface of the photoreceptor 21Y is exposed by the exposure device 19Y, and an electrostatic charge image corresponding to image information is formed. Subsequently, the negatively charged toner is reversely developed by the developing device 20Y, and the electrostatic charge image formed on the surface of the photoreceptor 21Y is visualized on the surface of the photoreceptor 21Y so as to form a toner image. Thereafter, the toner image on the surface of the photoreceptor 21Y is primarily transferred to the surface of the intermediate transfer belt 33 by the primary transfer roller 17Y. After the primary transfer, transfer residual components such as the residual toner remaining on the surface of the photoreceptor 21Y is scraped off by the cleaning blade of the cleaning device 15Y, and cleaned for the next image forming step.

The above operations are performed by the units 50Y, 50M, 50C, 50K, and 50B, and the toner images visualized on the surfaces of the photoreceptors 21Y, 21M, 21C, 21K, and 21B are sequentially transferred to the surface of the intermediate transfer belt 33. In the color mode, toner images of respective colors are transferred in order of yellow, magenta, cyan, black, and mixed color, and also in the two color and three color mode, required color toner images are only transferred alone or in multiple in the above order. Thereafter, the toner images transferred alone or in multiple to the surface of the intermediate transfer belt 33 are secondarily transferred to the surface of the recording sheet P supplied from a paper cassette (not shown) by the secondary transfer roller 34, and then is fixed by being heated and pressurized in the fixing device 35. The toner remaining on the surface of the intermediate transfer belt 33 after the secondary transfer is cleaned by a belt cleaner 26 formed of a cleaning blade for the intermediate transfer belt 33.

Further, the intermediate transfer belt 33, on which the toner image is transferred alone or in multiple, is erased by the driving roller 22.

In the image forming apparatus as illustrated in FIG. 5, a charging roller is used as a charging device; however, the charging device is not limited to the charging roller. For example, known chargers, such as a contact type charger using a charging brush, a charging film, a charging rubber blade, and a charging tube; a non-contact type roll charger, a scorotron charger or a corotron charger using a corona discharge, may be used.

In the image forming apparatus as illustrated in FIG. 5, a primary transfer roller is used as a primary transfer unit and a secondary transfer roller is used as a secondary transfer unit, but the present invention is not limited to this, and for example, known chargers, such as a contact type transfer charger using a belt, a film, a rubber blade or the like, a scorotron transfer charger or a corotron transfer charger each using a corona discharge, may be used.

In the image forming apparatus as illustrated in FIG. 5, five of the units 50Y, 50M, 50C, 50K, and 50B are arranged in this order from the upstream side in the rotational direction of the intermediate transfer belt 33, but this order is not limited.

The unit 50B in the image forming apparatus as illustrated in FIG. 5 may be configured as a process cartridge in which a developing device 20B including a developer holding member for holding a mixed color developer, a photoreceptor 21B, a charging roller 28B, and a cleaning device 15B are integrally formed, and which is detachable from an image forming apparatus. Further, the units 50M, 50C, 50K, and 50Y may also be configured as process cartridges similarly to the unit 50B.

A configuration of the process cartridge will be described below.

<Process Cartridge and Toner Cartridge>

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may be configured to include a developing device and at least one selected from other units such as an image holding member, a charging unit, an electrostatic charge image forming unit, and a transfer unit.

Hereinafter, an example of the process cartridge according to the exemplary embodiment will be described. However, the process cartridge is not limited thereto. Major parts shown in the drawing will be described, but descriptions of other parts will be omitted.

Figure 6:
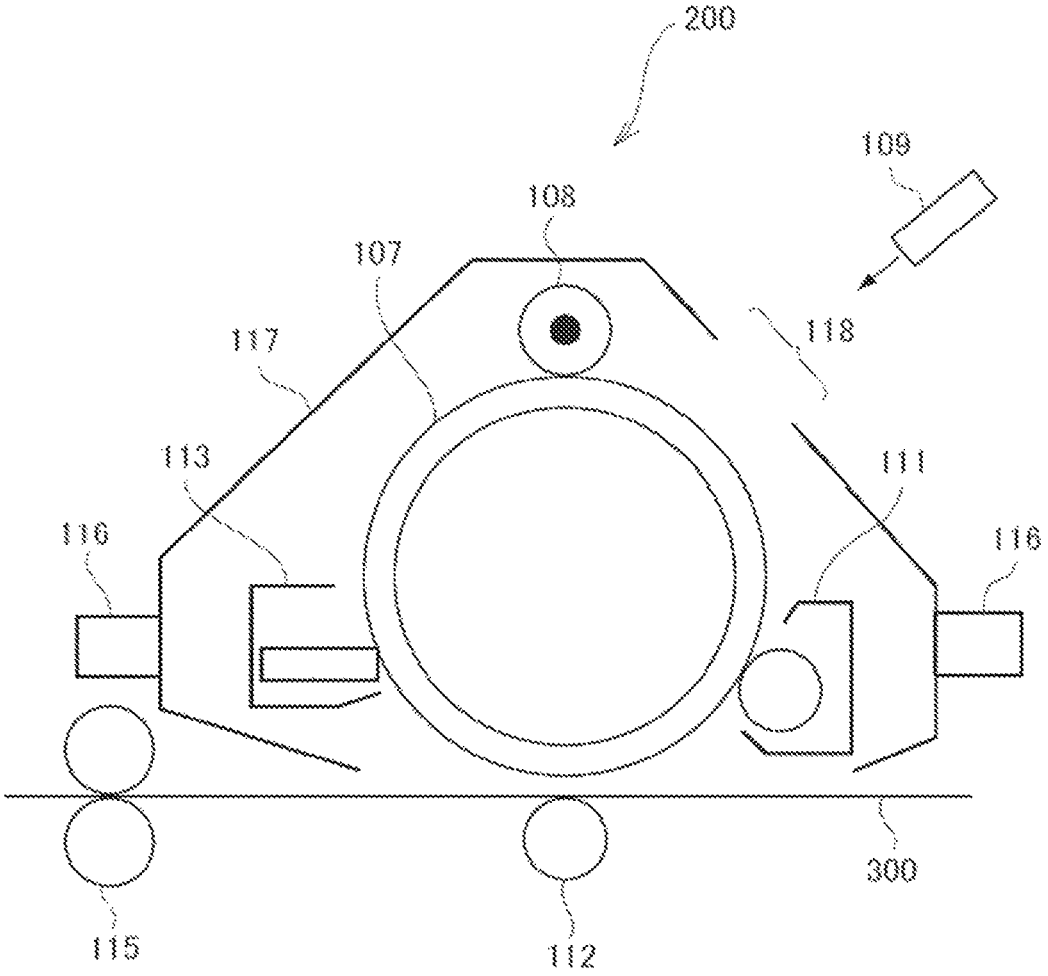
FIG. 6 is a configuration diagram illustrating the process cartridge according to the exemplary embodiment.

FIG. 6 is a configuration diagram illustrating the process cartridge according to the exemplary embodiment.

The process cartridge 200 illustrated in FIG. 6 is configured such that a photoreceptor 107 (an example of the image holding member), a charging roller 108 (an example of the charging unit) which is provided in the vicinity of the photoreceptor 107, a developing device 111 (an example of the developing unit), and a photoreceptor cleaning device 113 (an example of the cleaning unit) are integrally formed in combination, and are held by a housing 117 which is provided with an attached rail 116 and an opening portion 118 for exposing light.

Note that, in FIG. 6, reference numeral 109 is denoted as an exposure device (an example of the electrostatic charge image forming unit), reference numeral 112 is denoted as a transfer device (an example of the transfer unit), reference numeral 115 is denoted as a fixing device (an example of the fixing unit), and reference numeral 300 is denoted as a recording sheet (an example of the recording medium).

Next, the toner cartridge according to the exemplary embodiment will be described.

The toner cartridge according to the exemplary embodiment contains the mixed brilliant toner or the mixed toner according to the exemplary embodiment and is detachable from an image forming apparatus. The toner cartridge contains the brilliant toner or the toner for replenishment for being supplied to the developing unit provided in the image forming apparatus.

The image forming apparatus shown in FIG. 5 has such a configuration that the toner cartridges 40B, 40Y, 40M, 40C, and 40K are detachable therefrom, and the developing devices 20Y, 20M, 20C, 20K, and 20B are connected to the toner cartridges corresponding to the respective developing devices (colors) via toner supply tubes (not shown), respectively. In addition, in a case where the brilliant toner or the toner contained in the toner cartridge runs low, the toner cartridge is replaced.

Examples

Hereinafter, Embodiment X will be more specifically described with reference to Examples and Comparative Example Comparative Example; however, Embodiment X is not limited to any one of these Examples. In addition, "parts" and "%" are on a weight basis unless otherwise specified.

<Preparation of Mixed Brilliant Toner (1)>

[Preparation of First Brilliant Toner Particle (1)]

(Synthesis of Binder Resin 1)

Dimethyl adipate: 74 parts
Dimethyl terephthalate: 192 parts
Bisphenol A ethylene oxide adduct: 216 parts
Ethylene glycol: 38 parts
Tetrabutoxy titanate (catalyst): 0.037 parts The above components are put into a two-necked flask heat-dried, the inside of the container is kept in an inert atmosphere by introducing nitrogen gas into the container, the temperature is raised while stirring, and co-condensation polymerization reaction is performed at 160° C. for 7 hours. Subsequently, a pressure is slowly reduced to 10 Torr, the temperature is raised to 220° C. and the resultant is kept for 4 hours. The pressure is once returned to a normal pressure, 9 parts of trimellitic anhydride is added thereto, and the pressure is slowly reduced to 10 Torr again, and held at 220° C. for one hour, thereby synthesizing a binder resin 1.

The glass transition temperature (Tg) of the binder resin 1 is obtained by measuring by a differential scanning calorimeter (manufactured by Shimadzu Corporation: DSC-50) under the conditions of room temperature (25° C.) up to 150° C. at a heating rate of 10° C./min. Note that, the glass transition temperature is a temperature at an intersection between a base line and an extended line of a rising line in a heat absorbing portion. The glass transition temperature of the binder resin 1 is 63.5° C.

(Preparation of Resin Particle Dispersion 1)

Binder resin 1:160 parts
Ethyl acetate: 233 parts
Sodium hydroxide aqueous solution (0.3 N): 0.1 parts The above components are put into a 1,000 ml separable flask, heated at 70° C., and stirred with a three one motor (manufactured by Shinto Scientific Co., Ltd.) so as to prepare a resin mixture solution. While stirring the resin mixture at 90 rpm, 373 parts of ion exchanged water is slowly added thereto to perform phase inversion emulsification, followed by removal of the solvent, thereby obtaining a resin particle dispersion 1 (solid content concentration: 30% by weight). The volume average particle diameter of the resin particle dispersion 1 is 162 nm.

(Preparation of Release Agent Dispersion)

Carnauba wax (RC-160 manufactured by Toa Kasei Co., Ltd.): 50 parts

Anionic surfactant (NEOGEN RK, manufactured by DKS Co., Ltd.): 1.0 part

Ion exchanged water: 200 parts

The above-described materials are mixed with each other, the mixture is heated at 95° C., is dispersed by a homogenizer (ULTRA TURRAX T50, manufactured by IKA Ltd.), and then is subjected to a dispersing treatment by Manton-Gaulin high pressure homogenizer (manufactured by Manton Gaulin Mfg Company Inc) for 360 minutes, thereby obtaining a release agent particle dispersion (solid content concentration: 20% by weight) in which a release agent particle having a volume average particle diameter of 0.23 μm is dispersed.

(Preparation of aluminum pigment dispersion 1)

Flake-shape aluminum pigment (manufactured by Showa Aluminum Powder KK, 2173EA): 100 parts Anionic surfactant (manufactured by DKS Co. Ltd., NEOGEN R): 1.5 parts Ion exchanged water: 400 parts The above components are mixed and dispersed about one hour by an emulsifying disperser Cavitron (manufactured by Taiheiyo Kiko Co., Ltd., CR 1010), thereby obtaining an aluminum pigment dispersion 1 (solid content concentration: 20% by weight).

(Preparation of Coloring Agent Particle Dispersion 1)

Yellow pigment C.I. Pigment Yellow 74 (manufactured by Clariant) Hansa Yellow 5GX01:70 parts Anionic surfactant (NEOGEN RK, manufactured by DKS Co. Ltd.): 30 parts Ion exchanged water: 200 parts The above materials are mixed and dispersed for 10 minutes using a homogenizer (ULTRA TURRAX T50, manufactured by IKA). Ion exchanged water is added such that the solid content in the dispersion is 20% by weight, thereby obtaining a coloring agent particle dispersion in which a coloring agent particle having a volume average particle diameter of 140 nm is dispersed.

(Preparation of Brilliant Toner Particle)

Resin particle dispersion 1:80 parts

Release agent dispersion: 48 parts

Aluminum pigment dispersion 1:180 parts

Coloring agent particle dispersion 1:80 parts

Nonionic surfactant (IGEPAL CA897): 1.40 parts

The above raw materials are put into a 2 L cylindrical stainless steel container, and dispersed for 10 minutes and mixed while applying a shearing force at 4,000 rpm by a homogenizer (ULTRA TURRAX T50, manufactured by IKA Co., Ltd). Next, 300 parts of resin particle dispersion 1 is added thereto, then 1.75 parts of a 10% by weight nitric acid aqueous solution of polyaluminum chloride is slowly added dropwise, and the resultant is dispersed and mixed for 15 minutes at a rotation speed of 5,000 rpm by a homogenizer, thereby preparing a raw material dispersion.

Thereafter, the raw material dispersion is transferred to a furnace provided with a stirring device using two stirring blades and a thermometer, heating is started with a mantle heater at a stirring rotation speed of 810 rpm, and the resultant is kept for 30 minutes at 54° C. At this time, the pH of the raw material dispersion is controlled to be in the range of 2.2 to 3.5 with 0.3 N nitric acid or 1 N sodium hydroxide aqueous solution. The resultant is kept in the above pH range for about 2 hours, thereby forming an aggregated particle.

Next, 40 parts of resin particle dispersion 1 is additionally added thereto over 20 minutes, and the resultant is kept for 15 minutes, and then 40 parts of resin particle dispersion 1 is added again over 20 minutes. The temperature is further raised to 56° C., and agglomerated particles are arranged while confirming the size and form of the particle with an optical microscope and Multisizer II. Thereafter, the pH is raised to 8.0, then the temperature is raised to 67.5° C., the pH is lowered to 6.0 while maintaining the temperature at 67.5° C., and in one hour, the heating is stopped, and cooling is carried out at a cooling rate of 1.0° C./min. Thereafter, sieving is performed with a 20 μm mesh, washing is repeatedly performed with water, and then drying is performed with a vacuum dryer, thereby obtaining a core-shell particle (1).

On the other hand, the resin particle dispersion 1 is filtered, washed, and dried, thereby obtaining a resin particle (1) having a volume average particle diameter of 162 nm. Specifically, the resin particle dispersion 1 is put into a dialysis tube (SPECTRUM standard RC dialysis tube Sepctra/Pro 5, fraction molecular weight of 12,000 to 14,000 daltons, plane width of 140 mm), the container is filled with ion exchanged water, the ion exchanged water is appropriately exchanged, and such a cleaning is repeated until the resin particle dispersion 1 has electric conductivity of 5 S/m or less.

Further, the washed resin particles are dried by spraying and drying (that is, spray-dry) by Twin Jetter NL-5 (inlet temperature of 200° C., outlet temperature of 50° C., pressure of 0.2 MPa, feed rate of 8.5 kg/h), thereby obtaining a resin particle (1). Incidentally, an acceptance balance after drying is 0.4% of moisture content.

500 parts of the obtained core-shell particle (1) and 53 parts of the resin particle (1) are stirred at 2,000 rpm for 10 minutes by Nobilta NOB-300 (manufactured by Hosokawa Micron Corp.) while maintaining the inside temperature of the apparatus at 65° C., thereby obtaining a brilliant toner particle (1).

[Preparation of Second Brilliant Toner Particle (1)]

A second brilliant toner particle (1) is obtained in the same manner as in the preparation of the first brilliant toner particle (1) except that 70 parts of a magenta pigment C.I. Pigment Red 122 (manufactured by DIC Corporation) is used instead of the yellow pigment in the preparation of the coloring agent particle dispersion.

[Preparation of Mixed Brilliant Toner]

50 parts of the first brilliant toner particle (1), 50 parts of the second brilliant toner particle (1), and 5 parts of hydrophobic silica (RY 50 manufactured by Nippon Aerosil Co., Ltd.) are mixed in a Henschel mixer at a peripheral speed of 30 m/s for 3 minutes. Thereafter, the mixture is sieved with a vibration sieve having an opening of 45 μm, thereby obtaining a mixed brilliant toner (1).

The measurement results, in which a difference in brightness values, a difference in hue angles, a difference in saturation values, $R_1$, $R_2$, $D_1$, $D_2$, $|P_1-P_2|$, $|W_1-W_2|$, ΔE, and fluidity with respect to the mixed brilliant toner (1) are measured according to the above-described methods, are indicated in Table 1.

<Preparation of Developer (1)>

[Preparation of Carrier]

Ferrite particle (average particle diameter: 50 μm): 100 parts

Toluene: 14 parts

Styrene/methyl methacrylate copolymer (copolymerization ratio: 15/85): 3 parts

Carbon black: 0.2 parts

The above components other than the ferrite particles are dispersed with a sand mill, thereby preparing a dispersion, the dispersion and the ferrite particles are put into a vacuum degassing type kneader, and dried under reduced pressure while stirring, thereby obtaining a carrier.

[Preparation of Developer]

8 parts of mixed brilliant toner (1) and 100 parts of carrier are put into a V blender and the mixture is stirred for 20 minutes, thereby obtaining a developer (1).

<Evaluation>

The following evaluation is carried out by using the obtained developer (1). The results are indicated in Table 1.

Specifically, APEOSPORT IV C4470 (manufactured by Fuji Xerox Co., Ltd.) is prepared as an intermediate transfer type image forming apparatus of forming an image for evaluation, the developer is put into a developing unit, and a replenished toner (the same as the mixed brilliant toner contained in the developer) is put into a toner cartridge. Subsequently, 100 sheets of solid images of 5 cm×5 cm with 100% of image area ratio (5.0 g/m$^2$) are formed on the following recording medium 1 at room temperature (25° C.) at a process speed of 445 mm/sec by an image forming apparatus, then 100 sheets of fine line images of 0.5 mm in thickness and 50 mm in length are formed on the following recording medium 2, and 100 sheets of solid images of 5 cm×5 cm with 100% of image area ratio are formed on the following recording medium 3.

Recording medium 1: Embossed paper (product name: LE SAC 66 white (Continuity: 46 Edition 175 kg) manufactured by Takeo Paper Trading Co., Ltd)

Recording medium 2: Resin film (product name: OZK-T 100 μm, manufactured by DYNIC CORPORATION)

Recording medium 3: plain paper (product name: OK top coat+paper, manufactured by Oji Paper Co., Ltd.)

With respect to the images formed on the first, 50th, 75th, and 100th sheets of the recording medium 1, whether or not regions partially different in color tone (color unevenness) are generated in a recessed region of the recording medium 1 is visually observed. Note that, the color unevenness means a rough feeling of an apparent image such as granular feeling and graininess. The evaluation results are as follows.

A: Color unevenness is not confirmed on the 100th sheet.

B: Color unevenness is not confirmed on the 75th sheet, but color unevenness is slightly felt on the 100th sheet.

C: Color unevenness is not confirmed on the 50th sheet, but color unevenness is slightly felt on the 75th sheet and the 100th sheet.

D: Color unevenness is not confirmed on the 50th sheet, color unevenness is slightly felt on the 75th sheet, and color unevenness may be confirmed on the 100th sheet, which is acceptable.

E: Color unevenness is not confirmed on the first sheet, color unevenness is slightly felt on from the 50th sheet to the 75th sheet, and color unevenness may be confirmed on the 100th sheet, which is acceptable.

F: Color unevenness is not confirmed on the first sheet, color unevenness is slightly felt on from the 50th sheet to the 75th sheet, and color unevenness may be confirmed on the 100th sheet.

G: Color unevenness is not confirmed on the first sheet, color unevenness is slightly felt on the 50th sheet, and color unevenness may be confirmed on the 75th sheet and the 100th sheet.

H: Color unevenness is felt on the first sheet, and color unevenness may be confirmed on the 50th, which is acceptable.

With respect to the images formed on the first, 50th, 75th, and 100th sheets of the recording medium 2, whether or not regions partially different in color tone are generated at the end portion in the thickness direction of the thin line image is observed with eye and a magnifying glass (magnification: 50 times). The evaluation results are as follows.

A: Even when the 100th sheet is observed with a magnifying glass, areas having different color tone are not confirmed.

B: Even when the 75th sheet is observed with a magnifying glass, areas having different color tone are not confirmed, when the 100th sheet is observed with eyes, areas having different color tone are not confirmed, and when the 100th sheet is observed with a magnifying glass, areas having different color tone may be confirmed.

C: Even when the 75th sheet is observed with a magnifying glass, areas having different color tone are not confirmed, and areas having different color tone are slightly confirmed on the 100th sheet.

D: Even when the 50th sheet is observed with a magnifying glass, areas having different color tone are not confirmed, when the 75th sheet is observed with eyes, areas having different color tone are not confirmed, and when the 75th sheet is observed with a magnifying glass, areas having different color tone may be confirmed.

E: Even when the 50th sheet is observed with a magnifying glass, areas having different color tone are not confirmed, and areas having different color tone are slightly confirmed on the 75th sheet.

F: Even when the first sheet is observed with a magnifying glass, areas having different color tone are not confirmed, when the 50th sheet is observed with eyes, areas having different color tone are not confirmed, and when the 50th sheet is observed with a magnifying glass, areas having different color tone may be confirmed.

G: Even when the first sheet is observed with a magnifying glass, areas having different color tone are not confirmed, and areas having different color tone are slightly confirmed on the 50th sheet.

H: Even when the first sheet is observed with a magnifying glass, areas having different color tone are not confirmed, and areas having different color tone are slightly confirmed on the first sheet.

Regarding the image formed on the recording medium 3, the brilliance (FI value) of the fixed image is measured as follows. Incident light is incident on the formed solid image at an incident angle of −45° with respect to the solid image by a spectral type goniometric color difference meter GC 5000L manufactured by Nippon Denshoku Industries Co., Ltd. as a goniophotometer, and reflectance A at an acceptance angle+30° and reflectance B at an acceptance angle −30° are measured. Note that, the reflectance A and the reflectance B are measured at intervals of 20 nm for light having wavelengths in the range of 400 nm to 700 nm, and each are set as an average of the values of the reflectance at the respective wavelengths. The ratio (A/B) is calculated from these measurement results, and the brilliance (FI value) is measured.

<Preparation of Mixed Brilliant Toners (2) to (57)>

Mixed brilliant toners (2) to (57) are obtained in the same manner as in the preparation of the mixed brilliant toner (1) except that the kinds of the coloring agents used in the preparation of the first brilliant toner particle and the kinds of the coloring agents used in the preparation of the second brilliant toner particle are set as indicated in Tables 1 to 5, and the addition amount of the coloring agent particle dispersion in the preparation of the brilliant toner particle is set as follows in accordance with the kinds of the coloring agents to be used.

The measurement results in which a difference in brightness values, a difference in hue angles, a difference in saturation values, $R_1$, $R_2$, $D_1$, $D_2$, $|P_1-P_2|$, $|W_1-W_2|$, $\Delta E$, and fluidity with respect to the mixed brilliant toners (2) to (57) are measured according to the above-described method are indicated in Tables 1 to 5.

The notations in Tables 1 to 5 are as follows.

PY74: Yellow pigment C.I. Pigment Yellow 74 (Hansa Yellow 5GX01 manufactured by Clariant)

PB15: 3: Cyan Pigment C.I. Pigment Blue 15: 3 (manufactured by Dainichiseika Color & Chemicals Mfg. Co., Ltd.)

PR122: Magenta Pigment C.I. Pigment Red 122 (manufactured by DIC Corporation)

PR254: Red Pigment C.I. Pigment Red 254 (manufactured by DIC Corporation, ASTOGEN Super Red 226-5254)

PO38: Orange Pigment C.I. Pigment Orange 38 (Novoperm Red HFG, manufactured by Clariant)

PG36: Yellow Green Pigment C.I. Pigment Green 36 (FASTOGEN Green 2YK, manufactured by DIC Corporation)

PB7: Green Pigment C.I. Pigment Blue 7 (FASTOGEN Green S, manufactured by DIC Corporation)

PB15: 6: Blue Pigment C.I. Pigment Blue 15:6 (FASTOGEN Blue AE-8, manufactured by DIC Corporation)

PV23: Violet Pigment C.I. PigmentViolet 23 (FASTOGEN Violet RNS, manufactured by DIC Corporation)

CB: Black Pigment Carbon Black (Model No.: Nipex 35, manufactured by Evonik Industries AG)

W: White Pigment titanium oxide (Model No.: JR-301, manufactured by TAYCA)

Note that, the relation between the kinds of the coloring agent to be used and the addition amount of the coloring agent particle dispersion in preparing the toner particles is as follows.

Yellow pigment: 80 parts
Cyan Pigment: 40 parts
Magenta Pigment: 80 parts
Red Pigment: 80 parts
Orange Pigment: 120 parts
Yellow Green Pigment: 120 parts
Green Pigment: 80 parts
Blue Pigment: 80 parts
Violet Pigment: 40 parts
Black Pigment: 30 parts
White Pigment: 200 parts <Preparation and Evaluation of Developers (2) to (57)>

Developers (2) to (57) are obtained in the same manner as in the preparation of the developer (1) except that mixed brilliant toners (2) to (57) are used instead of the mixed brilliant toner (1), respectively.

The obtained developers (2) to (57) are evaluated in the same manner as in the evaluation of the developer (1). The results are indicated in Tables 1 to 5.

<Preparation of Mixed Brilliant Toner (58)>

[First Brilliant Toner Particle (58) to Third Brilliant Toner Particle (58)]

A first brilliant toner particle (58), a second brilliant toner particle (58), and a third brilliant toner particle (58) are obtained in the same manner as in the preparation of the first brilliant toner particle (1) except that the kinds of the coloring agents used in the preparation of the respective brilliant color toner particles are set as indicated in Table 5, and the addition amount of the coloring agent particle dispersion in the preparation of the brilliant toner particle is set as above in accordance with the kinds of the coloring agents to be used.

[Preparation of Mixed Brilliant Toner]

40 parts of the first brilliant toner particle (58), 40 parts of the second brilliant toner particle (58), 20 parts of third brilliant toner particle (58), and 5 parts of dimethyl silicone oil treated silica particle (RY 200 manufactured by Nippon Aerosil Co., Ltd.) are mixed in a Henschel mixer at a peripheral speed of 30 m/s for 3 minutes. Thereafter, the mixture is sieved with a vibration sieve having an opening of 45 μm, thereby obtaining a mixed brilliant toner (58).

The measurement results in which a difference in brightness values, a difference in hue angles, a difference in saturation values, $R_1$, $R_2$, $D_1$, $D_2$, $|P_1-P_2|$, $|W_1-W_2|$, $\Delta E$, and fluidity with respect to the mixed brilliant toner (58) are measured according to the above-described method are indicated in Table 5.

In addition, the results of the measurements for the average projected circularity $R_3$ and the average projected circle equivalent diameter $D_3$ in the third brilliant toner particle according to the above-described method are indicted in Table 5.

Note that, any one of the difference in brightness values, the difference in hue angles, difference in saturation values, $|P_1-P_2|$, and $|W_1-W_2|$ means "difference" in a combination which has the largest difference among the first brilliant toner particle to the third brilliant toner particle.

<Preparation and Evaluation of Developer (58)>

[Preparation and Evaluation of Developer]

A developers (58) is obtained in the same manner as in the preparation of the developer (1) except that mixed brilliant toner (58) is used instead of the mixed brilliant toner (1).

The obtained developer (58) is evaluated in the same manner as in the evaluation of the developer (1). The results are indicated in Table 5.

<Preparation of Mixed Brilliant Toner (59)>

[Preparation of First Brilliant Toner Particle (59) and Second Brilliant Toner Particle (59)]

Each of a first brilliant toner particle (59) and a second brilliant toner particle (59) is obtained in the same manner as in the preparation of each of the first brilliant toner particle (26) and the second brilliant toner particle (26) except that in the preparation of the first brilliant toner particle (26) and the second brilliant toner particle (26), the step of "the pH is raised to 8.0, then the temperature is raised to 67.5° C., the pH is lowered to 6.0 while maintaining the temperature at 67.5° C., and in one hour, the heating is stopped, and cooling is carried out at a cooling rate of 1.0° C./min" is changed to a step of "the pH is raised to 9.0, then the temperature is raised to 65° C., the pH is lowered to 7.0 while maintaining the temperature at 65° C., and in one and half hours, the heating is stopped, and cooling is carried out at a cooling rate of 1.0° C./min", and the resin particles are not adhered by Nobilter and a core-shell particle is used as it is as a brilliant toner particle.

[Preparation of Mixed Brilliant Toner]

A mixed brilliant toner (59) is obtained in the same manner as in the preparation of the mixed brilliant toner (1) except that the first brilliant toner particle (59) and the second brilliant toner particle (59) are used instead of the first brilliant toner particle (1) and the second brilliant toner particle (1).

The measurement results in which a difference in brightness values, a difference in hue angles, a difference in saturation values, $R_1$, $R_2$, $D_1$, $D_2$, $|P_1-P_2|$, $|W_1-W_2|$, $\Delta E$, and fluidity with respect to the mixed brilliant toner (59) are measured according to the above-described method are indicated in Table 5.

<Preparation and Evaluation of Developer (59)>

A developers (59) is obtained in the same manner as in the preparation of the developer (1) except that mixed brilliant toner (59) is used instead of the mixed brilliant toner (1).

The obtained developer (59) is evaluated in the same manner as in the evaluation of the developer (1). The results are indicated in Table 5.

<Preparation of Mixed Brilliant Toner (60)>

[Preparation of First Brilliant Toner Particle (60) and Second Brilliant Toner Particle (60)]

Each of first brilliant toner particle (60) and second brilliant toner particle (60) is obtained in the same manner as in the preparation of each of the first brilliant toner particle (26) and the second brilliant toner particle (26) except that in the preparation of the first brilliant toner particle (26) and the second brilliant toner particle (26), the step of "40 parts of resin particle dispersion 1 is additionally added and kept for 15 minutes, and then 40 parts of resin particle dispersion 1 is added again" is not performed, the step of "the pH is raised to 8.0, then the temperature is raised to 67.5° C., the pH is lowered to 6.0 while maintaining the temperature at 67.5° C., and in one hour, the heating is stopped, and cooling is carried out at a cooling rate of 1.0° C./min" is changed to a step of "the pH is raised to 9.0, then the temperature is raised to 65° C., the pH is lowered to 7.5 while maintaining the temperature at 65° C., and in two hours, the heating is stopped, and cooling is carried out at a cooling rate of 1.0° C./min", and the core particle is used as it is as a brilliant toner particle unless the resin particles are not adhered by Nobilter.

[Preparation of Mixed Brilliant Toner]

A mixed brilliant toner (60) is obtained in the same manner as in the preparation of the mixed brilliant toner (1) except that the first brilliant toner particle (60) and the second brilliant toner particle (60) are used instead of the first brilliant toner particle (1) and the second brilliant toner particle (1).

The measurement results in which a difference in brightness values, a difference in hue angles, a difference in saturation values, $R_1$, $R_2$, $D_1$, $D_2$, $|P_1-P_2|$, $|W_1-W_2|$, $\Delta E$, and fluidity with respect to the mixed brilliant toner (60) are measured according to the above-described method are indicated in Table 5.

<Preparation and Evaluation of Developer (60)>

A developers (60) is obtained in the same manner as in the preparation of the developer (1) except that mixed brilliant toner (60) is used instead of the mixed brilliant toner (1).

The obtained developer (60) is evaluated in the same manner as in the evaluation of the developer (1). The results are indicated in Table 5.

<Preparation of Mixed Brilliant Toner (61)>

[Preparation of First Brilliant Toner Particle (61)]

Binder resin 1:300 parts

Flake-shape aluminum pigment (manufactured by Showa Aluminum Powder Kk, 2173EA): 36 parts Yellow pigment C.I. Pigment Yellow 74 (product name, manufactured by Clariant): 16 parts Paraffin wax (HNP-9, manufactured by Nippon Seiro Co., Ltd.): 47 parts Charge control agent (BONTRON P-51 manufactured by Orient Chemical Industries Ltd.): 25 parts The above components are premixed by a 75 L Henschel mixer, and regarding 70% by weight of the entirety of the above components, a first kneading step is performed under the conditions of a kneading temperature of 180° C., the number of revolutions of 300 rpm, and the kneading rate of 100 kg/h, by a twin screw continuous kneader (extruder, manufactured by Kurimoto Kogyo Co., Ltd.) having a screw configuration. Thereafter, a second kneading step is performed on the kneaded material in the first kneading step and the remainder of the material (that is, 30% by weight of entirety of the above materials) under the conditions of a kneading temperature of 120° C., a rotational speed of 150 rpm, and a kneading rate of 300 kg/h, and thereby a kneaded material is obtained.

The obtained kneaded material in the second kneading step is pulverized by 400AFG-CR pulverizer (manufactured by Hosokawa Micron Corporation), and then fine powers and coarse powders are removed by an air elbow jet classifier (manufactured by MATSUBO Corporation), thereby obtaining a first brilliant toner particle (61).

[Preparation of Second Brilliant Toner Particle (61)]

A second brilliant toner particle (61) is obtained in the same manner as in the preparation of the first brilliant toner particle (61) except that 36 parts of Blue pigment C.I. Pigment PB 15:6 (product name: FASTOGEN Blue AE-8, manufactured by DIC Corporation) is used instead of Yellow pigment C.I. Pigment Yellow 74 (product name: Hansa Yellow 5GX01, manufactured by Clariant).

[Preparation of Mixed Brilliant Toner]

A mixed brilliant toner (61) is obtained in the same manner as in the preparation of the mixed brilliant toner (1) except that the first brilliant toner particle (61) and the second brilliant toner particle (61) are used instead of the first brilliant toner particle (1) and the second brilliant toner particle (1).

The measurement results in which a difference in brightness values, a difference in hue angles, a difference in saturation values, $R_1$, $R_2$, $D_1$, $D_2$, $|P_1-P_2|$, $|W_1-W_2|$, $\Delta E$, and fluidity with respect to the mixed brilliant toner (61) are measured according to the above-described method are indicated in Table 5.

<Preparation and Evaluation of Developer (61)>

A developers (61) is obtained in the same manner as in the preparation of the developer (1) except that mixed brilliant toner (61) is used instead of the mixed brilliant toner (1).

The obtained developer (61) is evaluated in the same manner as in the evaluation of the developer (1). The results are indicated in Table 5.

<Preparation of Brilliant Toner Set (C1)>

100 parts of first brilliant toner particle (1) and 5 parts of dimethyl silicone oil treated silica particle (RY 200 manufactured by Nippon Aerosil Co., Ltd.) are mixed in a Henschel mixer at a peripheral speed of 30 m/s for 3 minutes. Thereafter, the mixture is sieved with a vibration sieve having an opening of 45 μm, thereby obtaining a first brilliant toner (C1).

100 parts of second brilliant toner particle (1) and 5 parts of dimethyl silicone oil treated silica particle (RY 200 manufactured by Nippon Aerosil Co., Ltd.) are mixed in a Henschel mixer at a peripheral speed of 30 m/s for 3 minutes. Thereafter, the mixture is sieved with a vibration sieve having an opening of 45 μm, thereby obtaining a second brilliant toner (C1).

The first brilliant toner (C1) and the second brilliant toner (C1) are combined to constitute a brilliant toner set (C1).

The measurement results in which a difference in brightness values, a difference in hue angles, a difference in saturation values, and $\Delta E$ between the first brilliant toner (C1) and the second brilliant toner (C1) are measured according to the above-described method are indicated in Table 6.

<Preparation of Developer Set (C1)>

A first developer (C1) is obtained in the same manner as in the preparation of the developer (1) except that the first brilliant toner (C1) is used instead of the mixed brilliant toner (1).

A second developer (C1) is obtained in the same manner as in the preparation of the developer (1) except that the second brilliant toner (C1) is used instead of the mixed brilliant toner (1).

The first developer (C1) and the second developer (C1) are combined to constitute a developer set (C1).

<Evaluation of Developer Set (C1)>

The following evaluation is carried out by using the obtained developer set (C1). The results are indicated in Table 6.

Specifically, APEOSPORT IV C4470 (manufactured by Fuji Xerox Co., Ltd.) is prepared as an intermediate transfer type image forming apparatus of forming an image for evaluation, the first developer (C1) and the second developer (C1) constituting the developer set (C1) are put into a developer unit of each of the image forming units, and a replenished toner (the same mixed brilliant toner as the mixed brilliant toner contained in the developer) is put into a corresponding toner cartridge.

Specifically, the first developer (C1) is put into the developer unit of an image-form paper unit on the upstream side in the intermediate transfer member transport direction, and the second developer (C1) is put into the developer unit of an image-form paper unit on the downstream side in the intermediate transfer member transport direction. That is, first, a toner image formed of the first brilliant toner (C1) is formed on the intermediate transfer member, and a toner image formed of the second brilliant toner (C1) is formed thereon.

Next, 20 sheets of solid images of 5 cm×5 cm with 100% of image area ratio formed of both of first brilliant toner (C1) and second brilliant toner (C2) are formed on the following recording medium 3 at room temperature (25° C.) at a process speed of 445 mm/sec by an image forming apparatus.

Recording medium 3: plain paper (product name: OK top coat+paper, manufactured by Oji Paper Co., Ltd.)

Regarding the image formed on the recording medium 3, the brilliance (FI value) of the fixed image is measured in the same manner as in the preparation of the evaluation for the developer (1).

TABLE 1

| | Mixed brilliant toner | Coloring agent: First brilliant toner | Coloring agent: Second brilliant toner | Coloring agent: Third brilliant toner | Average projected circularity: $R_1$ | $R_2$ | $R_3$ | Average projected circle equivalent diameter (μm): $D_1$ | $D_2$ | $D_3$ | Difference in the respective color toner particles: Brightness difference | Hue difference (°) |
|---|---|---|---|---|---|---|---|---|---|---|---|---|
| Example 1 | (1) | PY74 | PR122 | — | 0.927 | 0.928 | — | 10.0 | 9.8 | — | 43 | 102 |
| Example 2 | (2) | PY74 | PB15:3 | — | 0.927 | 0.929 | — | 10.0 | 9.7 | — | 40 | 138 |
| Example 3 | (3) | PY74 | None | — | 0.927 | 0.933 | — | 10.0 | 9.5 | — | — | — |
| Example 4 | (4) | PY74 | CB | — | 0.927 | 0.930 | — | 10.0 | 9.6 | — | 90 | — |
| Example 5 | (5) | PR122 | PB15:3 | — | 0.928 | 0.929 | — | 9.8 | 9.7 | — | 2 | 120 |
| Example 6 | (6) | PR122 | None | — | 0.928 | 0.933 | — | 9.8 | 9.5 | — | — | — |
| Example 7 | (7) | PR122 | CB | — | 0.928 | 0.930 | — | 9.8 | 9.6 | — | 37 | — |
| Example 8 | (8) | PB15:3 | None | — | 0.929 | 0.933 | — | 9.7 | 9.5 | — | — | — |
| Example 9 | (9) | PB15:3 | CB | — | 0.929 | 0.930 | — | 9.7 | 9.6 | — | 39 | — |
| Example 10 | (10) | PR254 | None | — | 0.925 | 0.933 | — | 10.2 | 9.5 | — | — | — |
| Example 11 | (11) | PR254 | CB | — | 0.925 | 0.930 | — | 10.2 | 9.6 | — | 41 | — |
| Example 12 | (12) | PO38 | None | — | 0.926 | 0.933 | — | 9.9 | 9.5 | — | — | — |
| Example 13 | (13) | PO38 | CB | — | 0.926 | 0.93 | — | 9.9 | 9.6 | — | 50 | — |

| | Difference in the respective color toner particles: Saturation difference | ΔE | $\lvert P_1 - P_2 \rvert$ (mm) | $\lvert W_1 - W_2 \rvert$ (mm) | Mixed toner: Fluidity (sec/50 g) | Evaluation: Recording medium 1 | Recording medium 2 | Recording medium 3 (FI value) |
|---|---|---|---|---|---|---|---|---|
| Example 1 | 25 | 147 | 1.3 | 0.6 | 24 | B | A | 9.7 |
| Example 2 | 40 | 168 | 1.0 | 0.5 | 24 | B | A | 9.7 |
| Example 3 | — | — | 0.3 | 1.6 | 18 | E | F | 9.0 |
| Example 4 | — | — | 2.7 | 2.4 | 36 | G | H | 10.0 |
| Example 5 | 15 | 126 | 1.1 | 0.6 | 21 | B | A | 10.5 |
| Example 6 | — | — | 0.2 | 1.6 | 18 | E | F | 9.5 |
| Example 7 | — | — | 2.5 | 2.5 | 36 | G | H | 9.7 |
| Example 8 | — | — | 0.6 | 1.6 | 19 | F | G | 9.6 |
| Example 9 | — | — | 2.8 | 2.7 | 36 | G | H | 10.7 |
| Example 10 | — | — | 0.6 | 1.5 | 18 | F | G | 9.7 |
| Example 11 | — | — | 2.3 | 2.6 | 36 | G | H | 9.7 |
| Example 12 | — | — | 0.9 | 1.8 | 18 | F | G | 9.3 |
| Example 13 | — | — | 2.3 | 2.2 | 38 | G | H | 9.8 |

TABLE 2

| | Mixed brilliant toner | Coloring agent: First brilliant toner | Coloring agent: Second brilliant toner | Coloring agent: Third brilliant toner | Average projected circularity: $R_1$ | $R_2$ | $R_3$ | Average projected circle equivalent diameter (μm): $D_1$ | $D_2$ | $D_3$ | Difference in the respective color toner particles: Brightness difference | Hue difference (°) |
|---|---|---|---|---|---|---|---|---|---|---|---|---|
| Example 14 | (14) | PG36 | None | — | 0.926 | 0.933 | — | 10.1 | 9.5 | — | — | — |
| Example 15 | (15) | PG36 | CB | — | 0.926 | 0.93 | — | 10.1 | 9.6 | — | 52 | — |
| Example 16 | (16) | PB7 | None | — | 0.929 | 0.933 | — | 10.0 | 9.5 | — | — | — |
| Example 17 | (17) | PB7 | CB | — | 0.929 | 0.93 | — | 10.0 | 9.6 | — | 46 | — |
| Example 18 | (18) | PB15:6 | None | — | 0.928 | 0.933 | — | 9.9 | 9.5 | — | — | — |
| Example 19 | (19) | PB15:6 | CB | — | 0.928 | 0.93 | — | 9.9 | 9.6 | — | 17 | — |
| Example 20 | (20) | PV23 | None | — | 0.925 | 0.933 | — | 10.2 | 9.5 | — | — | — |
| Example 21 | (21) | PV23 | CB | — | 0.925 | 0.93 | — | 10.2 | 9.6 | — | 16 | — |
| Example 22 | (22) | PR254 | PB15:3 | — | 0.925 | 0.93 | — | 10.2 | 9.7 | — | 2 | 158 |
| Example 23 | (23) | PO38 | PB15:3 | — | 0.926 | 0.929 | — | 10.1 | 9.7 | — | 11 | 175 |
| Example 24 | (24) | PG36 | PR122 | — | 0.926 | 0.928 | — | 10.1 | 9.8 | — | 15 | 162 |
| Example 25 | (25) | PB7 | PR122 | — | 0.929 | 0.928 | — | 10.0 | 9.8 | — | 9 | 178 |

| | Difference in the respective color toner particles: Saturation difference | ΔE | $\lvert P_1 - P_2 \rvert$ (mm) | $\lvert W_1 - W_2 \rvert$ (mm) | Mixed toner: Fluidity (sec/50 g) | Evaluation: Recording medium 1 | Recording medium 2 | Recording medium 3 (FI value) |
|---|---|---|---|---|---|---|---|---|
| Example 14 | — | — | 0.5 | 1.3 | 17 | F | G | 9.7 |
| Example 15 | — | — | 2.6 | 2.6 | 39 | G | H | 10.5 |
| Example 16 | — | — | 0.3 | 1.2 | 19 | F | G | 9.5 |
| Example 17 | — | — | 2.8 | 2.9 | 36 | G | H | 10.7 |
| Example 18 | — | — | 0.6 | 1.8 | 17 | F | G | 9.6 |
| Example 19 | — | — | 2.2 | 2.1 | 36 | G | H | 10.6 |
| Example 20 | — | — | 0.2 | 1.4 | 32 | E | G | 9.3 |
| Example 21 | — | — | 2.1 | 2.5 | 38 | G | H | 9.5 |
| Example 22 | 30 | 161 | 1.2 | 1.7 | 26 | B | C | 9.7 |
| Example 23 | 42 | 174 | 1.5 | 1.6 | 24 | B | C | 9.6 |
| Example 24 | 1 | 161 | 1.4 | 1.2 | 25 | B | C | 9.7 |
| Example 25 | 0 | 158 | 1.2 | 1.3 | 21 | B | C | 9.6 |

TABLE 3

| | Mixed brilliant toner | Coloring agent: First brilliant toner | Coloring agent: Second brilliant toner | Coloring agent: Third brilliant toner | Average projected circularity: $R_1$ | $R_2$ | $R_3$ | Average projected circle equivalent diameter (μm): $D_1$ | $D_2$ | $D_3$ | Difference in the respective color toner particles: Brightness difference | Hue difference (°) |
|---|---|---|---|---|---|---|---|---|---|---|---|---|
| Example 26 | (26) | PB15:6 | PY74 | — | 0.928 | 0.927 | — | 9.9 | 10.0 | — | 63 | 180 |
| Example 27 | (27) | PR254 | PG36 | — | 0.925 | 0.93 | — | 10.2 | 10.1 | — | 11 | 124 |
| Example 28 | (28) | PR254 | PB7 | — | 0.925 | 0.929 | — | 10.2 | 9.8 | — | 5 | 144 |
| Example 29 | (29) | PR254 | PB15:6 | — | 0.925 | 0.928 | — | 10.2 | 9.9 | — | 24 | 116 |
| Example 30 | (30) | PO38 | PG36 | — | 0.926 | 0.93 | — | 10.1 | 10.1 | — | 2 | 107 |
| Example 31 | (31) | PO38 | PB7 | — | 0.926 | 0.929 | — | 10.1 | 9.8 | — | 4 | 127 |
| Example 32 | (32) | PO38 | PB15:6 | — | 0.926 | 0.928 | — | 10.1 | 9.9 | — | 33 | 133 |
| Example 33 | (33) | PG36 | PB15:6 | — | 0.93 | 0.928 | — | 10.1 | 9.9 | — | 35 | 120 |
| Example 34 | (34) | PG36 | PV23 | — | 0.93 | 0.925 | — | 10.1 | 10.2 | — | 36 | 150 |
| Example 35 | (35) | PB7 | PV23 | — | 0.929 | 0.925 | — | 9.8 | 10.2 | — | 30 | 130 |
| Example 36 | (36) | PV23 | PY74 | — | 0.925 | 0.927 | — | 10.2 | 10.0 | — | 64 | 150 |
| Example 37 | (37) | PR254 | PY74 | — | 0.925 | 0.927 | — | 10.2 | 10.0 | — | 39 | 64 |
| Example 38 | (38) | PR254 | PV23 | — | 0.925 | 0.925 | — | 10.2 | 10.2 | — | 25 | 86 |

TABLE 3-continued

| | Difference in the respective color toner particles | | | | Mixed toner | Evaluation | | |
|---|---|---|---|---|---|---|---|---|
| | Saturation difference | ΔE | $\lvert P_1 - P_2 \rvert$ (mm) | $\lvert W_1 - W_2 \rvert$ (mm) | Fluidity (sec/50 g) | Recording medium 1 | Recording medium 2 | Recording medium 3 (FI value) |
| Example 26 | 30 | 19 | 1.8 | 1.7 | 22 | B | C | 9.4 |
| Example 27 | 14 | 15 | 1.1 | 1.2 | 24 | B | C | 9.3 |
| Example 28 | 15 | 16 | 1.4 | 1.4 | 24 | B | C | 9.5 |
| Example 29 | 20 | 15 | 1.7 | 1.7 | 25 | B | C | 9.5 |
| Example 30 | 26 | 15 | 1.8 | 1.6 | 24 | B | C | 9.5 |
| Example 31 | 27 | 16 | 1.2 | 1.2 | 23 | B | C | 9.4 |
| Example 32 | 32 | 17 | 1.8 | 1.6 | 24 | B | C | 9.4 |
| Example 33 | 6 | 14 | 1.8 | 1.7 | 24 | B | C | 9.5 |
| Example 34 | 6 | 16 | 1.1 | 1.3 | 27 | B | C | 9.4 |
| Example 35 | 1 | 14 | 1.1 | 1.1 | 25 | B | C | 9.5 |
| Example 36 | 24 | 18 | 1.1 | 1.1 | 26 | B | C | 9.4 |
| Example 37 | 10 | 10 | 1.2 | 1.3 | 26 | B | B | 9.4 |
| Example 38 | 14 | 12 | 1.3 | 0.13 | 25 | B | B | 9.2 |

20

TABLE 4

| | Mixed brilliant toner | Coloring agent: First brilliant toner | Second brilliant toner | Third brilliant toner | Average projected circularity | | | Average projected circle equivalent diameter (μm) | | | Difference in the respective color toner particles: Brightness difference | Hue difference (°) |
|---|---|---|---|---|---|---|---|---|---|---|---|---|
| | | | | | $R_1$ | $R_2$ | $R_3$ | $D_1$ | $D_2$ | $D_3$ | | |
| Example 39 | (39) | PO38 | PV23 | — | 0.926 | 0.925 | — | 10.1 | 10.2 | — | 34 | 103 |
| Example 40 | (40) | PG36 | PB15:3 | — | 0.93 | 0.929 | — | 10.1 | 9.7 | — | 13 | 78 |
| Example 41 | (41) | PB7 | PY74 | — | 0.929 | 0.927 | — | 9.8 | 10.0 | — | 34 | 80 |
| Example 42 | (42) | PB7 | PB15:6 | — | 0.929 | 0.928 | — | 9.8 | 9.9 | — | 29 | 100 |
| Example 43 | (43) | PV23 | PB15:3 | — | 0.925 | 0.929 | — | 10.2 | 9.7 | — | 23 | 72 |
| Example 44 | (44) | PB15:6 | PR122 | — | 0.928 | 0.928 | — | 9.9 | 9.8 | — | 20 | 78 |
| Example 45 | (45) | PR254 | PO38 | — | 0.925 | 0.926 | — | 10.2 | 10.1 | — | 9 | 17 |
| Example 46 | (46) | PR254 | PR122 | — | 0.925 | 0.928 | — | 10.2 | 9.9 | — | 4 | 38 |
| Example 47 | (47) | PO38 | PR122 | — | 0.926 | 0.928 | — | 10.1 | 9.9 | — | 13 | 55 |
| Example 48 | (48) | PO38 | PY74 | — | 0.926 | 0.927 | — | 10.1 | 10.0 | — | 30 | 47 |
| Example 49 | (49) | PG36 | PY74 | — | 0.93 | 0.927 | — | 10.1 | 10.1 | — | 28 | 60 |
| Example 50 | (50) | PG36 | PB7 | — | 0.93 | 0.929 | — | 10.1 | 9.8 | — | 6 | 20 |

| | Difference in the respective color toner particles | | | | Mixed toner | Evaluation | | |
|---|---|---|---|---|---|---|---|---|
| | Saturation difference | ΔE | $\lvert P_1 - P_2 \rvert$ (mm) | $\lvert W_1 - W_2 \rvert$ (mm) | Fluidity (sec/50 g) | Recording medium 1 | Recording medium 2 | Recording medium 3 (FI value) |
| Example 39 | 26 | 152 | 1.6 | 1.6 | 25 | B | B | 9.3 |
| Example 40 | 16 | 93 | 1.4 | 1.2 | 21 | B | B | 9.5 |
| Example 41 | 25 | 131 | 1.3 | 1.1 | 21 | B | B | 9.5 |
| Example 42 | 5 | 122 | 1.7 | 1.6 | 24 | B | B | 10.1 |
| Example 43 | 70 | 70 | 1.1 | 1.5 | 22 | B | B | 9.7 |
| Example 44 | 97 | 97 | 1.1 | 1.6 | 23 | B | B | 10.2 |
| Example 45 | 12 | 30 | 1.1 | 1.7 | 25 | B | B | 10.3 |
| Example 46 | 15 | 65 | 1.2 | 1.4 | 25 | B | B | 9.7 |
| Example 47 | 27 | 93 | 1.3 | 1.1 | 22 | B | B | 9.2 |
| Example 48 | 2 | 81 | 1.6 | 1.3 | 22 | B | B | 9.2 |
| Example 49 | 24 | 109 | 1.4 | 1.1 | 21 | B | B | 9.4 |
| Example 50 | 28 | 28 | 0.7 | 0.5 | 20 | A | A | 9.5 |

TABLE 5

| | Mixed brilliant toner | Coloring agent: First brilliant toner | Coloring agent: Second brilliant toner | Coloring agent: Third brilliant toner | Average projected circularity $R_1$ | $R_2$ | $R_3$ | Average projected circle equivalent diameter (μm) $D_1$ | $D_2$ | $D_3$ | Difference in the respective color toner particles: Brightness difference | Hue difference (°) |
|---|---|---|---|---|---|---|---|---|---|---|---|---|
| Example 51 | (51) | PB7 | PB15:3 | — | 0.93 | 0.929 | — | 10.1 | 9.7 | — | 7 | 58 |
| Example 52 | (52) | PB15:6 | PB15:3 | — | 0.928 | 0.929 | — | 9.9 | 9.7 | — | 22 | 42 |
| Example 53 | (53) | PB15:6 | PV23 | — | 0.928 | 0.925 | — | 9.9 | 10.2 | — | 1 | 30 |
| Example 54 | (54) | PV23 | PR122 | — | 0.925 | 0.928 | — | 10.2 | 9.8 | — | 21 | 48 |
| Example 55 | (55) | PR122 | W | — | 0.928 | 0.927 | — | 10.2 | 10.0 | — | 46 | — |
| Example 56 | (56) | PB15:6 | W | — | 0.928 | 0.927 | — | 9.9 | 10.0 | — | 66 | — |
| Example 57 | (57) | CB | W | — | 0.925 | 0.927 | — | 10.2 | 10.0 | — | 81 | — |
| Example 58 | (58) | PY74 | PO38 | PR254 | 0.927 | 0.926 | 0.925 | 10.0 | 9.9 | 10.2 | 39 | 64 |
| Example 59 | (59) | PB15:6 | PY74 | — | 0.909 | 0.912 | — | 10.0 | 9.9 | — | 63 | 180 |
| Example 60 | (60) | PB15:6 | PY74 | — | 0.911 | 0.908 | — | 10.0 | 9.9 | — | 63 | 180 |
| Example 61 | (61) | PY74 | PB15:6 | — | 0.877 | 0.878 | — | 10.0 | 9.9 | — | 63 | 180 |

| | Difference in the respective color toner particles: Saturation difference | ΔE | $\lvert P_1 - P_2 \rvert$ (mm) | $\lvert W_1 - W_2 \rvert$ (mm) | Mixed toner: Fluidity (sec/50 g) | Evaluation: Recording medium 1 | Recording medium 2 | Recording medium 3 (FI value) |
|---|---|---|---|---|---|---|---|---|
| Example 51 | 15 | 70 | 0.6 | 0.8 | 20 | A | A | 9.9 |
| Example 52 | 10 | 58 | 0.8 | 0.7 | 20 | A | A | 10.5 |
| Example 53 | 6 | 40 | 1.3 | 1.1 | 24 | B | B | 9.4 |
| Example 54 | 1 | 66 | 1.2 | 1.2 | 22 | B | B | 9.2 |
| Example 55 | — | — | 2.4 | 2.4 | 37 | G | H | 9.1 |
| Example 56 | — | — | 2.5 | 2.7 | 38 | G | H | 9.0 |
| Example 57 | — | — | 2.6 | 2.9 | 42 | H | H | 9.3 |
| Example 58 | 12 | 104 | 1.7 | 1.7 | 23 | B | B | 9.3 |
| Example 59 | 30 | 191 | 2.6 | 2.5 | 29 | F | F | 9.8 |
| Example 60 | 30 | 191 | 3.2 | 3.5 | 26 | F | F | 9.5 |
| Example 61 | 30 | 191 | 3.7 | 4.1 | 26 | G | H | 9.5 |

TABLE 6

| | Mixed brilliant toner set | Coloring agent: First brilliant toner | Coloring agent: Second brilliant toner | Difference in the respective brilliant toner: Brightness difference | Hue difference (°) | Saturation difference | ΔE | Evaluation: Recording medium 3 (FI value) |
|---|---|---|---|---|---|---|---|---|
| Comparative Example 1 | (C1) | PY74 | PR122 | 43 | 102 | 25 | 147 | 7.0 |

From the above results, it is found that in this examples, as compared with comparative examples, a brilliant image with high brilliance may be obtained.

In addition, it is found that in Example 26, as compared with Examples 59 to 61, the generation of the areas having partially different colors is prevented.

Hereinafter, Embodiment A will be more specifically described with reference to examples and comparative examples; however, Embodiment A is not limited to any of these examples. In addition, "parts" and "%" are on a weight basis unless otherwise specified.

<Preparation of Mixed Toners (1) to (57)>

[Preparation of First Toner Particle (1)]

(Preparation of Polyester Resin Particle Dispersion (1))

Terephthalic acid: 30 parts by mol

Fumaric acid: 70 parts by mol

Bisphenol A ethylene oxide adduct: 10 parts by mol

Bisphenol A propylene oxide adduct: 90 parts by mol

The above-described materials are put into a flask which has five liters of content, and is equipped with a stirrer, a nitrogen inlet pipe, a temperature sensor, and a rectification column, the temperature of the flask is raised up to 220° C. over one hour, and then 1 part of titanium tetraethoxide is added to 100 parts of the above materials. While distilling off water to be generated, the temperature is raised up to 230° C. for 0.5 hours, dehydration condensation reaction is continued for one hour at the aforementioned temperature, and then the resultant is cooled. In this way, a polyester resin (1) having a weight average molecular weight of 20,000, an acid value of 13 mgKOH/g, and a glass transition temperature of 60° C. is synthesized.

Subsequently, 40 parts of ethyl acetate and 25 parts of 2-butanol are put into a container provided with a temperature control unit and a nitrogen replacement unit to prepare a mixed solvent, then 100 parts of polyester resin (1) is slowly put into the container and dissolved, and 10% by weight of ammonia aqueous solution (equivalent to three times the molar ratio with respect to the acid value of the resin) is put into the container and stirred for 30 minutes.

Subsequently, the inside of the container is replaced with dry nitrogen, and 400 parts of ion exchange water is added dropwise at a rate of 2 parts per minute while maintaining the temperature at 40° C. and stirring the mixed solution, to thereby perform emulsification. After completing the dropwise addition, the emulsion is returned to room temperature (20° C. to 25° C.) and bubbling with dry nitrogen is performed for 48 hours with stirring, and thus ethyl acetate and 2-butanol are reduced to equal to or less than 1,000 ppm, thereby obtaining a resin particle dispersion in which a resin particle having a volume average particle diameter 200 nm is dispersed. The ion exchange water is added to the resin particle dispersion so as to adjust the solid content to 20% by weight, thereby obtaining a polyester resin particle dispersion (1).

(Preparation of Polyester Resin Particle Dispersion (2))

1,10-dodecanedioic acid: 50 parts by mol 1,9-nonanediol: 50 parts by mol

The monomer components are put into a reaction container equipped with a stirrer, a thermometer, a condenser, and a nitrogen gas inlet tube, the inside of the reaction container is substituted with dry nitrogen gas, and 0.25 parts of titanium tetrabutoxide (reagent) is added to 100 parts of the monomer components. After reaction is performed at 170° C. for 3 hours with stirring under nitrogen gas flow, the temperature is further raised to 210° C. over one hour, the inside of the reaction container is depressurized to 3 kPa, and reaction is performed for 13 hours with stirring under reduced pressure, thereby obtaining a polyester resin (2).

The obtained polyester resin (2) has a melting temperature by DSC of 73.6° C., a weight average molecular weight Mw by GPC of 25,000, a number average molecular weight Mn of 10,500, and an acid value AV of 10.1 mg KOH/g.

Next, 300 parts of the polyester resin (2), 160 parts of methyl ethyl ketone (solvent), and 100 parts of isopropyl alcohol (solvent) are added to a 3-liter reaction container (Jacketed BJ-30N manufactured by Tokyo Rikakikai Co., Ltd.) equipped with a condenser, a thermometer, a water dropping device, and the resin is dissolved in a water circulation type thermostatic chamber while stirring and mixing at 100 rpm while maintaining the temperature at 70° C. (dissolving liquid preparing step).

17 parts of 10% by weight ammonia aqueous solution (reagent) is added thereto over 10 minutes under the conditions of the stirring rotation speed which is set to be 150 rpm and the temperature of the water circulation type thermostatic chamber which is set at 66° C., and then a total of 900 parts of ion exchanged water maintained at 66° C. is added dropwise at a rate of 7 parts/minute to cause phase inversion, thereby obtaining an emulsion liquid.

Immediately thereafter, 800 parts of the obtained emulsion and 700 parts of ion exchanged water are put into a 2 liter eggplant flask, and an evaporator (manufactured by Tokyo Rikakikai Co., Ltd.) equipped with a vacuum control unit via a trap ball is set. While rotating the eggplant flask, the temperature is heated with a hot water bath at 60° C., and the solvent is removed by reducing the pressure to 7 kPa while paying attention to bumping. When a solvent collection amount reached 1,100 parts, the pressure is returned to atmospheric pressure, and an eggplant flask is cooled with water, thereby obtaining a dispersion. There is no solvent odor in the resulting dispersion. The volume average particle diameter D50v of the resin particles in this dispersion is 130 nm. After that, the solid content concentration is adjusted to 20% by weight by adding the ion exchanged water, and the resultant is set as a polyester resin particle dispersion (2).

(Preparation of Coloring Agent Particle Dispersion (1))

Yellow pigment C.I. Pigment Yellow 74 (Hansa Yellow 5GX01, manufactured by Clariant): 70 parts Anionic surfactant (NEOGEN RK, manufactured by DKS Co. Ltd.): 30 parts Ion exchanged water: 200 parts The above materials are mixed and dispersed for 10 minutes by a homogenizer (ULTRA TURRAX T50, manufactured by IKA). Ion exchanged water is added such that the solid content in the dispersion is 20% by weight, thereby obtaining a coloring agent particle dispersion (1) in which coloring agent particles having a volume average particle diameter of 140 nm are dispersed.

(Preparation of Release Agent Particle Dispersion (1))

Paraffin wax (HNP-9, manufactured by Nippon Seiro Co., Ltd.): 100 parts

Anionic surfactant (NEOGEN RK, manufactured by DKS Co. Ltd.): 1 part

Ion exchanged water: 350 parts

The above-described materials are mixed with each other, the mixture is heated at 100° C., is dispersed by a homogenizer (ULTRA-TURRAX T50, manufactured by IKA Ltd.), and then is subjected to a dispersing treatment by Manton-Gaulin high pressure homogenizer (manufactured by Manton Gaulin Mfg Company Inc), thereby obtaining a release agent particle dispersion (1) (solid content 20% by weight) in which a release agent particle having a volume average particle diameter of 200 nm is dispersed.

(Preparation of Toner Particle)

Polyester resin particle dispersion (1): 425 parts

Polyester resin particle dispersion (2): 32 parts

Coloring agent dispersion (1): 20 parts

Release agent dispersion (1): 50 parts

Anionic surfactant (TAYCAPOWER manufactured by TAYCA): 30 parts

The above-described materials are put into a round stainless steel flask, 0.1 N of sulfuric acid is added to the flask to thereby adjust the pH to 3.5, and then 30 parts of a nitric acid aqueous solution having a polyaluminum chloride concentration of 10% by weight is added. Then, the mixture is dispersed at 30° C. by a homogenizer (ULTRA-TURRAX T50, manufactured by IKA Ltd.), then heated at 45° C. in the oil bath for heating, and kept for 30 minutes. After that, 100 parts of the polyester resin particle dispersion (1) is slowly added and kept for one hour, the pH is adjusted to be 8.6 by adding 0.1 N sodium hydroxide, the resultant is heated up to 100° C. while continuously stirring, kept for nine hours, cooled up to 25° C., filtrated, washed with ion exchange water, and then dried, thereby obtaining a core-shell particle (1) having the volume average particle diameter of 5.8 μm.

On the other hands, a resin particle (1) having a volume average particle diameter of 200 nm is obtained by filtering, washing, and drying the polyester resin particle dispersion (1). Specifically, 500 parts of polyester resin dispersion (1) is put into a dialysis tube (SPECTRUM standard RC dialysis tube Sepctra/Pro 5, fraction molecular weight of 12,000 to 14,000 daltons, plane width of 140 mm), the container is filled with ion exchanged water, 50,000 parts of ion exchanged water is appropriately exchanged, and cleaning is repeated until the polyester resin dispersion (1) has an electric conductivity of 5 S/m or less.

Further, the washed resin particles are dried by spraying and drying (that is, spray-dry) by Twin Jetter NL-5 (inlet temperature of 200° C., outlet temperature of 50° C., pressure of 0.2 MPa, feed rate of 8.5 kg/h), thereby obtaining a resin particle (1). Incidentally, an acceptance balance after drying is 0.4% of moisture content.

500 parts of the obtained core-shell particle (1) and 53 parts of the resin particle (1) are stirred at 2,000 rpm for 10 minutes by Nobilta NOB-300 (manufactured by Hosokawa Micron Corp.) while maintaining the inside temperature of the apparatus at 65° C., thereby obtaining a toner particle (1) having a volume average particle diameter of 6.0 μm. The ratio of the coating resin to the entire toner particle (1) is 10.6% by weight.

[Preparation of Second Toner Particle (1)]

A second toner particle (1) is obtained in the same manner as in the preparation of the first toner particle (1) except that 70 parts of a magenta pigment C.I. Pigment Red 122 (FASTOGEN Super Magenta RE-05, manufactured by DIC Corporation) is used instead of the yellow pigment in the preparation of the coloring agent particle dispersion.

[Preparation of First Toner Particles (2) to (57) and Second Toner Particles (2) to (57)]

First toner particles (2) to (57) and second toner particles (2) to (57) are obtained in the same manner as in the preparation of the first toner particle (1) except that the kinds of the coloring agents used in the preparation of the coloring agent dispersion are set as indicated in Tables 7 to 9, and the addition amount of the coloring agent dispersion in the preparation of the toner particle is set as follows in accordance with the kinds of the coloring agents to be used.

The notations in Tables 7 to 9 are as follows.

PY74: Yellow pigment C.I. Pigment Yellow 74 (Hansa Yellow 5GX01 manufactured by Clariant)

PB15:3: Cyan Pigment C.I. Pigment Blue 15:3 (ECB-301, manufactured by Dainichiseika Color & Chemicals Mfg. Co., Ltd.)

PR122: Magenta Pigment C.I. Pigment Red 122 (FASTOGEN Super Red RE-05, manufactured by DIC Corporation)

PR254: Red Pigment C.I. Pigment Red 254 (FASTOGEN Super Red 226-5254, manufactured by DIC Corporation)

PO38: Orange Pigment C.I. Pigment Orange 38 (Novoperm Red HFG, manufactured by Clariant)

PG36: Yellow Green Pigment C.I. Pigment Green 36 (FASTOGEN Green 2YK, manufactured by DIC Corporation)

PB7: Green Pigment C.I. Pigment Blue 7 (FASTOGEN Green S, manufactured by DIC Corporation)

PB15: 6: Blue Pigment C.I. Pigment Blue 15:6 (FASTOGEN Blue AE-8, manufactured by DIC Corporation)

PV23: Violet Pigment C.I. Pigment Violet 23 (FASTOGEN Violet RNS, manufactured by DIC Corporation)

CB: Black Pigment Carbon Black (Model No.: Nipex 35, manufactured by Evonik Industries AG)

W: White Pigment titanium oxide (Model No.: JR-301, manufactured by TAYCA)

Note that, the relation between the kinds of the coloring agent to be used and the addition amount of the coloring agent dispersion in preparing the toner particles is as follows.

Yellow Pigment: 20 parts
Cyan Pigment: 10 parts
Magenta Pigment: 20 parts
Red Pigment: 20 parts
Orange Pigment: 30 parts
Yellow Green Pigment: 30 parts
Green Pigment: 20 parts
Blue Pigment: 30 parts
Violet Pigment: 10 parts
Black Pigment: 10 parts
White Pigment: 100 parts

[Preparation of Mixed Toner]

First, 50 parts of first toner particle and 50 parts of second toner particle used for preparation of each mixed toner are previously mixed in a Henschel mixer at a peripheral speed of 25 m/s for three minutes, and with respect to the obtained mixed toner particles, a difference between the maximum peak position in the charge distribution of the first toner particle and the maximum peak position in the charge distribution of the second toner particle is confirmed according to a charge spectrograph method as described above.

At this stage, in a case where the difference between the maximum peak positions is 3 mm or more, the following operation is performed so as to obtain a first toner and a second toner. Specifically, a dimethyl silicone oil treated silica particle (RY 200 manufactured by Nippon Aerosil Co., Ltd.) is added to the toner particle having a relatively lower charge amount among the first toner particle and the second toner particle, and the mixture is put into a V blender and agitated for 20 minutes so as to obtain a toner to be used as a toner while silica particles are not added to the toner particle having a relatively higher charge amount. In addition, in a case where the difference between the maximum peak positions of the mixed toner particles is less than 3 mm, the first toner particle and the second toner particle are used as they are as the first toner and the second toner, respectively.

50 parts of the first toner, 50 parts of the second toner, and 5 parts of dimethyl silicone oil treated silica particle (RY 200 manufactured by Nippon Aerosil Co., Ltd.) are mixed in a Henschel mixer, thereby obtaining a mixed toner.

The difference in brightness value ("brightness difference" in Tables), the difference in hue angle ("hue difference (degree)" in Tables), the difference in saturation values ("saturation difference" in Tables), the difference in colors ΔE ("ΔE" in Tables), $|P_1-P_2|$, $|W_1-W_2|$, and the average thickness ("average thickness (m)" in Tables) of the coating layer in the mixed toner are measured, and the results are indicated in Tables 7 to 9.

<Preparation of Mixed Toner (58)>

[First Toner Particle (58) to Third Toner Particle (58)]

A first toner particle (58), a second toner particle (58), and a third toner particle (58) are obtained in the same manner as in the preparation of the first toner particle (1) except that the kinds of the coloring agents used in the preparation of the coloring agent dispersion are set as indicated in Table 3, and the addition amount of the coloring agent dispersion in the preparation of the toner particle is set as follows in accordance with the kinds of the coloring agents to be used.

[Preparation of Mixed Toner]

A first toner (58), a second toner (58), and a third toner (58) are obtained in the same manner as in the preparation of the first toner (1) and the second toner (2) except that a first toner particle (58), a second toner particle (58), and a third toner particle (58) are used instead of the first toner particle (1) and the second toner particle (2). Note that, the difference between the maximum peak positions means a "difference" in the combination with the largest difference among the first toner particle to the third toner particle.

40 parts of first toner (58), 40 parts of second toner (58), 20 parts of third toner (58), and 5 parts of dimethyl silicone oil treated silica particle (RY 200 manufactured by Nippon Aerosil Co., Ltd.) are mixed in a Henschel mixer, thereby obtaining a mixed toner (58).

The difference in brightness value ("brightness difference" in Tables), the difference in hue angle ("hue difference (degree)" in Tables), the difference in saturation values ("saturation difference" in Tables), the difference in colors ΔE ("ΔE" in Tables), $|P_1-P_2|$, $|W_1-W_2|$, and the average thickness ("average thickness (m)" in Tables) of the coating layer in the mixed toner (58) are measured, and the results are indicated in Table 3.

Note that, any one of the difference in brightness values, the difference in hue angles, difference in saturation values, color difference ΔE, $|P_1-P_2|$, and $|W_1-W_2|$ means "difference" in a combination which has the largest difference among the first toner particle to the third toner particle.

<Preparation of Mixed Toner (59)>

[Preparation of First Toner Particle (59) and Second Toner Particle (59)]

Each of first toner particle (59) and second toner particle (59) is obtained in the same manner as in the preparation of the first toner particle (32) and the second toner particle (32) except that the resin particles are not adhered by Nobilter and the core-shell particles are used as they are as the toner particles in the preparation of the first toner particle (32) and the second toner particle (32).

[Preparation of Mixed Toner]

A mixed toner (59) is obtained in the same manner as in the preparation of the mixed toner (1) except that the first toner particle (59) and the second toner particle (59) are used instead of the first toner particle (1) and the second toner particle (1).

The difference in brightness value ("brightness difference" in Tables), the difference in hue angle ("hue difference (degree)" in Tables), the difference in saturation values ("saturation difference" in Tables), the difference in colors ΔE ("ΔE" in Tables), $|P_1-P_2|$, $|W_1-W_2|$, and the average thickness ("average thickness (m)" in Tables) of the coating layer in the mixed toner (59) are measured, and the results are indicated in Table 3.

<Preparation of Mixed Toner (C1)>

[Preparation of First Toner Particle (C1) and Second Toner Particle (C1)]

Each of a first toner particle (C1) and a second toner particle (C2) is obtained in the same manner as in the preparation of the first toner particle (32) and the second toner particle (32) except that the step of slowly adding 100 parts of the polyester resin particle dispersion (1) and keeping it for one hour is not performed, the resin particles are not adhered by Nobilter, and the core particles are used as they are as the toner particles in the preparation of the first toner particle (32) and the second toner particle (32).

[Preparation of Mixed Toner]

50 parts of first toner particle (C1), 50 parts of second toner particle (C1), and 5 parts of dimethyl silicone oil treated silica particle (RY 200 manufactured by Nippon Aerosil Co., Ltd.) are mixed in a Henschel mixer, thereby obtaining a mixed toner (C1).

The difference in brightness value ("brightness difference" in Tables), the difference in hue angle ("hue difference (degree)" in Tables), the difference in saturation values ("saturation difference" in Tables), the difference in colors ΔE ("ΔE" in Tables), $|P_1-P_2|$, $|W_1-W_2|$, and the average thickness ("average thickness (m)" in Tables) of the coating layer in the mixed toner (C1) are measured, and the results are indicated in Table 3.

<Preparation of Mixed Toner (C2)>

[Preparation of First Toner Particle (C2)]

Polyester resin (1): 200 parts

Polyester resin (2): 200 parts

Orange Pigment C.I. Pigment 38 (product name: Novoperm Red HFG, manufactured by Clariant): 79 parts Paraffin wax (HNP-9, manufactured by Nippon Seiro Co., Ltd.): 47 parts Charge control agent (BONTRON P-51 manufactured by Orient Chemical Industries Ltd.): 25 parts The above components are premixed by a 75 L Henschel mixer, and regarding 70% by weight of the entirety of the above components, a first kneading step is performed under the conditions of a kneading temperature of 180° C., the number of revolutions of 300 rpm, and the kneading rate of 100 kg/h, by a twin screw continuous kneader (extruder, manufactured by Kurimoto Kogyo Co., Ltd.) having a screw configuration. Thereafter, a second kneading step is performed on the kneaded material in the first kneading step and the remainder of the material (that is, 30% by weight of the entirety of the above components) under the conditions of a kneading temperature of 120° C., a rotational speed of 150 rpm, and a kneading rate of 300 kg/h, thereby obtaining a kneaded material.

The obtained kneaded material in the second kneading step is pulverized by 400AFG-CR pulverizer (manufactured by Hosokawa Micron Corporation), and then fine powers and coarse powders are removed by an air elbow jet classifier (manufactured by MATSUBO Corporation), thereby obtaining a first toner particle (C2).

[Preparation of Second Toner Particle (C2)]

A second toner particle (C2) is obtained in the same manner as in the preparation of the first toner particle (C2) except that 79 parts of Blue Pigment C.I. Pigment 15:6 (product name: FASTOGEN Blue AE-8, manufactured by DIC Corporation) instead of Orange Pigment C.I. Pigment 38 (product: Novoperm Red HFG, manufactured by Clariant).

[Preparation of Mixed Toner]

50 parts of the first toner particle (C2), 50 parts of the second toner particle (C2), and 5 parts of dimethyl silicone oil treated silica particle (RY 200 manufactured by Nippon Aerosil Co., Ltd.) are mixed in a Henschel mixer, thereby obtaining a mixed toner (C2).

The difference in brightness value ("brightness difference" in Tables), the difference in hue angle ("hue difference (degree)" in Tables), the difference in saturation values ("saturation difference" in Tables), the difference in colors ΔE ("ΔE" in Tables), $|P_1-P_2|$, $|W_1-W_2|$, and the average thickness ("average thickness (m)" in Tables) of the coating layer in the mixed toner (C2) are measured, and the results are indicated in Table 3.

<Preparation of Developers (1) to (59), (C1), and (C2)>

[Preparation of Carrier]

Ferrite particle (average particle diameter: 50 μm): 100 parts

Toluene: 14 parts

Styrene/methyl methacrylate copolymer (copolymerization ratio: 15/85): 3 parts

Carbon black: 0.2 parts

The above components other than the ferrite particles are dispersed with a sand mill so as to prepare a dispersion, and this dispersion, as well as the ferrite particles, is put into a vacuum degassing type kneader, followed by drying under reduced pressure while stirring, thereby obtaining a carrier.

[Preparation of Developer]

8 parts of mixed toner and 100 parts of carrier are put into a V blender and stirred for 20 minutes, thereby obtaining a developer.

<Evaluation>

The following evaluation for the obtained developer is carried out. The results are indicated in Tables 7 to 9.

Specifically, APEOSPORT IV C4470 (manufactured by Fuji Xerox Co., Ltd.) is prepared as an image forming apparatus of forming an image for evaluation, the developer is put into a developer unit, and a replenished toner (the same mixed toner as the mixed toner contained in the developer) is put into a toner cartridge. Subsequently, 100 sheets of solid images of 5 cm×5 cm with 100% of image area ratio (5.0 g/m$^2$) are formed on the following recording medium 1 at room temperature (25° C.) at a process speed of 445 mm/sec by an image forming apparatus, and then 100 sheets of fine line images of 0.5 mm in thickness and 50 mm in length are formed on the following recording medium 2 (combination of lateral direction and longitudinal direction with respect to output direction).

Recording medium 1: Embossed paper (product name: LE SAC 66 white (Continuity: 46 Edition 175 kg) manufactured by Takeo Paper Trading Co., Ltd)

Recording medium 2: Resin film (product name: OZK-T 100 μm, manufactured by DYNIC CORPORATION)

With respect to the images formed on the first, 50th, and 100th sheets of the recording medium 1, whether or not regions (color unevenness) partially different in color tone are generated in a recessed region of the recording medium 1 is visually observed. The evaluation results are as follows.

A: Color unevenness is not felt on the 100th sheet.

B: Color unevenness is not felt on the 50th sheet, and color unevenness is slightly felt on the 100th sheet.

C: Color unevenness is not felt on the 50th sheet, and color unevenness is felt on the 100th sheet, but it does not matter.

D: Color unevenness is not felt on the first sheet, and color unevenness is slightly felt on the 50th sheet.

E: Color unevenness is not felt on the first sheet, and color unevenness is felt on the 50th sheet, but it does not matter.

F: Color unevenness is slightly felt on the first sheet.

Note that, A to E are acceptable.

With respect to the images formed on the first, 50th, and 100th sheets of the recording medium 2, whether or not regions partially different in color tone are generated at the end portion in the thickness direction of the thin line image is observed with eye and a magnifying glass (magnification: 50 times). The evaluation results are as follows.

A: Even when the 100th sheet is observed with a magnifying glass, areas having different color tone are not confirmed.

B: Even when the 50th sheet is observed with a magnifying glass, areas having different color tone are not confirmed. In addition, even when the 100th sheet is observed with eyes, areas having different color tone are not confirmed, and areas having different color tone are slightly confirmed when being observed with a magnifying glass.

C: Even when the 50th sheet is observed with a magnifying glass, areas having different color tone are not confirmed. In addition, even when the 100th sheet is observed with eyes, areas having different color tone are slightly confirmed.

D: Even when the first sheet is observed with a magnifying glass, areas having different color tone are not confirmed. In addition, even when the 50th sheet is observed with eyes, areas having different color tone are not confirmed, and areas having different color tone are slightly confirmed when being observed with a magnifying glass. Note that, a difference between the 100th sheet and the 50th sheet is not confirmed.

E: Even when the first sheet is observed with a magnifying glass, areas having different color tone are not confirmed. In addition, even when the 50th sheet is observed with eyes, areas having different color tone are not confirmed, and areas having different color tone are slightly confirmed when being observed with a magnifying glass. Note that, areas having slightly different color tone are confirmed with eyes on the 100th sheet.

F: Even when the first sheet is observed with a magnifying glass, areas having different color tone are not confirmed. In addition, even when the 50th sheet is observed with eyes, areas having different color tone are slightly confirmed.

G: Even when the first sheet is observed with eyes, areas having different color tone are not confirmed, and areas having different color tone are slightly confirmed when being observed with a magnifying glass. Note that, areas having different color tone are slightly confirmed with eyes on the 50th sheet and the 100th sheet.

H: Even when the first sheet is observed with eyes, areas having different color tone are slightly confirmed. Note that, areas having different color tone are confirmed with eyes on the 50th sheet and the 100th sheet, but are at an acceptable level.

I: Even when the first sheet is observed with eyes, areas having different color tone are slightly confirmed. Note that, the areas having different color tone are confirmed with eyes on the 50th sheet are at the acceptable level; however, the areas having different color tone are confirmed on the 100th sheet to exceed at the acceptable level.

J: Even when the first sheet is observed with eyes, areas having different color tone are slightly confirmed, which exceeds acceptable level. Note that, A to I are acceptable.

TABLE 7

| | | Coloring agent | | | Difference in the respective color toner particles | | | | | | Coating layer | Evaluation | |
|---|---|---|---|---|---|---|---|---|---|---|---|---|---|
| | Mixed toner | First toner | Second toner | Third toner | Brightness difference | Hue difference (degree) | Saturation difference | ΔE | $\lvert P_1 - P_2 \rvert$ (mm) | $\lvert W_1 - W_2 \rvert$ (mm) | Average thickness (μm) | Recording medium 1 | Recording medium 2 |
| Example 1A | (1) | PY74 | PR122 | — | 43 | 102 | 25 | 147 | 1.4 | 0.9 | 0.15 | C | B |
| Example 2A | (2) | PY74 | PB15:3 | — | 40 | 138 | 40 | 168 | 1.1 | 0.8 | 0.14 | C | C |
| Example 3A | (3) | PY74 | None | — | — | — | — | — | 0.5 | 1.7 | 0.16 | B | E |
| Example 4A | (4) | PY74 | CB | — | 90 | — | — | — | 2.8 | 2.5 | 0.13 | E | H |
| Example 5A | (5) | PR122 | PB15:3 | — | 2 | 120 | 15 | 126 | 1.2 | 0.7 | 0.15 | C | H |
| Example 6A | (6) | PR122 | None | — | — | — | — | — | 0.4 | 1.8 | 0.14 | B | E |
| Example 7A | (7) | PR122 | CB | — | 37 | — | — | — | 2.7 | 2.7 | 0.16 | E | H |
| Example 8A | (8) | PB15:3 | None | — | — | — | — | — | 0.6 | 1.6 | 0.15 | B | E |
| Example 9A | (9) | PB15:3 | CB | — | 39 | — | — | — | 2.9 | 2.8 | 0.15 | E | H |
| Example 10A | (10) | PR254 | None | — | — | — | — | — | 0.7 | 1.7 | 0.13 | B | E |
| Example 11A | (11) | PR254 | CB | — | 41 | — | — | — | 2.5 | 2.6 | 0.15 | E | H |
| Example 12A | (12) | PO38 | None | — | — | — | — | — | 0.9 | 1.9 | 0.15 | B | E |
| Example 13A | (13) | PO38 | CB | — | 50 | — | — | — | 2.4 | 2.3 | 0.16 | E | H |

TABLE 7-continued

| | | Coloring agent | | | Difference in the respective color toner particles | | | | | | Coating layer | Evaluation | |
|---|---|---|---|---|---|---|---|---|---|---|---|---|---|
| | Mixed toner | First toner | Second toner | Third toner | Brightness difference | Hue difference (degree) | Saturation difference | ΔE | $\lvert P_1 - P_2 \rvert$ (mm) | $\lvert W_1 - W_2 \rvert$ (mm) | Average thickness (μm) | Recording medium 1 | Recording medium 2 |
| Example 14A | (14) | PG36 | None | — | — | — | — | — | 0.5 | 1.5 | 0.15 | B | E |
| Example 15A | (15) | PG36 | CB | — | 52 | — | — | — | 2.7 | 2.6 | 0.14 | E | H |
| Example 16A | (16) | PB7 | None | — | — | — | — | — | 0.4 | 1.2 | 0.15 | B | E |
| Example 17A | (17) | PB7 | CB | — | 46 | — | — | — | 2.8 | 2.8 | 0.15 | E | H |
| Example 18A | (18) | PB15:6 | None | — | — | — | — | — | 0.8 | 1.8 | 0.16 | B | E |
| Example 19A | (19) | PB15:6 | CB | — | 17 | — | — | — | 2.2 | 2.1 | 0.15 | E | H |
| Example 20A | (20) | PV23 | None | — | — | — | — | — | 0.3 | 1.5 | 0.14 | B | E |
| Example 21A | (21) | PV23 | CB | — | 16 | — | — | — | 2.3 | 2.5 | 0.14 | E | H |
| Example 22A | (22) | PR254 | PB15:3 | — | 2 | 158 | 30 | 161 | 1.3 | 1.8 | 0.15 | D | G |
| Example 23A | (23) | PO38 | PB15:3 | — | 11 | 175 | 42 | 174 | 1.7 | 1.7 | 0.15 | D | G |
| Example 24A | (24) | PG36 | PR122 | — | 15 | 162 | 1 | 161 | 1.4 | 1.4 | 0.15 | D | G |
| Example 25A | (25) | PB7 | PR122 | — | 9 | 178 | 0 | 158 | 1.3 | 1.5 | 0.16 | D | G |

TABLE 8

| | | Coloring agent | | | Difference in the respective color toner particles | | | | | | Coating layer | Evaluation | |
|---|---|---|---|---|---|---|---|---|---|---|---|---|---|
| | Mixed toner | First toner | Second toner | Third toner | Brightness difference | Hue difference (degree) | Saturation difference | ΔE | $\lvert P_1 - P_2 \rvert$ (mm) | $\lvert W_1 - W_2 \rvert$ (mm) | Average thickness (μm) | Recording medium 1 | Recording medium 2 |
| Example 26A | (26) | PB15:6 | PY74 | — | 63 | 180 | 30 | 191 | 1.9 | 1.8 | 0.15 | D | G |
| Example 27A | (27) | PR254 | PG36 | — | 11 | 124 | 14 | 158 | 1.2 | 1.3 | 0.16 | D | F |
| Example 28A | (28) | PR254 | PB7 | — | 5 | 144 | 15 | 167 | 1.6 | 1.5 | 0.15 | D | F |
| Example 29A | (29) | PR254 | PB15:6 | — | 24 | 116 | 20 | 150 | 1.8 | 1.7 | 0.15 | D | F |
| Example 30A | (30) | PO38 | PG36 | — | 2 | 107 | 26 | 154 | 1.9 | 1.8 | 0.13 | D | F |
| Example 31A | (31) | PO38 | PB7 | — | 4 | 127 | 27 | 167 | 1.4 | 1.3 | 0.15 | D | F |
| Example 32A | (32) | PO38 | PB15:6 | — | 33 | 133 | 32 | 171 | 1.9 | 1.8 | 0.15 | D | F |
| Example 33A | (33) | PG36 | PB15:6 | — | 35 | 120 | 6 | 140 | 1.8 | 1.9 | 0.14 | D | F |
| Example 34A | (34) | PG36 | PV23 | — | 36 | 150 | 6 | 161 | 1.2 | 1.3 | 0.17 | D | F |
| Example 35A | (35) | PB7 | PV23 | — | 30 | 130 | 1 | 148 | 1.1 | 1.1 | 0.15 | D | F |
| Example 36A | (36) | PV23 | PY74 | — | 64 | 150 | 24 | 189 | 1.2 | 1.1 | 0.15 | D | F |
| Example 37A | (37) | PR254 | PY74 | — | 39 | 64 | 10 | 104 | 1.4 | 1.3 | 0.15 | D | E |
| Example 38A | (38) | PR254 | PV23 | — | 25 | 86 | 14 | 127 | 1.3 | 1.4 | 0.14 | D | E |
| Example 39A | (39) | PO38 | PV23 | — | 34 | 103 | 26 | 152 | 1.7 | 1.7 | 0.16 | D | E |
| Example 40A | (40) | PG36 | PB15:3 | — | 13 | 78 | 16 | 93 | 1.4 | 1.2 | 0.15 | D | E |
| Example 41A | (41) | PB7 | PY74 | — | 34 | 80 | 25 | 131 | 1.3 | 1.1 | 0.15 | D | E |
| Example 42A | (42) | PB7 | PB15:6 | — | 29 | 100 | 5 | 122 | 1.8 | 1.8 | 0.14 | D | E |
| Example 43A | (43) | PV23 | PB15:3 | — | 23 | 72 | 6 | 70 | 1.2 | 1.5 | 0.15 | D | E |
| Example 44A | (44) | PB15:6 | PR122 | — | 20 | 78 | 1 | 97 | 1.2 | 1.7 | 0.15 | D | E |
| Example 45A | (45) | PR254 | PO38 | — | 9 | 17 | 12 | 30 | 1.1 | 1.7 | 0.14 | D | D |
| Example 46A | (46) | PR254 | PR122 | — | 4 | 38 | 15 | 65 | 1.3 | 1.4 | 0.15 | D | D |
| Example 47A | (47) | PO38 | PR122 | — | 13 | 55 | 27 | 93 | 1.2 | 1.3 | 0.16 | D | D |
| Example 48A | (48) | PO38 | PY74 | — | 30 | 47 | 2 | 81 | 1.5 | 1.4 | 0.15 | D | D |
| Example 49A | (49) | PG36 | PY74 | — | 28 | 60 | 24 | 109 | 1.4 | 1.1 | 0.15 | D | D |
| Example 50A | (50) | PG36 | PB7 | — | 6 | 20 | 1 | 28 | 0.7 | 0.5 | 0.15 | A | A |

TABLE 9

| | | Coloring agent | | | Difference in the respective color toner particles | | | | | | Coating layer | Evaluation | |
|---|---|---|---|---|---|---|---|---|---|---|---|---|---|
| | Mixed toner | First toner | Second toner | Third toner | Brightness difference | Hue difference (degree) | Saturation difference | ΔE | $\lvert P_1 - P_2 \rvert$ (mm) | $\lvert W_1 - W_2 \rvert$ (mm) | Average thickness (μm) | Recording medium 1 | Recording medium 2 |
| Example 51A | (51) | PB7 | PB15:3 | — | 7 | 58 | 15 | 70 | 0.6 | 0.8 | 0.15 | A | A |
| Example 52A | (52) | PB15:6 | PB15:3 | — | 22 | 42 | 10 | 58 | 0.9 | 0.7 | 0.14 | A | A |
| Example 53A | (53) | PB15:6 | PV23 | — | 1 | 30 | 6 | 40 | 1.3 | 1.1 | 0.15 | D | D |
| Example 54A | (54) | PV23 | PR122 | — | 21 | 48 | 1 | 66 | 1.3 | 1.2 | 0.15 | D | D |

TABLE 9-continued

| | | Coloring agent | | | Difference in the respective color toner particles | | | | | | Coating layer | Evaluation | |
|---|---|---|---|---|---|---|---|---|---|---|---|---|---|
| | | | | | | Hue | | | $\lvert P_1 - P_2 \rvert$ (mm) | $\lvert W_1 - W_2 \rvert$ (mm) | Average thickness (μm) | | |
| | Mixed toner | First toner | Second toner | Third toner | Brightness difference | difference (degree) | Saturation difference | ΔE | | | | Recording medium 1 | Recording medium 2 |
| Example 55A | (55) | PR122 | W | — | 46 | — | — | — | 2.5 | 2.4 | 0.14 | E | H |
| Example 56A | (56) | PB15:6 | W | — | 66 | — | — | — | 2.6 | 2.7 | 0.15 | E | H |
| Example 57A | (57) | CB | W | — | 81 | — | — | — | 2.8 | 2.9 | 0.15 | E | H |
| Example 58A | (58) | Y74 | PO38 | PR254 | 39 | 64 | 12 | 104 | 1.8 | 1.7 | 0.15 | D | E |
| Example 59A | (59) | PO38 | PB15:6 | — | 63 | 180 | 30 | 191 | 2.7 | 2.5 | 0.15 | E | I |
| Comparative Example 1A | (C1) | PO38 | PB15:6 | — | 63 | 180 | 30 | 191 | 3.3 | 3.5 | 0 | F | J |
| Comparative Example 2A | (C2) | PO38 | PB15:6 | — | 63 | 180 | 30 | 191 | 3.7 | 4.1 | 0 | F | J |

Form the above results, it is found that in the examples, as compared with the comparative examples, the generation of the areas having partially different colors is prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing mixed toner comprising:

a mixture of a first toner and a second toner, wherein the first toner comprises a plurality of first toner particles, wherein the second toner has a different color from that of the first toner, wherein the second toner comprises a plurality of second toner particles, and wherein, based on a charge distribution of each of the first toner and the second toner obtained according to a charge spectrograph method, maximum peak positions of the first toner and the second toner are taken as $P_1$ and $P_2$, respectively, and full widths at half maximum of the first toner and the second toner are taken as $W_1$ and $W_2$, respectively, $\lvert P_1-P_2 \rvert$ is 3 mm or less and $\lvert W_1-W_2 \rvert$ is 3 mm or less.

2. The electrostatic charge image developing mixed toner according to claim 1, wherein $\lvert P_1-P_2 \rvert$ is 2 mm or less, and $\lvert W_1-W_2 \rvert$ is 2 mm or less.

3. The electrostatic charge image developing mixed toner according to claim 1, wherein a color of the first toner is a chromatic color, and wherein a hue angle of the first toner is from 15 degrees to 75 degrees, from 115 degrees to 225 degrees, or from 255 degrees to 345 degrees.

4. The electrostatic charge image developing mixed toner according to claim 3, wherein a color of the second toner is a chromatic color, and wherein a difference between the hue angle of the first toner and a hue angle of the second toner is 150 degrees or lower.

5. The electrostatic charge image developing mixed toner according to claim 4, wherein a difference between the hue angle of the first toner and the hue angle of the second toner is 105 degrees or lower.

6. The electrostatic charge image developing mixed toner according to claim 4, wherein a difference between the hue angle of the first toner and the hue angle of the second toner is 60 degrees or lower.

7. The electrostatic charge image developing mixed toner according to claim 1, wherein the first toner particles and the second toner particles each include a core particle and a coating layer which covers the core particle and has an average thickness of 0.1 μm or more.

8. The electrostatic charge image developing mixed toner according to claim 7, wherein an average thickness of the coating layer is 0.15 μm or more.

9. An electrostatic charge image developer comprising an electrostatic charge image developing mixed toner according to claim 1.

10. A toner cartridge comprising:

a container that contains an electrostatic charge image developing mixed toner comprising:

a mixture of a first toner and a second toner, wherein the first toner comprises a plurality of first toner particles, wherein the second toner has a different color from that of the first toner, wherein the second toner comprises a plurality of second toner particles, wherein, based on a charge distribution of each of the first toner and the second toner obtained according to a charge spectrograph method, maximum peak positions of the first toner and the second toner are taken as $P_1$ and $P_2$, respectively, and full widths at half maximum of the first toner and the second toner are taken as $W_1$ and $W_2$, respectively, $\lvert P_1-P_2 \rvert$ is 3 mm or less and $\lvert W_1-W_2 \rvert$ is 3 mm or less, and wherein the toner cartridge is detachable from an image forming apparatus.

* * * * *